US006530351B2

(12) United States Patent
Mikame

(10) Patent No.: US 6,530,351 B2
(45) Date of Patent: Mar. 11, 2003

(54) APPARATUS FOR CONTROLLING VALVE TIMING OF INTERNAL COMBUSTION ENGINE

(75) Inventor: Kazuhisa Mikame, Nagoya (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/785,266

(22) Filed: Feb. 20, 2001

(65) Prior Publication Data

US 2001/0017114 A1 Aug. 30, 2001

(30) Foreign Application Priority Data

Feb. 22, 2000 (JP) ..... 2000-044708

(51) Int. Cl.[7] ..... F01L 1/34

(52) U.S. Cl. ..... 123/90.15; 123/90.16; 123/90.17; 123/339.24

(58) Field of Search ..... 123/339.24, 491, 123/492, 90.15, 90.16, 90.17, 90.18

(56) References Cited

U.S. PATENT DOCUMENTS 5,293,741 A 3/1994 Kashiyama et al.
5,558,051 A 9/1996 Yoshioka
5,893,345 A 4/1999 Sugimoto et al.
5,960,755 A * 10/1999 Diggs et al. ..... 123/568.14
6,085,706 A * 7/2000 Kadowaki et al. ..... 123/198 D
6,109,225 A * 8/2000 Ogita et al. ..... 123/90.15
6,240,359 B1 * 5/2001 Fujiwara et al. ..... 123/90.15

FOREIGN PATENT DOCUMENTS

EP 0 915 234 A2 5/1999
EP 0 937 865 A1 8/1999

* cited by examiner

*Primary Examiner*—Thomas Denion
*Assistant Examiner*—Jaime Corrigan
(74) *Attorney, Agent, or Firm*—Oliff & Berridge, PLC

(57) ABSTRACT

An apparatus controls valve timing of an internal combustion engine that is provided with helical splines of an actuator for varying a phase difference in rotation and an actuator for varying a cam profile and lift of an intake cam. When the apparatus for controlling valve timing and respective actuators are not driven, a valve timing can be automatically established, which can achieve a cold valve overlap θov. Carburetion of fuel can be promoted in the combustion chamber and intake ports by the blow-back of exhaust resulting from the cold valve overlap θov. A mixture is made into a sufficient air-fuel ratio without depending on an increase in fuel when cold idling, wherein combustion is stabilized still more than in a case where valve overlap is not increased, cold hesitation can be prevented from occurring, and drivability can be maintained in a comparatively favorable state.

14 Claims, 43 Drawing Sheets

Ex : EXHAUST VALVE LIFT PATTERN
In : INTAKE VALVE LIFT PATTERN

[ MAP A ]

[ MAP B ]

APPARATUS FOR CONTROLLING VALVE TIMING OF INTERNAL COMBUSTION ENGINE

INCORPORATION BY REFERENCE

The disclosure of Japanese Patent Application No. 2000-44708 filed in Feb. 22, 2000 including the specification, drawings and abstract is incorporated herein by reference in its entirety.

BACKGROUND OF THE INVENTION

1. Field of the Invention

The invention relates to an apparatus for controlling valve timing of an internal combustion engine, which varies valve overlap in response to running conditions of the internal combustion engine.

2. Description of Related Art

Such a technology has been publicly known which achieves preferable performance of an internal combustion engine by controlling valve timing of an intake valve and an exhaust valve in response to running conditions of the internal combustion engine incorporated in a vehicle, etc. In such a technology, in order to take into consideration the combustion stability during the idling of an internal combustion engine, the combustion stability has been secured by lowering the amount of the remaining gas in a combustion chamber by preventing the valve opening periods of the intake valve and the exhaust valve from overlapping. (Japanese Patent Laid-Open Publication No. HEI 05-71369).

By controlling a valve timings of the intake valve and the exhaust valve so that such valve overlap is not produced in such an idling state, fuel that is injected through a fuel injection valve is adhered to an intake port and the inner surface of the combustion chamber when the engine is still cold, and the mixture becomes leaner than a predetermined air-fuel ratio, thereby causing the combustion to become unstable, wherein the drivability may be lowered due to cold hesitation.

Also, where the fuel injection amount is increased when cold in order to prevent such cold hesitation, the fuel efficiency and emission may be worsened.

SUMMARY OF THE INVENTION

The present invention was developed in order to solve the aforementioned problem. It is therefore an object of the invention to prevent the cold hesitation by suppressing becoming lean of the air-fuel ratio without increasing the fuel at cold idling.

In order to achieve the aforementioned object, one aspect of the invention is providing an apparatus for controlling the valve timing of an internal combustion engine, which varies valve overlap in response to running conditions of the internal combustion engine, wherein the valve overlap when cold idling is made larger than that when hot idling.

In the apparatus for controlling valve timing, when cold running, the valve overlap is made larger than that when hot running even in the case of idling. Fuel carburetion is increased in the combustion chamber and intake port due to blow-back of exhaust from an exhaust port and combustion chamber. Therefore, even if fuel injected from a fuel injection valve is adhered to the intake port and the inner surface of the combustion chamber when cold running, it is instantaneously carbureted. Accordingly, the mixture is subject to a sufficient air-fuel ratio without increasing the fuel supplied to the combustion chamber, wherein combustion will be further stabilized rather than in the case where the valve overlap is not increased, and cold hesitation can be prevented to maintain the drivability in a comparatively favorable state. Further, since the fuel does not have to be increased, it is possible to prevent fuel efficiency and emission from worsening.

Also, taking fuel stability into consideration when cold idling, the valve overlap is made smaller when hot idling than when cold idling. For example, an attempt was made so that the valve overlap does not occur. Therefore, the amount of the remaining gas in the combustion chamber is reduced, wherein it is possible to sufficiently stabilize the fuel.

In addition, in the apparatus for controlling valve timing, the valve opening period of both or any one of the intake valve and exhaust valve is controlled so that the valve overlap when cold idling is generated when an internal combustion engine is in cold idling, and no valve overlap is generated when hot idling thereof.

For example, by differently using the valve overlap in such cold idling and hot idling, the amount of the remaining gas is decreased when hot idling in which the fuel carburetion is sufficient, whereby an attempt is made so that the fuel stability becomes sufficient. And, when cold idling in which fuel carburetion is not usually sufficient, fuel is sufficiently carbureted due to blow-back of the exhaust to stabilize the combustion, thereby bringing about the aforementioned effect.

Another aspect of the invention is providing an apparatus for controlling valve timing, having a variable valve overlap mechanism that adjusts valve overlap by varying both or any one of the valve closing timing of an intake valve and the valve opening timing of an exhaust valve in an internal combustion engine and achieves valve overlap when cold running when the variable valve overlap mechanism itself does not operate.

The variable valve overlap mechanism is devised to be set to a timing that achieves valve overlap for cold running where the variable valve overlap mechanism itself does not operate. Therefore, even in a case where the variable valve overlap mechanism cannot be driven due to an insufficient output of oil pressure, etc., when cold running just after the starting of an internal combustion engine, the variable overlap mechanism is set to a valve timing that achieves valve overlap for cold running, before the starting of the internal combustion engine after the stop of the internal combustion engine. Therefore, in a situation such that the variable valve overlap mechanism does not sufficiently function when cold idling just after starting of the internal combustion engine, it is possible to achieve valve timing for cold running. It is possible to provide necessary valve overlap, for example, a state where no valve overlap is provided, and a state that larger valve overlap is secured than the valve overlap for cold running, since the valve overlap mechanism can be driven after the warm-up of the internal combustion engine.

Therefore, the mixture will have a sufficient air-fuel ratio without increasing the amount of the fuel into the combustion chamber when cold idling, and combustion can be stabilized still further than in the case of not increasing the valve overlap, and the cold hesitation can be prevented, wherein drivability can be maintained in a comparatively favorable state, and no increase in fuel consumption is required. The fuel efficiency and emission can be prevented from worsening. Accordingly, for example, when hot idling in which fuel carburetion is sufficient, the amount of the remaining gas in the combustion chamber is reduced, thereby achieving sufficient stabilization of combustion.

In addition, the variable valve overlap mechanism may be provided with one or both of an intake cam and an exhaust cam, whose profiles differ from each other in the rotation axis direction, a rotation direction shifter that can vary the valve overlap by consecutively adjusting the valve lift by adjusting the position in the rotation axis direction with respect to the cams whose profiles are different from each other in the aforementioned rotation axis direction, and a valve overlap setter for non-operation state, which when the variable valve overlap mechanism does not operate, sets the position of the cams in the rotation axis direction to the position corresponding to the valve timing at which the aforementioned valve overlap for cold running can be achieved.

The variable valve overlap mechanism is provided with one or both of an intake cam and an exhaust cam whose profiles differ from each other in the rotation axis direction. And, the cam is adjusted by the rotation axis direction shifter with respect to the position thereof in the rotation axis direction, whereby the valve lift is consecutively adjusted to enable consecutive changes in the valve timing.

And, when the variable valve overlap mechanism does not operate, the valve overlap setter for the non-operation state sets the position of the cam in the rotation axis direction to the position corresponding to the valve timing at which the valve overlap for cold running can be achieved.

In such a construction, in a case where the variable valve overlap mechanism cannot be driven due to the insufficient output of oil pressure, etc., when cold running after the starting of an internal combustion engine, the valve overlap setter for the non-operation state sets the position of the cam in the rotation axis direction to the position where the valve overlap for cold running can be achieved. Therefore, in a situation such that the variable overlap mechanism cannot be sufficiently driven when cold idling after the starting of the combustion engine, it is possible to achieve the valve overlap for cold running. Since the variable overlap mechanism can be driven after the internal combustion engine is warmed up, it is possible to achieve the required valve overlap, for example, a state in which the valve overlap is eliminated, or a state in which a valve overlap is secured that is larger than the valve overlap for cold running.

Accordingly, a mixture can be subject to a sufficient air-fuel ratio without increasing the fuel even when cold idling, and combustion is better stabilized than in the case of not increasing the valve overlap, wherein the cold hesitation can be prevented from occurring, and the drivability can be maintained at a comparatively favorable state. Further, fuel efficiency and emission can be prevented from worsening without requiring the fuel increase. Also, when hot idling where the fuel carburetion is sufficient, the amount of the remaining gas in the combustion chamber is reduced, thereby achieving sufficient stabilization of combustion.

In addition, the aforementioned cam is formed so that the valve lift may consecutively vary in the rotation axis direction. It may be shaped so that the valve overlap for cold running can be achieved at the position in the rotation axis direction where the valve lift assumes the minimum value.

According to such the cam, a thrust force acting in the direction along which the valve lift is decreased is generated at the camshaft by a pressing force from the valve lifter side which is brought into contact with the cam and causes the lift of the intake valve and exhaust valve to follow the cam surface. Therefore, when the variable valve overlap mechanism does not operate, it enters the most stabilized state such that the valve lifter is brought into contact with the position in the rotation axis direction, where the valve lift assumes the minimum value, in the position of the rotation axis direction.

Therefore, in a situation such that the variable valve overlap mechanism cannot operate sufficiently when cold idling after the starting of an internal combustion engine, since the valve lifter can function as a valve overlap setter for non-operation state, valve overlap for cold running can be naturally achieved. Since the variable valve overlap mechanism can be driven after the engine is warmed up, it will become possible to achieve the required valve overlap by the function of the rotation axis direction shifter, that is, it will become possible for the valve overlap to be eliminated, for example.

Further, the aforementioned valve overlap setter for non-operation state may be constructed as a rotation axis presser that makes the position in the rotation axis direction which has such a profile in which the valve lift is minimized, into a stabilized stop position when the cam is not driven.

By the rotation axis presser that makes the position in the rotation axis direction, which has such a profile in which the valve lift is minimized, into a stabilized stop position when the cam is not driven, the valve overlap setter for non-operation state may be achieved. In such a case, in a situation such that the variable valve overlap mechanism cannot be sufficiently driven when cold idling after the starting of an internal combustion engine, the rotation axis presser can achieve valve overlap for cold running. Since the variable valve overlap mechanism can be sufficiently driven after warm-up of the internal combustion engine, required valve overlap can be acquired against a pressing force of the rotation axis presser by the function of the rotation axis direction shifter, or the valve overlap can also be eliminated.

Further, the variable valve overlap mechanism enables adjustment of the valve overlap by varying a phase difference in rotation between the intake cam and exhaust cam of an internal combustion engine, and when the variable valve overlap mechanism itself is not driven, the aforementioned phase difference in rotation may become a phase difference in rotation, by which cold valve overlap can be achieved.

The variable valve overlap mechanism can adjust the valve overlap by varying the phase difference in rotation between the intake cam and exhaust cam. When the variable valve overlap mechanism is not driven, the valve overlap for cold running can be achieved by the phase difference in rotation.

Therefore, in the case where the variable valve overlap mechanism cannot be sufficiently driven due to an insufficient output of oil pressure, etc., when cold running after the starting of an internal combustion engine, the valve overlap mechanism has a phase difference in rotation to achieve cold valve overlap from when the engine stops to when the engine starts. Therefore, in a situation such that the variable valve overlap mechanism cannot be sufficiently driven when cold idling after the starting of an internal combustion engine, valve overlap for cold running can be achieved. And, since the variable valve overlap mechanism can be driven after warm-up of an internal combustion engine, and a phase difference in rotation can be adjusted, any required valve overlap can be secured, that is, it is possible to eliminate the valve overlap or to provide a larger valve overlap than the valve overlap for cold running.

For this reason, the mixture can be made into a sufficient air-fuel ratio without increasing the fuel when cold idling, and combustion is better stabilized than in the case of not increasing the valve overlap. As a result, cold hesitation can be prevented from occurring, and the drivability can be maintained in a comparatively favorable state. Furthermore, fuel efficiency and emission can be prevented from worsening, without requiring the increase in the fuel. The amount of the remaining gas in the combustion chamber is reduced when hot idling in which fuel carburetion is sufficient, and combustion can be better stabilized.

Still further, the variable valve overlap mechanism of an internal combustion engine may be provided with a rotation phase difference adjuster that is capable of adjusting the valve overlap by varying the phase difference in rotation between an intake cam and an exhaust cam, and a valve overlap setter for the non-operation state, in which, when the variable valve overlap mechanism is not driven, the phase difference in rotation between the intake cam and the exhaust cam by the aforementioned rotation phase difference adjuster is made into a phase difference in rotation by which valve overlap for cold running can be achieved.

In the variable valve overlap mechanism, when the variable valve overlap mechanism is not driven, the valve overlap setter for the non-operation state makes the phase difference in rotation between the intake cam and exhaust cam by the rotation phase difference adjuster into a phase difference in rotation at which valve overlap for cold running can be achieved.

In such a construction, even in a case where the variable valve overlap mechanism can not be sufficiently driven due to insufficient oil pressure, etc., when cold running after the starting of an internal combustion engine, the valve overlap setter for the non-operation state can bring about a phase difference in rotation, by which valve overlap for cold running can be achieved. Therefor, in a situation such that the variable valve overlap mechanism cannot be sufficiently driven when cold idling after the starting of the engine, it will become possible to achieve valve overlap for cold idling. Since the variable valve overlap mechanism can be driven after warm-up of the engine, it is possible to obtain the required valve overlap by the rotation phase difference adjuster. For example, valve overlap can be eliminated or a larger valve overlap can be obtained than the valve overlap for cold running.

Therefore, the mixture can be made into a sufficient air-fuel ratio without increasing the fuel when cold idling, and combustion is better stabilized than in the case of not increasing the valve overlap. As a result, cold hesitation can be prevented from occurring, and the drivability can be maintained in a comparatively favorable state. Furthermore, the fuel cost and emission can be prevented from worsening, without depending on an increase in the fuel. The amount of the remaining gas in the combustion chamber is reduced when hot idling in which fuel carburetion is sufficient, and the combustion can be better stabilized.

Still further, the variable valve overlap mechanism of an internal combustion engine may be provided with a rotation phase difference adjuster that is capable of adjusting valve overlap by varying the phase difference in rotation between an intake cam and an exhaust cam, and a valve overlap setter for the non-operation state, in which, the variable valve overlap mechanism is not driven after the cranking of an internal combustion engine, the phase difference in rotation between the intake cam and the exhaust cam by the aforementioned rotation phase difference adjuster is made into a phase difference in rotation, achieving valve overlap for cold running.

In the variable valve overlap mechanism, when the variable valve overlap mechanism is not driven after the cranking of an internal combustion engine, the valve overlap setter for the non-operation state makes a phase difference in rotation between the intake cam and exhaust cam by the rotation phase difference adjuster into a phase difference in rotation, by which the valve overlap for cold running can be achieved.

In such a construction, even in a case where the variable valve overlap mechanism can not be sufficiently driven due to an insufficient output of oil pressure, etc., when cold running after the starting of an internal combustion engine, the valve overlap setter for the non-operation state can already bring about a phase difference in rotation, achieving the valve overlap for cold running, till the cranking. Therefore in a situation such that the variable valve overlap mechanism cannot be sufficiently driven when cold idling after the starting of the engine, it will become possible to achieve the valve overlap for cold idling. Since the variable valve overlap mechanism can be driven after warm-up of the engine, it is possible to obtain the required valve overlap by the rotation phase difference adjuster. For example, valve overlap can be eliminated or a larger valve overlap can be obtained than the valve overlap for cold running.

Therefore, the mixture can be made into a sufficient air-fuel ratio without increasing the fuel when cold idling, and combustion is better stabilized than in the case of not increasing the valve overlap, wherein cold hesitation can be prevented from occurring, and drivability can be maintained in a comparatively favorable state. Furthermore, fuel efficiency and emission can be prevented from worsening, without depending on an increase in the fuel. And, the amount of the remaining gas in the combustion chamber is reduced when hot idling in which fuel carburetion is sufficient, and the combustion can be better stabilized.

A variable overlap mechanism of an internal combustion engine according to one embodiment of the invention comprises: one or both the intake cam and exhaust cam whose valve lifts consecutively varies in the direction of the rotation axis; a rotation axis direction shifter that is capable of varying the valve timing by consecutively controlling the valve lifts by adjusting the position in the direction of the rotation axis with respect to the aforementioned cam; a rotation phase difference adjuster that is capable of varying the phase difference in rotation between the intake cam and exhaust cam; and a coupler that couples the aforementioned rotation axis direction shifter and the aforementioned rotation phase difference adjuster with each other, and that, as the aforementioned cam moves to the position in the direction of the rotation axis where the valve lift is the minimum when the variable valve overlap mechanism is not driven, can achieve the valve overlap for cold running by varying a change in the phase difference in rotation between the intake cam and exhaust cam in synchronization with adjustment of the position of cams in the direction of the rotation axis by the aforementioned rotation axis direction shifter.

Thus, the variable valve overlap mechanism may be provided with both the rotation axis direction shifter and rotation phase difference adjuster. In this case, the rotation axis direction shifter is coupled with the rotation phase difference adjuster by a coupler. The coupler is constructed to vary a change in the phase difference in rotation between the intake cam and exhaust cam in response in synchronization wiht the adjustment of the position of cams in the direction of the rotation axis by the rotation axis direction shifter. By this, as the cams move to the position in the direction of the rotation axis where the valve lift assumes the minimum value when the variable valve overlap mechanism is not driven, the valve overlap for cold running can be achieved by the movement.

In such a construction, even in a case where the variable valve overlap mechanism cannot be driven due to an insufficient output of oil pressure, etc., when cold running after the starting of an internal combustion engine, the valve overlap for cold running can be achieved by the coupler. And, since the variable valve overlap mechanism can be produced after the engine is warmed up, required valve overlap can be brought about by one or both of the rotation axis direction shifter and rotation phase difference adjuster. For example, no valve overlap is provided, or a larger valve overlap than the valve overlap for cold running can be achieved.

Therefore, the mixture can be made into a sufficient air-fuel ratio without increasing the fuel when cold idling, and the combustion is better stabilized than in the case of not increasing the valve overlap, wherein cold hesitation can be prevented from occurring, and the drivability can be maintained in a comparatively favorable state. Furthermore, the fuel cost and emission can be prevented from worsening because the increase in the fuel is not required. The amount of the remaining gas in the combustion chamber is reduced when hot idling in which fuel carburetion is sufficient, and the combustion can be better stabilized.

The aforementioned coupler is caused to move in the direction along which the phase difference in rotation between the intake cam and exhaust cam makes the valve overlap smaller in response to an increase in the valve lift by adjusting the position of the cams in the direction of the rotation axis by the rotation axis direction shifter, by coupling the rotation axis direction shifter and the rotation phase difference adjuster with each other by a helical spline mechanism.

Thus, the coupler is provided with the helical spline mechanism that connects the rotation axis direction shifter to the rotation phase difference adjuster. In the helical spline mechanism, the phase difference in rotation between the intake cam and exhaust cam makes the valve overlap become smaller in response to an increase in the valve lift by adjusting the position of the cam in the rotation axis direction by the rotation axis direction shifter. That is, it is devised that the valve overlap is made larger in response to the valve lift becoming smaller.

Therefore, by a thrust force generated by a pressing force of a valve lifter that is brought into contact with the cam and that causes the lift of the intake valve and exhaust valve to follow the cam surface, it enters the most stabilized state such that the valve lifter is brought into contact with the position in the direction of the rotation axis where the valve lift assumes the minimum value in the position in rotation axis direction when the variable valve overlap mechanism is not driven. As the valve lift is adjusted to the minimum value, the phase difference in rotation between the intake cam and exhaust cam is adjusted by the helical spline mechanism so that the valve overlap becomes large, achieving valve overlap for cold running.

Therefore, under the situation that the variable overlap mechanism cannot be sufficiently driven when cold running after the starting of engine, it is possible to naturally achieve the valve overlap for cold running. Since the variable valve overlap mechanism can be driven after the engine is warmed up, it is possible to achieve the required valve overlap by the functions of the rotation axis direction shifter and rotation phase difference adjuster, and for example, the valve overlap can be also eliminated.

Also, an apparatus for controlling valve timing in an internal combustion engine according to one embodiment of the present invention may be provided with: a variable valve overlap mechanism for an internal combustion engine; a running status detector for detecting the running state of the internal combustion engine; and a valve overlap controller that, in the case where the running status of the internal combustion engine detected by the aforementioned running status detector indicates cold idling, can maintain the valve overlap for cold running, which is achieved when the variable overlap mechanism is not driven before the starting of the internal combustion engine, and in the case where the running status of the internal combustion engine detected by the aforementioned running status detector indicates hot idling, can eliminate any valve overlap or employ valve overlap which is smaller than the valve overlap for cold running, by driving the variable valve overlap mechanism, and in the case where the running status of the internal combustion engine detected by the aforementioned running status detector indicates a hot non-idling state, can employ valve overlap larger than the valve overlap in the aforementioned hot idling state by driving the variable valve overlap mechanism.

The valve overlap mechanism maintains valve overlap for cold running, which is achieved when the variable valve overlap mechanism is not driven before the starting of an internal combustion engine in a case where the running status of the internal combustion engine, which is detected by the running status detector, indicates cold idling. Also, it eliminates the valve overlap by driving the variable valve overlap mechanism or adjust to the valve overlap for hot running, which is smaller than the valve overlap for cold running, in a case where the running status of the internal combustion engine, which is detected by the running status detector, indicates hot idling. Still further, the variable valve overlap mechanism employs valve overlap which is larger than the valve overlap for hot idling by driving the variable valve overlap mechanism in a case where the running status of the internal combustion engine, which is detected by the running status detector, indicates hot non-idling.

Thereby, the mixture will have a sufficient air-fuel ratio without an increase in the fuel when cold idling, and the combustion can be stabilized still further than in the case of not increasing the valve overlap, and the cold hesitation can be prevented, wherein the drivability can be maintained at a comparatively favorable state, and no increase in fuel consumption is required. The fuel cost and emission can be prevented from worsening. Accordingly, for example, when hot idling in which fuel carburetion is sufficient, the amount of the remaining gas in the combustion chamber is reduced, and the combustion can be sufficiently stabilized.

In addition, an apparatus for controlling valve timing in an internal combustion engine according to one embodiment of the invention, may be provided with: a variable valve overlap mechanism for an internal combustion engine; a running status detector that detects the running state of the internal combustion engine; and a valve overlap control device that, in the case where the running status of the internal combustion engine detected by the aforementioned running status detector indicates cold idling, can maintain the valve overlap for cold running, which is achieved when the variable overlap mechanism is not driven before the starting of the internal combustion engine, and in the case where the running status of the internal combustion engine detected by the aforementioned running status detector indicates other hot states, can employ valve overlap responsive to the running status of the internal combustion engine by driving the aforementioned variable valve overlap mechanism.

The valve overlap control device can maintain the valve overlap for cold running, which is achieved when the variable overlap mechanism is not driven before the starting of the internal combustion engine in the case where the running status of the internal combustion engine detected by the aforementioned running status detector indicates cold idling, and can employ a valve overlap responsive to the running status of the internal combustion engine by driving the aforementioned variable valve overlap mechanism in the case where the running status of the internal combustion engine detected by the aforementioned running status detector indicates other hot states.

Therefore, the mixture can be made into a sufficient air-fuel ratio without increasing the fuel when cold idling, and combustion is better stabilized than in the case of not increasing the valve overlap, wherein cold hesitation can be prevented from occurring, and the drivability can be maintained in a comparatively favorable state. Furthermore, fuel efficiency and emission can be prevented from worsening, without depending on an increase in the fuel. And, the amount of the remaining gas in the combustion chamber is reduced when hot idling in which fuel carburetion is sufficient, and combustion can be better stabilized.

The embodiment of the invention is not limited to the apparatus for controlling valve timing as described above. Another embodiment of the invention is, for example, a vehicle in which an apparatus for controlling valve timing is incorporated, and it relates to a method for controlling valve timing of an internal combustion engine.

DETAILED DESCRIPTION OF PREFERRED EMBODIMENTS

Figure 1:
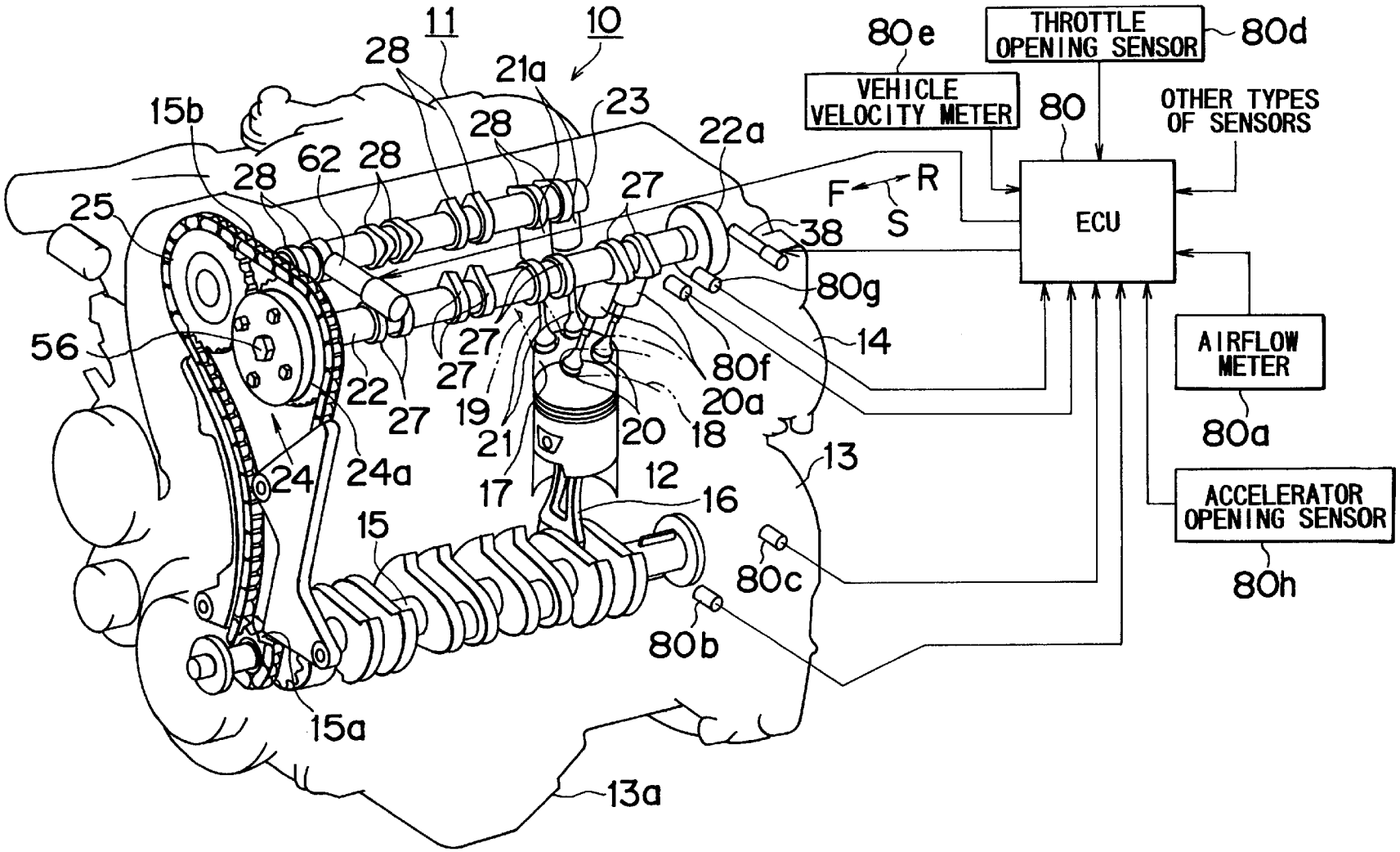
FIG. 1 is a general configuration view illustrating the valve operating system in an engine according to one embodiment of the invention.

In FIG. 1, a general construction of the valve operating system in a four-cylinder gasoline engine 11 incorporated in a vehicle and equipped with a valve characteristics controlling apparatus 10 is shown. The valve characteristics controlling apparatus 10 is installed on the intake side camshaft 22 in the engine 11. The engine 11 is such that the valve operating system is a DOHC (Double Over Head Camshaft), and it is a four-valve engine consisting of two valves as the intake valves 20 and two valves as the exhaust valves 21.

The engine 11 is provided with a cylinder block 13 in which reciprocating pistons 12 are incorporated; an oil pan 13*a* secured beneath the lower side of the cylinder block 13; and a cylinder head 14 installed on the upper side of the cylinder block 13. A crankshaft 15 that is an output shaft is supported so as to rotate at the lower part of the engine 11, and a piston 12 is coupled to the crankshaft 15 via a connecting rod 16. Reciprocation of the piston 12 is converted to rotation of the crankshaft 15 by the connecting rod 16. Also, a combustion chamber 17 is secured above the piston 12, and intake ports 18 and exhaust ports 19 are connected to the combustion chamber 17. Intake valves 20 control communication and interruption between the intake ports 18 and the combustion chamber 17 and exhaust valves 21 control communication and interruption between the exhaust ports 19 and the combustion chamber 17.

On the other hand, an intake side camshaft 22 and exhaust side camshaft 23 are mounted in the cylinder head 14 in parallel to each other. The intake side cam shaft 22 is supported on the cylinder head 14 so as to rotate and to move in the axial direction while the exhaust side camshaft 23 is supported on the cylinder head 14 so as to rotate but so as not to move in the axial direction.

One end of the intake side camshaft 22 is provided with a timing sprocket 24*a*, and an actuator 24 for varying a rotation phase difference is provided at the end of the intake camshaft 22 in order to vary a phase difference in rotation between the crankshaft 15 and the intake side camshaft 22. Also, the other end of the intake side camshaft 22 is provided with a lift-varying actuator 22*a* that moves the intake side camshaft 22 in the direction of the rotation axis. In addition, one end of the exhaust side camshaft 23 is provided with a timing sprocket 25. The timing sprocket 25 and timing sprocket 24*a* for the actuator 24 for varying the phase difference in rotation is connected to the timing sprocket 15*a* attached to the crankshaft 15 via a timing chain 15*b*. Rotation of the crankshaft 15 acting as a drive side rotation axis is transmitted to the intake side camshaft 22 and exhaust side camshaft 23 as driven side rotation axes by means of the timing chain 15*b*, whereby the intake side camshaft 22 and exhaust side camshaft 23 rotate in synchronization with the rotation of the crankshaft 15. Further, in the example shown in FIG. 1, the crankshaft 15, intake side camshaft 22 and exhaust side camshaft 23 rotate rightward (clockwise) when being observed from the side where the timing sprocket 15*a*, 24*a* and 25 are secured.

The intake side camshaft 22 has an intake cam 27 brought into contact with a cam follower 20*b* (FIG. 2) secured at a valve lifter 20*a* which is attached to the upper end of the intake valve 20. Also, the exhaust side camshaft 23 has an exhaust cam 28 brought into contact with a valve lifter 21*a* secured at the valve lifter 21*a* which is attached to the upper end of the exhaust valve 21. As the intake side camshaft 22 rotates, the intake valve 20 is driven to open and close by the intake cam 27, and as the exhaust side camshaft 23 rotates, the exhaust valve 21 is driven to open and close by the exhaust cam 28.

Herein, while the cam profile of the exhaust cam 28 is fixed with respect to the direction of the rotation axis of the exhaust side camshaft 23, the cam profile of the intake cam 27 consecutively varies in the direction of the rotation axis of the intake side camshaft 22 as described later. That is, the intake cam 27 is constituted as a three-dimensional cam.

Next, described are the lift-varying actuator 22*a* and the actuator 24 for varying a phase difference in rotation, which constitute the valve characteristic controlling apparatus 10 with reference to FIG. 2 through FIG. 6.

Figure 2:
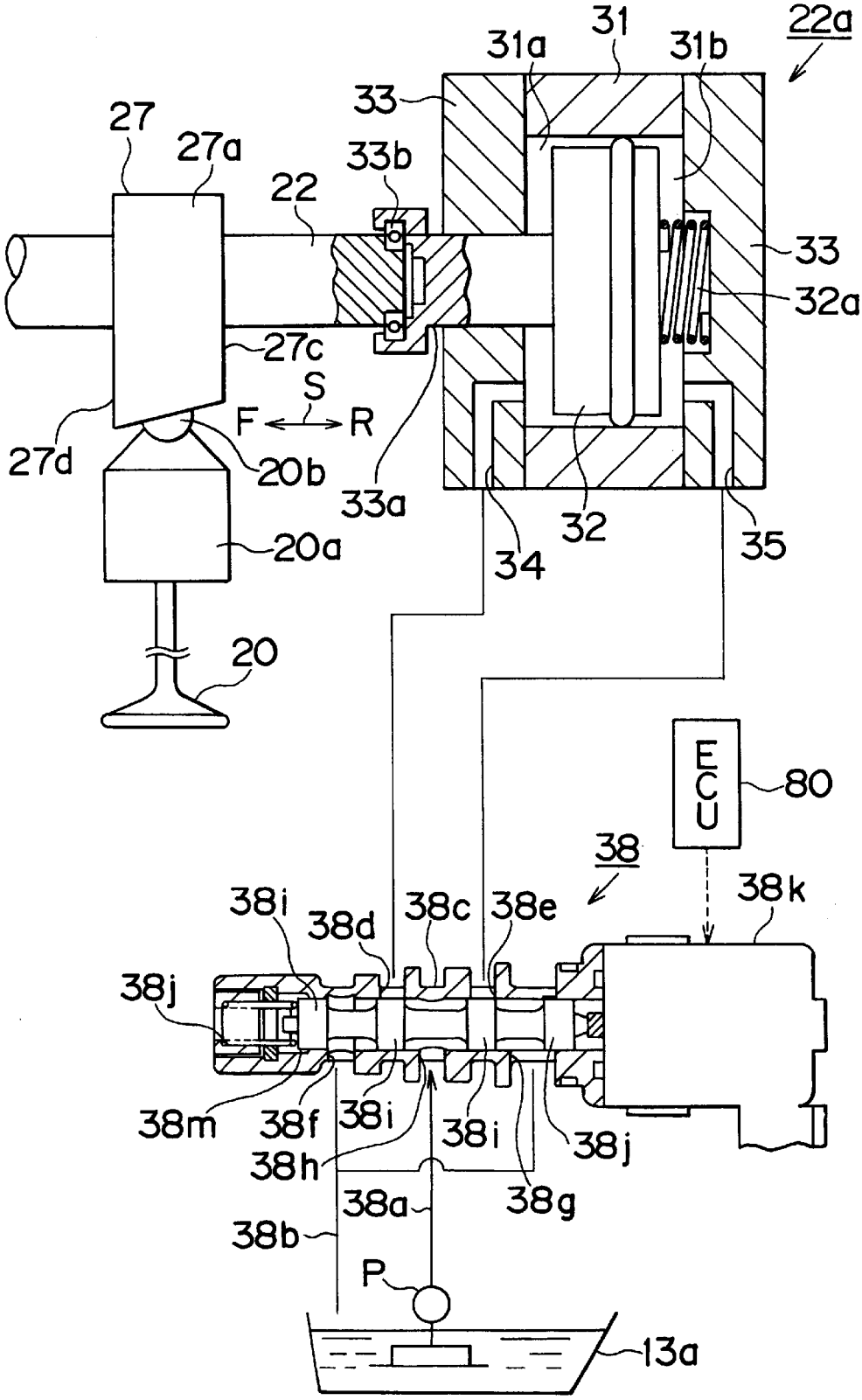
FIG. 2 is a view illustrating a construction of a lift-varying actuator according to the embodiment.
Figure 3:
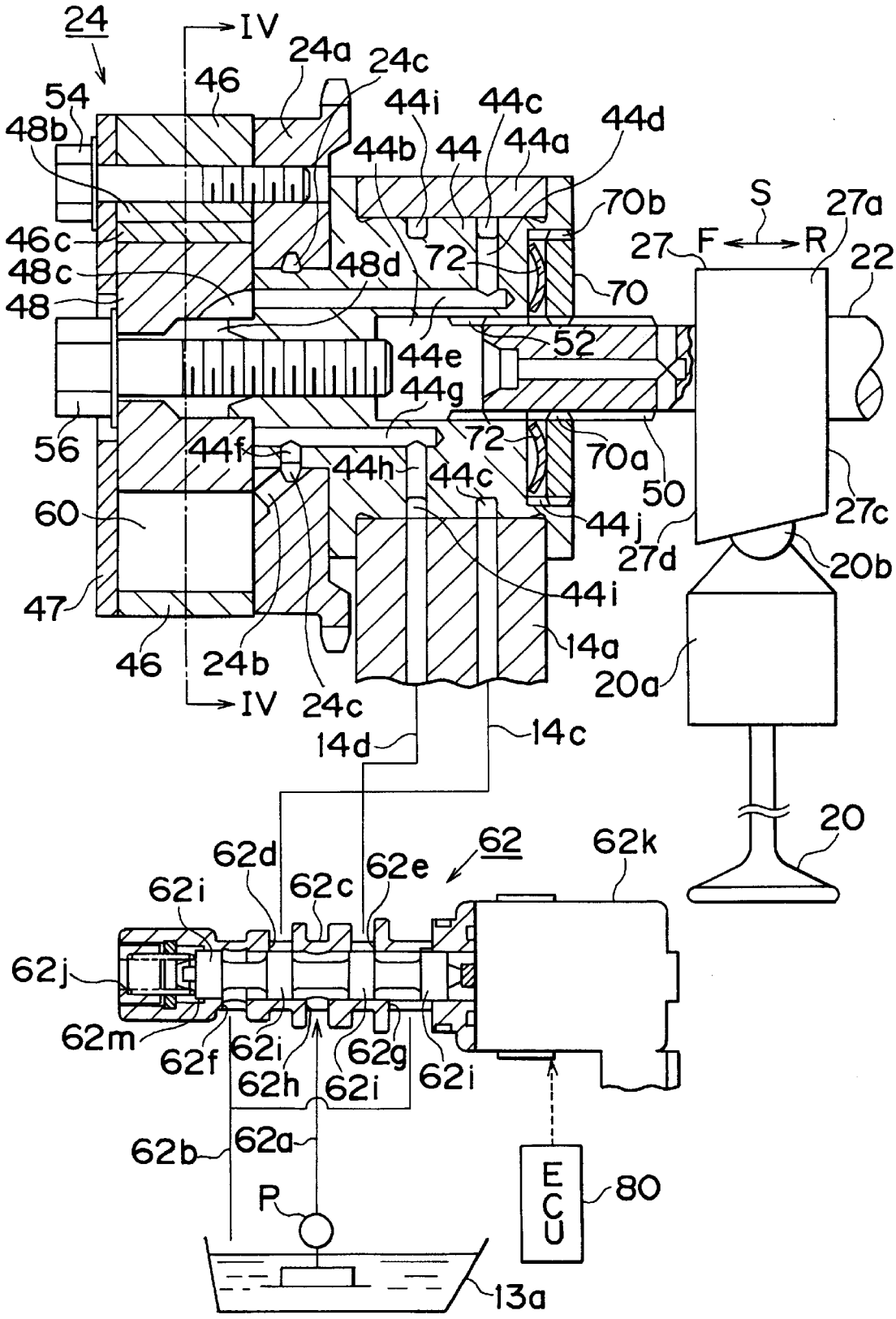
FIG. 3 is a view explaining the construction of an actuator for varying a rotation phase difference according to the embodiment.

FIG. 2 shows a sectional structure of the lift-varying actuator 22*a* and its surrounding part, and FIG. 3 shows a sectional structure of the actuator 24 for varying a phase difference in rotation and its surrounding part. The actuator 24 for varying a phase difference in rotation is secured at the tip end of the intake side camshaft 22, and the lift-varying actuator 22*a* is secured at the rear end of the intake side camshaft 22.

As shown in FIG. 2, the lift-varying actuator 22*a* is composed of a cylindrically shaped cylinder tube 31, a piston 32 secured in the cylinder tube 31, a pair of end covers 33 secured so as to block both-end openings of the cylinder tube 31, and a compressed compression spring 32*a* disposed between the piston 32 and an end cover 33 at the right side in FIG. 2. The cylinder tube 31 is fixed at the cylinder head 14.

The intake side camshaft 22 is connected to the piston 32 via an auxiliary shaft 33*a* passed through one end cover 33.

A rolling bearing 33*b* intervenes between the auxiliary shaft 33*a* and the intake side camshaft 22, and the lift-varying actuator 22*a* causes the rotating intake side camshaft 22 to smoothly move in the direction S of the rotation axis via the auxiliary shaft 33*a* and rolling bearing 33*b*.

The cylinder tube 31 is divided into the first oil pressure chamber 31*a* and the second oil pressure chamber 31*b* by the piston 32. The first supply and discharge passage 34 formed in one end cover 33 is connected to the first oil pressure chamber 31*a*, and the second supply and discharge passage 35 formed in the other end cover 33 is connected to the second oil pressure chamber 31*b*.

As a working oil is selectively supplied to the first oil pressure chamber 31 a and the second oil pressure chamber 31*b* via the first supply and discharge passage 34 and the second supply and discharge passage 35, the piston 32 is caused to move in the direction S of the rotation axis of the intake side camshaft 22. In line with the movement of the piston 32, the intake side camshaft 22 also moves in the direction S of the rotation axis.

The first supply and discharge passage 34 and the second supply and discharge passage 35 are connected to the first oil control valve 38. A supply passage 38*a* and a discharge passage 38*b* are connected to the first oil control valve 38. And, the supply passage 38*a* is connected to an oil pan 13*a* via an oil pump P that is driven in line with rotation of the crankshaft 15, and the discharge passage 38*b* is directly connected to the oil pan 13*a*.

The first oil control valve 38 is provided with a casing 38*c* that is provided with the first supply and discharge port 38*d*, the second supply and discharge port 38*e*, the first discharge port 38*f*, the second discharge port 38*g*, and supply port 38*h*. The first supply and discharge passage 38*d* is connected to the first supply and discharge passage 34, and the second supply and discharge passage 35 is connected to the second supply and discharge port 38*e*. Further, the supply passage 38*a* is connected to the supply port 38*h*, and the discharge passage 38*b* is connected to the first discharge port 38*f* and the second discharge port 38*g*. A spool 38*m* that is provided with four valve sections 38*i* which are pressed in respectively opposed directions by a coil spring 38*j* and an electromagnetic solenoid 38*k* is installed in the casing 38*c*.

In a demagnetized state of the electromagnetic solenoid 38*k*, the spool 38*m* is disposed at one end (the right side in FIG. 2) of the casing 38*c* by a pressing force of the coil spring 38*j*, wherein the first supply and discharge port 38*d* is caused to communicate with the first discharge port 38*f*, and the second supply and discharge port 38*e* is caused to communicate with the supply port 38*h*. In this state, the working oil in the oil pan 13*a* is supplied into the second oil pressure chamber 31*b* through the supply passage 38*a*, the first oil control valve 38 and the second supply and discharge passage 35. Also, the working oil remaining in the first oil pressure chamber 31*a* is discharged into the oil pan 13*a* through the first supply and discharge passage 34, the first oil control valve 38, and discharge passage 38*b*. Therefore, the piston 32 is caused to move to the left side in FIG. 2, and the intake side camshaft 22 is caused to move in the direction of the F side in the direction S of the rotation axis in line with the movement of the piston 32. In addition, in the movement in the direction F, the phase of the entire intake side camshaft 22 shifts in the advancing direction with respect to the crankshaft 15 and the exhaust side camshaft 23 by engagement of a helical spline described later.

On the other hand, when the electromagnetic solenoid 38*k* is magnetized, the spool 38*m* is disposed at the other end side (the left side in FIG. 2) of the casing 38*c* against the pressing force of the coil spring 38*j*, wherein the second supply and discharge port 38*e* is caused to communicate with the second discharge port 38*g*, and the first supply and discharge port 38*d* is caused to communicate with the supply port 38*h*. In this state, the working oil in the oil pan 13*a* is supplied into the first oil pressure chamber through the supply passage 38*a*, the first oil control valve 38 and the first supply and discharge passage 34. Also, the working oil remaining in the second oil pressure chamber 31*b* is discharged into the oil pan 13*a* through the second supply and discharge passage 35, the first oil control valve 38 and the discharge passage 38*b*. As a result, the piston 32 moves rightward in the drawing against the pressing force of the coil spring 32*a*, wherein the intake side camshaft 22 is caused to move in the direction R in the direction S of the rotation axis in line with the movement of the piston 32. Also, in the movement in the direction R, the phase in rotation of the entirety intake side camshaft 22 shifts with respect to the crankshaft 15 and exhaust side camshaft 23 in the delay direction by engagement of a helical spline described later.

Still further, as the spool 38*m* is positioned at an intermediate portion of the casing 38*c* by controlling the duty of a current supplied to the electromagnetic solenoid 38*k*, the first supply and discharge port 38*d* and the second supply and discharge port 38*e* are blocked, and movement of the working oil through these supply and discharge ports 38*d* and 38*e* is prohibited. In this state, no working oil is supplied into nor discharged from the first oil pressure chamber 31*a* and the second oil pressure chamber 31*b*, wherein the working oil is charged and retained in the first and second oil pressure chambers 31*a* and 31*b*. Thereby, the piston 32 and the intake side camshaft 22 will not change their positions in the direction S of the rotation axis, that is, they are fixed. The state shown in FIG. 2 indicates this fixed state.

By adjusting the degree of opening of the first supply and discharge port 38*d* and the degree of opening of the second supply and discharge port 38*e* by controlling the duty of a current feeding to the electromagnetic solenoid 38*k*, it is possible to control the supply rate of the working oil from the supply port 38*h* to the first oil pressure chamber 31*a* or the second oil pressure chamber 31*b*.

As described above, since supply and discharge of the working oil into the respective oil pressure chambers 31*a* and 31*b* are adjusted through the respective supply and discharge passages 34 and 35 by the first oil control valve 38, the piston 32 can move in the cylinder tube 31, whereby it is possible to displace the intake side camshaft 22 in the direction S of the rotation axis, and also possible to vary the position where the intake cam 27 is brought into contact with the cam follower 20*b* of the valve lifter 20*a*.

Figure 7:
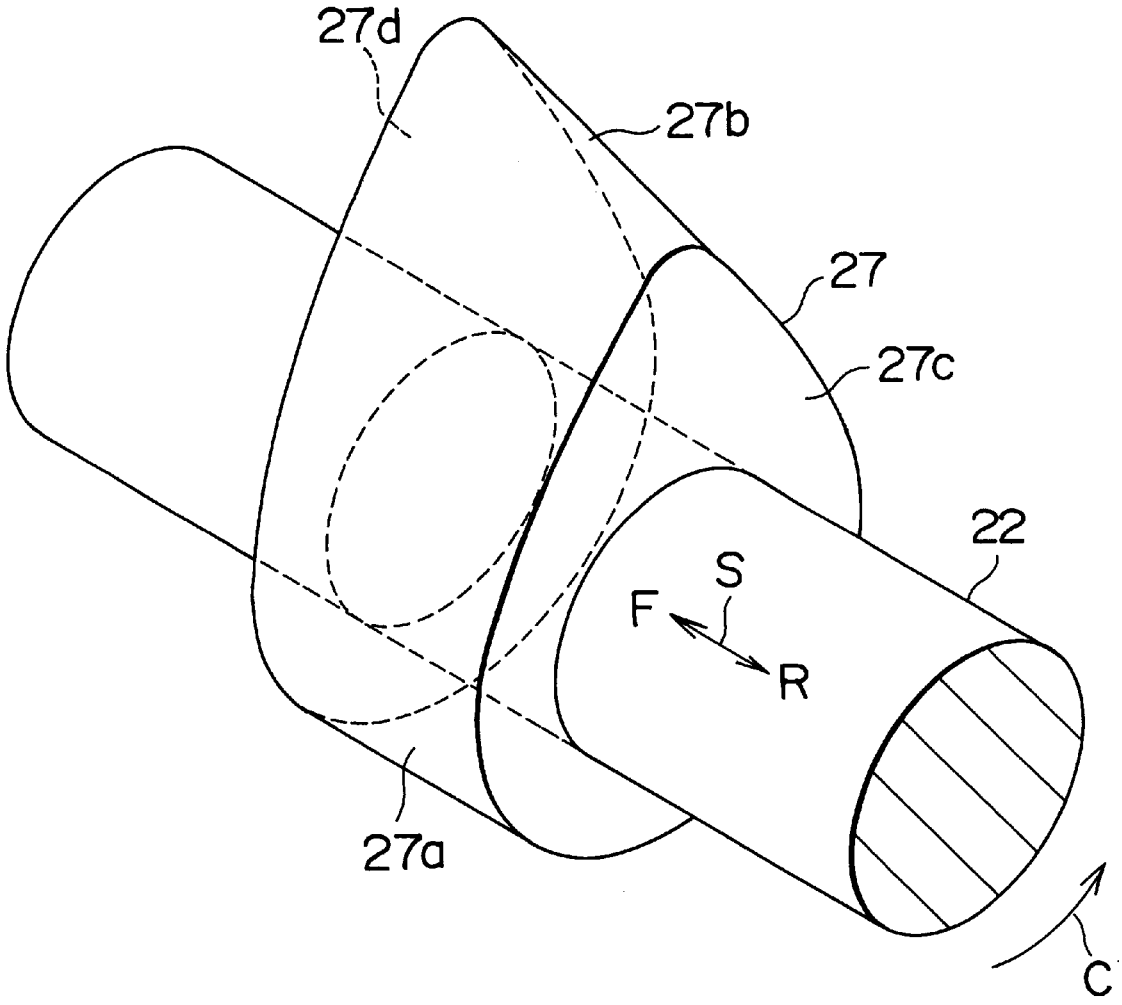
FIG. 7 is a perspective view of an intake cam according to the embodiment.
Figure 8:
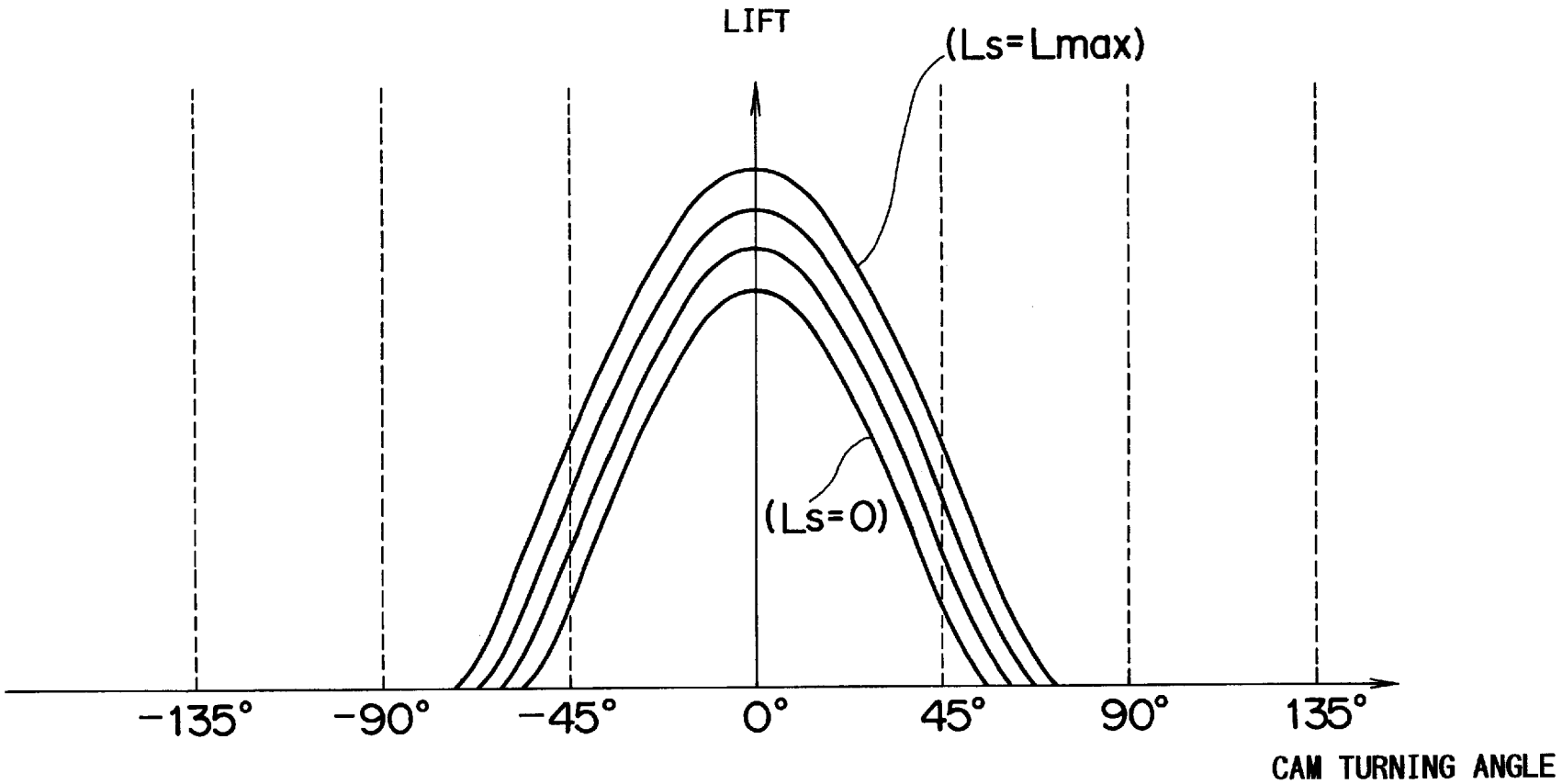
FIG. 8 is a view illustrating a profile of the intake cam according to the embodiment.

As shown in a perspective view of FIG. 7 and a lift pattern view in FIG. 8, the intake cam 27 varies the cam profile in the direction S of the rotation axis. That is, the cam surface 27*a* of the intake cam 27 has a lift pattern such that the lift is minimized at the rear end face 27*c* side and is maximized at the tip end face 27*d* side. And, the lift consecutively varies by the cam surface 27*a* from the rear end face 27*c* side to the tip end face 27*d* side. Therefore, the lift-varying actuator 22*a* can vary the valve characteristics of the intake cam 27 by adjusting the valve lift in line with displacement of the intake side camshaft 22 in the direction S of the rotation axis.

Next, as shown in FIG. 3, the actuator for varying a phase difference in rotation, which is secured at the tip end side of the intake side camshaft 22, is provided with a timing sprocket 24*a*, a journal 44, an external rotor 46 and an internal rotor 48.

The journal 44 is disposed at the tip end side of the intake side camshaft 22 and is rotatably supported by a bearing cap 44*a* at a journal bearing 14*a* formed on the cylinder head 14 of the engine 11. A slide hole 44*b* is formed at the position of the center axis of the journal 44, into which the tip end side of the intake side camshaft 22 is slidably inserted.

An outer toothed helical spline 50 extending in the direction of the rotation axis is formed on the outer circumference of the tip end portion of the intake side camshaft 22, and an inner toothed helical spline 52 that extends in the direction of the rotation axis and is engaged with the helical spline 50 at the intake side camshaft 22 side is formed on the inner circumference of the slide hole 44*b* into which the helical spline 50 portion is inserted. These helical splines 50 and 52 are formed to be of a left-threaded type. And, the intake side camshaft 22 and journal 44 are coupled to each other so as to rotate integral with each other through engagement of these helical splines 50 and 52, and at the same time, are coupled in a state that permits the intake side camshaft 22 in the direction S of the rotation axis to move while rotating in a left-threaded state.

The timing sprocket 24*a* is disposed in contact with the tip end side with respect to the journal 44, and at the same time, is disposed so as to rotate relative to the journal 44. As described above, the timing sprocket 24*a* is coupled to the crankshaft 15 of the engine output shaft and the exhaust side camshaft 23 via a timing chain 15*b* (FIG. 1).

The external rotor 46 is coupled, by a bolt 54, to the timing sprocket 24*a* along with the cover 47 so as to be integrated with each other. The internal rotor 48 integrally coupled to the journal 44 by a bolt 56 disposed inside the external rotor 46, which is surrounded by the cover 47 and the timing sprocket 24*a*.

Figure 4:
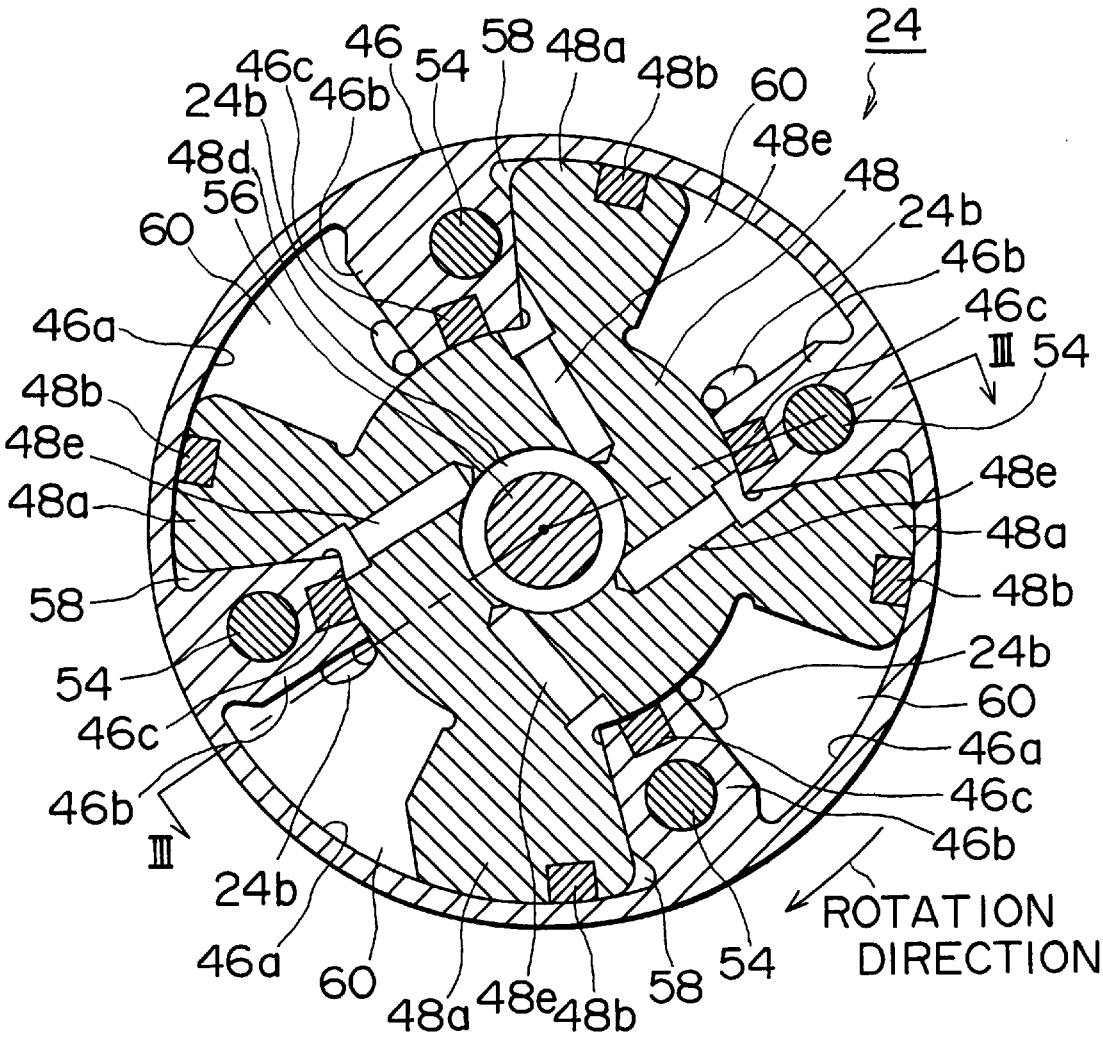
FIG. 4 is a cross-sectional view taken along the line IV—IV in FIG. 3.

FIG. 4 shows a cross-sectional view taken along the line IV—IV in FIG. 3. FIG. 3 corresponds to the cross-sectional view taken along the line III—III in FIG. 4. As illustrated, the internal rotor 48 is provided with a plurality (herein, four) vanes 48*a* protruding outside. On the other hand, recesses 46*a* opened inside are formed on the inner circumference of the annularly formed external rotor 46 by the same number as that of the vanes 48*a* of the internal rotor 48, and respectively accommodate the vanes 48*a*. Sealing members 46*c* and 48*b* are respectively provided at the tip end of a protrusion 46*b* of the external rotor 46 that sections these recesses 46*a* and at the tip end of the vanes 48*a* of the internal rotor 48, whereby the tip end of the protrusion 46*b* and the tip end of the vanes 48*a* are slidably brought into contact with the outer circumferential surface of the internal rotor 48 and the inner circumferential surface of the recess portion 46*a* of the external rotor 46 in a liquid-tight state. Thereby, the internal rotor 48 and external rotor 46 are caused to rotate relative to each other around the same rotation axis.

In addition, by the construction described above, the space in the recess portion 46*a* of the external rotor 46 is sectioned by two oil pressure chambers 58 and 60 by means of the vanes 48*a* of the internal rotor 48. Working oil is supplied into these oil pressure chambers 58 and 60 by the second oil control valve 62 (FIGS. 1 and 3).

An oil channel is formed by an oil passage 14*c* of the journal bearing 14*a*, an oil passage 44*c* on the outer circumference of the journal 44, oil passages 44*d* and 44*e* inside the journal 44, and oil passages 48*c*, 48*d* and 48*e* of the internal rotor 48 between the second oil control valve 62 and the first oil pressure chamber 58 of the two oil pressure chambers 58 and 60.

Another oil channel is formed by an oil passage 14*d* inside the journal bearing 14*a*, oil passages 44*i*, 44*h*, 44*g* and 44*f* in the journal 44, and oil passages 24*c* and 24*b* in the timing sprocket 24*a* between the second oil control valve 62 and the second oil pressure chamber 60 of the two oil pressure chambers 58 and 60.

The second oil control valve 62 is constructed as in the first oil control valve 38. That is, the second oil control valve 62 is provided with a casing 62*c*, the first supply and discharge port 62*d*, the second supply and discharge port 62*e*, a valve portion 62*i*, the first discharge port 62*f*, the second discharge port 62*g*, a supply port 62*h*, a coil spring 62*j*, an electromagnetic solenoid 62*k* and a spool 62*m*. And, the oil passage 14*c* in the journal bearing 14*a* is connected to the first supply and discharge port 62*d*, and the oil passage 14*d* in the journal bearing 14*a* is connected to the second supply and discharge port 62*e*. In addition, the supply passage 62*a* is connected to the supply port 62*h*, and the discharge passage 62*b* is connected to the first discharge port 62*f* and the second discharge port 62*g*.

Therefore, when the electromagnetic solenoid 62*k* is demagnetized, the spool 62*m* is disposed at one end (the right side in FIG. 3) of the casing 62*c* by a pressing force of the coil spring 62*j*, whereby the first supply and discharge port 62*d* and the first supply and discharge port 62*f* are caused to communicate with each other, and the second supply and discharge port 62*e* is caused to communicate with the supply port 62*h*. In this state, working oil in the oil pan 13*a* is supplied into the second oil pressure chamber 60 in the actuator 24 for varying a phase difference in rotation through the supply passage 62*a*, the second oil control valve 62, and oil passages 14*d*, 44*i*, 44*h*, 44*g*, 44*f*, 24*c* and 24*b*. In addition, the working oil remaining in the actuator 24 for varying a phase difference in rotation is discharged into the oil pan 13*a* through the oil passages 48*e*, 48*d*, 48*c*, 44*e*, 44*d*, 44*c*, and 14*c*, the second oil control valve 62 and the discharge passage 62*b*. As a result, the internal rotor 48 relatively rotates in the delay direction with respect to the external rotor 46, wherein the intake side camshaft 22 varies the phase difference in rotation in the delaying direction with respect to the crankshaft 15 and the exhaust side camshaft 23. That is, the intake side camshaft 22 relatively rotates in the direction along which the phase difference in rotation expressed in terms of the advance value becomes 0° CA (that is, the state shown in FIG. 4). If the demagnetized state of the electromagnetic solenoid 62*k* is continued, finally, the spool 62*m* stops in the state shown in FIG. 4, wherein the advance value becomes 0° CA.

On the other hand, when the electromagnetic solenoid 62*k* is magnetized, the spool 62*m* is disposed at the other end side (the left side in FIG. 3) of the casing 62*c* against the pressing force of the coil spring 62*j*. Thereby, the second supply and discharge port 62*e* is caused to communicate with the second discharge port 62*g*, and the first supply and discharge port 62*d* is caused to communicate with the supply port 62*h*. In this state, working oil in the oil pan 13*a* is supplied into the first oil pressure chamber 58 in the actuator for varying a phase difference in rotation through the supply passage 62*a*, the second oil control valve 62, and oil passages 14*c*, 44*c*, 44*d*, 44*e*, 48*c*, 48*d*, and 48*e*. The working oil remaining in the second oil pressure chamber 60 of the actuator 24 for varying a phase difference in rotation is discharged into the oil pan 13*a* through the oil passages 24*b*, 24*c*, 44*f*, 44*g*, 44*h*, 44*i*, 14*d*, the second oil control valve 62 and discharge passage 62*b*. As a result, the internal rotor 48 relatively rotates in the advancing direction with respect to the external rotor 46, and the intake side camshaft 22 varies its phase difference in rotation in the advancing direction with the crankshaft 15 and exhaust side camshaft 23. That is, the internal rotor 48 relatively rotates from 0° CA (the state shown in FIG. 4) where the phase difference in rotation is expressed in terms of an advance value in a gradually increasing direction. If the magnetized state of the electromagnetic solenoid 62*k* is continued, finally, the internal rotor 48 stops in a state where the vanes 48*a* thereof are brought into contact with the protrusion 46*b* at the side opposed to the external rotor 46, that is, in a state where, for example, 50°CA is obtained in terms of an advance value.

Further, as the spool 62*m* is positioned at an intermediate position of the casing 62*c* by controlling the duty of a current supplied to the electromagnet solenoid 62*k*, the first supply and discharge port 62*d* and the second supply and discharge port 62*e* are blocked, and movement of the working oil through these supply and discharge ports 62*d* and 62*e* is prohibited. In this state, no working oil is supplied into and discharged from the first oil pressure chamber 58 and second oil pressure chamber 60 of the actuator 24 for varying a phase difference in rotation. As a result, the working oil is charged and retained in the first and second oil pressure chambers 58 and 60, wherein the internal rotor 48 stops relative rotation with respect to the external rotor 46. Therefore, the phase difference in rotation between the intake side camshaft 22 and the crankshaft 15 or the exhaust side camshaft 23 is maintained in the state where the relative rotation of the internal rotor 48 stops.

By controlling the duty of a current supplied to the electromagnetic solenoid 62*k*, the supply rate of the working oil from the supply port 62*h* into the first oil pressure chamber 58 or the second oil pressure chamber 60 can be controlled by adjusting the degree of opening of the first supply and discharge port 62*d* or the degree of opening of the second supply and discharge port 62*e*.

In addition, as described above, the journal 44 integrated with the internal rotor 48 is connected to the intake side camshaft 22 side via the left-threaded helical splines 50 and 52. Therefore, the intake side camshaft 22 can vary its phase difference in rotation with respect to the crankshaft 15 and the exhaust side camshaft 23 by driving only the lift-varying actuator 22*a* without driving the actuator 24 for varying a phase difference in rotation.

That is, in the first embodiment, in the case where the actuator 24 for varying a phase difference in rotation is maintained, as shown in FIG. 4, in a state where the internal rotor 48 is at an advance value of 0° CA, it is possible to make the actual advance value in the intake side camshaft 22 smaller than 0° CA by the lift-varying actuator 22*a*.

Figure 9:
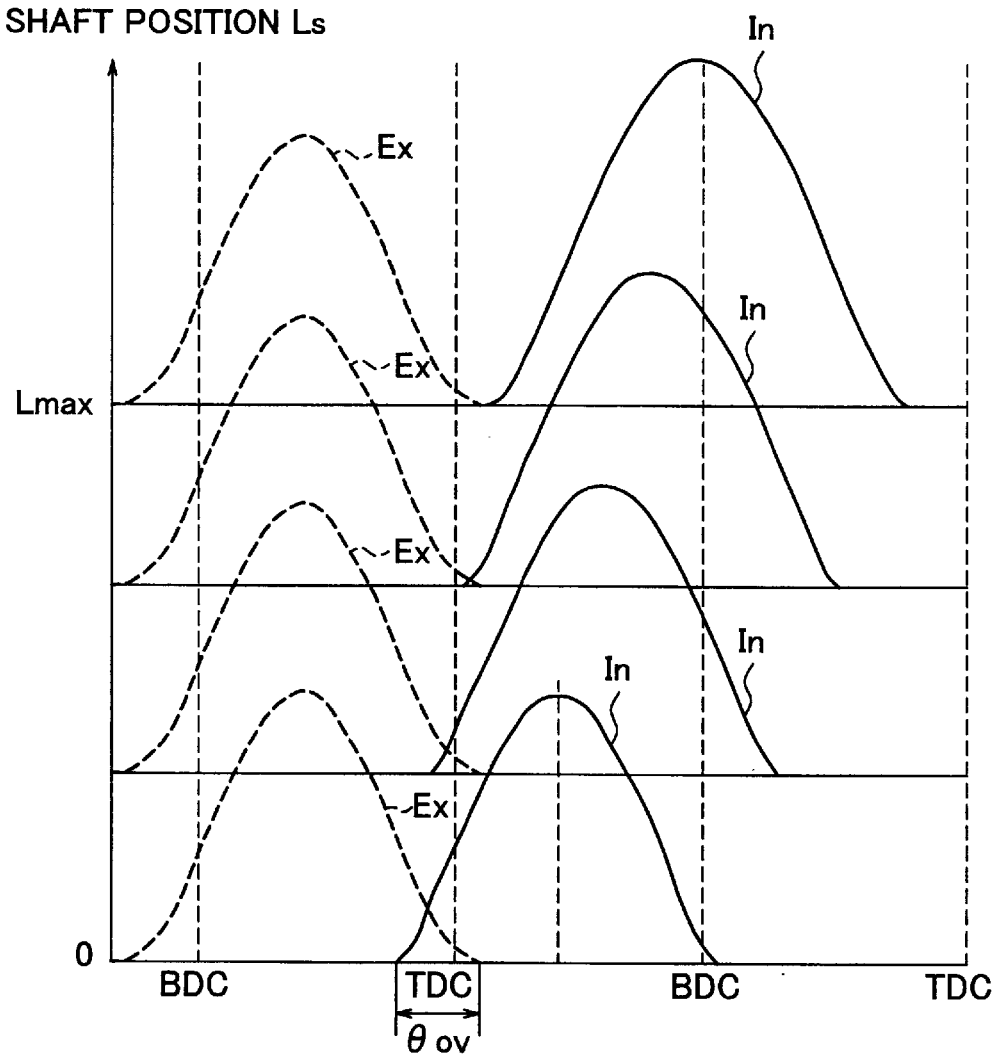
FIG. 9 is a view illustrating the respective lift patterns of the exhaust valve and intake valve according to the embodiment.

The example shown in FIG. 9 shows the relationship (solid line: In) between the shaft position and lift when the intake side camshaft 22 moved in the direction S of the rotation axis in the state where the internal rotor 48 is maintained at an advance value of 0° CA by the actuator 24 for varying a phase difference in rotation. As illustrated, it is understood that the phase difference in rotation of the intake side camshaft 22 is consecutively delayed as the intake side camshaft 22 is caused to move from the position (shaft position: 0 mm) where it is not moved in the direction R to the position of the maximum shaft position Lmax. In particular, although a valve overlap θov exists between the intake valve lift In and the lift (broken line: Ex) of the exhaust valve 21 at the shaft position 0 mm, the valve overlap is negated by a delay of the valve timing of the intake valve 20 at the maximum shaft position Lmax, that is, it is set that no valve overlap is provided. Therefore, at the shaft position 0 mm, blow-back of the exhaust is sufficiently performed by the valve overlap, and at the maximum shaft position Lmax, no blow-back of the exhaust is provided since no valve overlap exist.

Further, at the shaft position 0 mm, the lift pattern of the minimum lift is created, wherein the closing timing of the intake valve 20 is made earlier, and at the maximum shaft position Lmax, the lift pattern of the maximum lift is created, where the opening timing of the intake valve 20 is delayed.

In the case where a coupling structure of the actuator 24 for varying a phase difference in rotation and a lift-varying actuator 22*a* using engagement of the aforementioned helical splines 50 and 52 is employed, the engagement between both the helical splines 50 and 52 cannot be made overly tight for the convenience of smooth sliding of the intake side camshaft 22. For this reason, since the intake side camshaft 22 is subject to fluctuations in torque, tapping noise may be produced between teeth of the helical splines 50 and 52 due to backlashes. Therefore, a tapping noise preventing structure that suppresses the tapping noise between teeth of the helical splines 50 and 52 due to torque fluctuations is provided in the journal 44. The tapping noise preventing structure is constructed of a subgear 70 spline-connected to each of the intake side camshaft 22 and journal 44 and a waved washer 72 for pressing the subgear 70 in the direction R. The subgear 70 and waved washer 72 are accommodated in the rear end side of the journal 44 as shown in FIG. 3.

Figure 5:
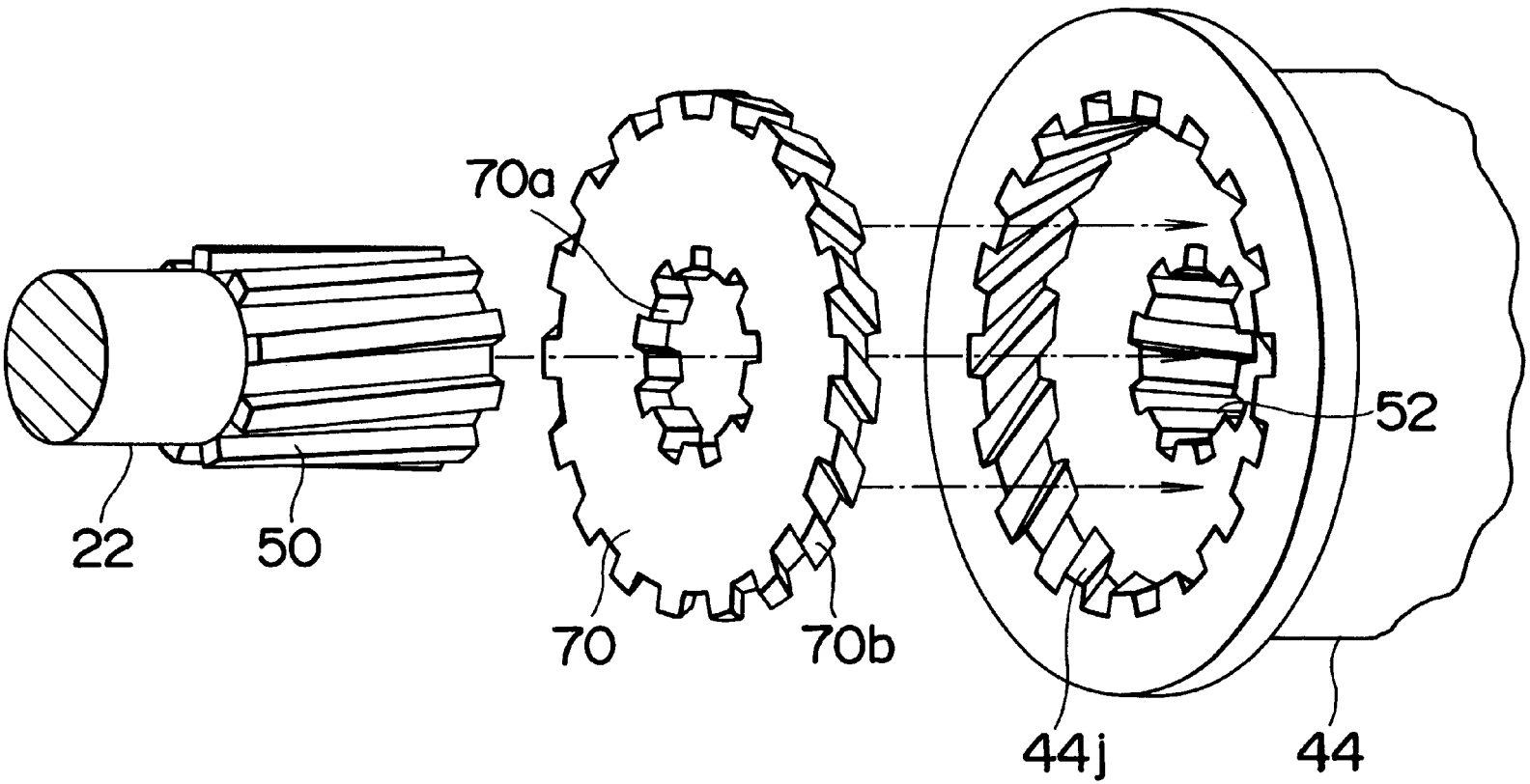
FIG. 5 is an exploded perspective view of the intake side camshaft, journal and subgear according to the embodiment.

FIG. 5 is a disassembled perspective view of the intake side camshaft 22, journal 44 and subgear 70. As illustrated, the subgear 70 is a circular disk-shaped gear having a through-hole, into which the intake side camshaft 22 is inserted, formed at the center thereof, wherein a left-threaded type spline 70*a* that is engaged with the left-threaded type helical spline 50 formed at the tip end part of the intake side camshaft 22 is formed on the inner circumference of the throughhole. Also, a right-threaded type helical spine 70*b* is formed on the outer circumference of the subgear 70. The helical spline 70*b* is engaged with the right-threaded type helical spline 44*j* formed on the journal 44. And, since these splines are coupled to each other, the subgear 70 is coupled to that of the intake side camshaft 22 and journal 44.

And, as shown in FIG. 3, the waved washer 72 is disposed between the rear end surface of the journal 44 and the tip end surface of the subgear 70. By a pressing force of the waved washer 72, the subgear 70 is usually pressed to the rear end side (in the direction R). Such a pressing force of the waved washer 72 is converted in the rotation direction through the right-threaded type helical spline connection of the subgear 70 and journal 44, and the journal 44 and subgear 70 are pressed in a direction that causes relative rotation centering around the rotation axis thereof.

Figure 6:
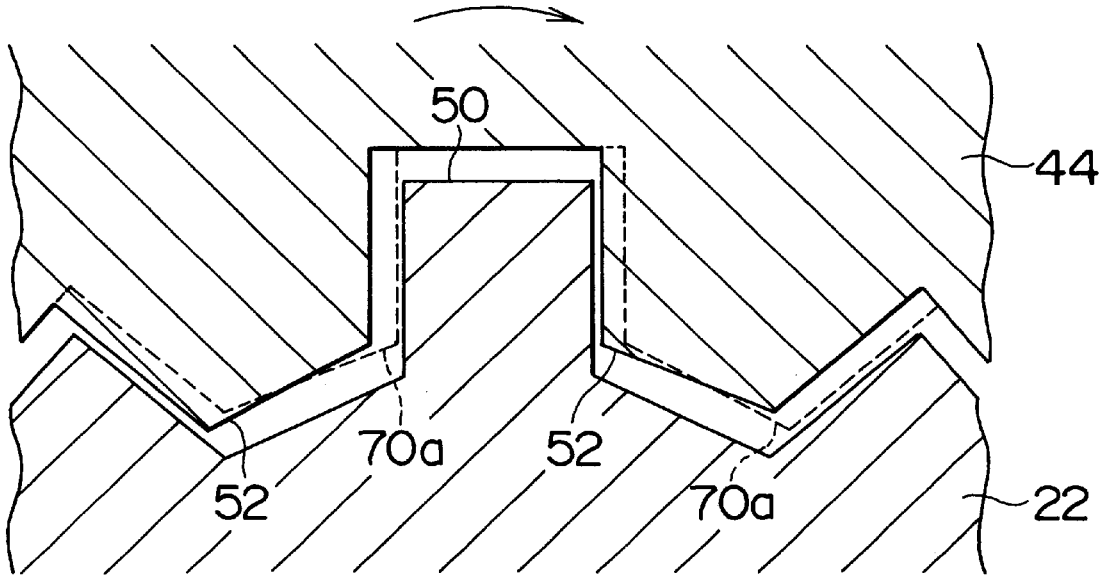
FIG. 6 is a view illustrating a cross section of a helical spline portion of the actuator for varying the rotation phase difference.

As a result, as shown in FIG. 6, the helical spline 52 of the journal 44 and spline 70*a* of the subgear 70 have tooth traces shifted in the rotation direction, and are always brought into contact with the rotation direction side and the side opposed thereto and presses the helical spline 50 at the tip end part of the intake side camshaft 22. Therefore, the backlash due to a torque fluctuation of the intake side camshaft 22 is eliminated, and the tapping noise due to the collision of teeth of the helical splines 50 and 52 of the journal 44 and the intake side camshaft 22 is suppressed.

Next, a description is given of a process for setting target values of valve characteristics of various controls made by an ECU (Electronic Control Unit) 80 in the first embodiment. Also, the ECU 80 is an electronic circuit mainly formed of logical operation circuits. The ECU 80 detects, as shown in FIG. 1, various types of data including the running state of the engine 11 by means of an airflow meter 80*a* for detecting an air intake amount GA into the engine 11, an RPM (revolution-per-minute) sensor 80*b* for detecting the number NE of revolutions per minute of the engine 11 based on rotations of the crankshaft 15, a water temperature sensor 80*c* that is installed at the cylinder block 13 and detects the coolant temperature THW of the engine 11, a throttle opening sensor 80*d*, vehicle velocity sensor 80*e*, accelerator opening degree sensor 80*h*, and various other types of sensors.

Further, the ECU 80 detects a rotation phase of the intake side camshaft 22 from a cam angle sensor 80*f*. And, the phase difference in rotation of the intake side camshaft 22 is calculated based on the relationship between the detected value of the cam angle sensor 80*f* and the detected value of the RPM sensor 80*b* with respect to the crankshaft 15 and the exhaust side camshaft 23 side. In addition, the shaft position of the intake side camshaft 22 in the direction S of the rotation axis is detected from a shaft position sensor 80*g*.

In addition, based on these detected values, the ECU 80 outputs control signals to the first oil control valve 38 and the second oil control valve 62, whereby the phase difference AO in rotation (actually, the advance value 10 in the internal rotor 48) of the intake cam 27 with the exhaust cam 28, and the shaft position Ls of the intake side cam shaft 22 are controlled by feedback.

Figure 10:
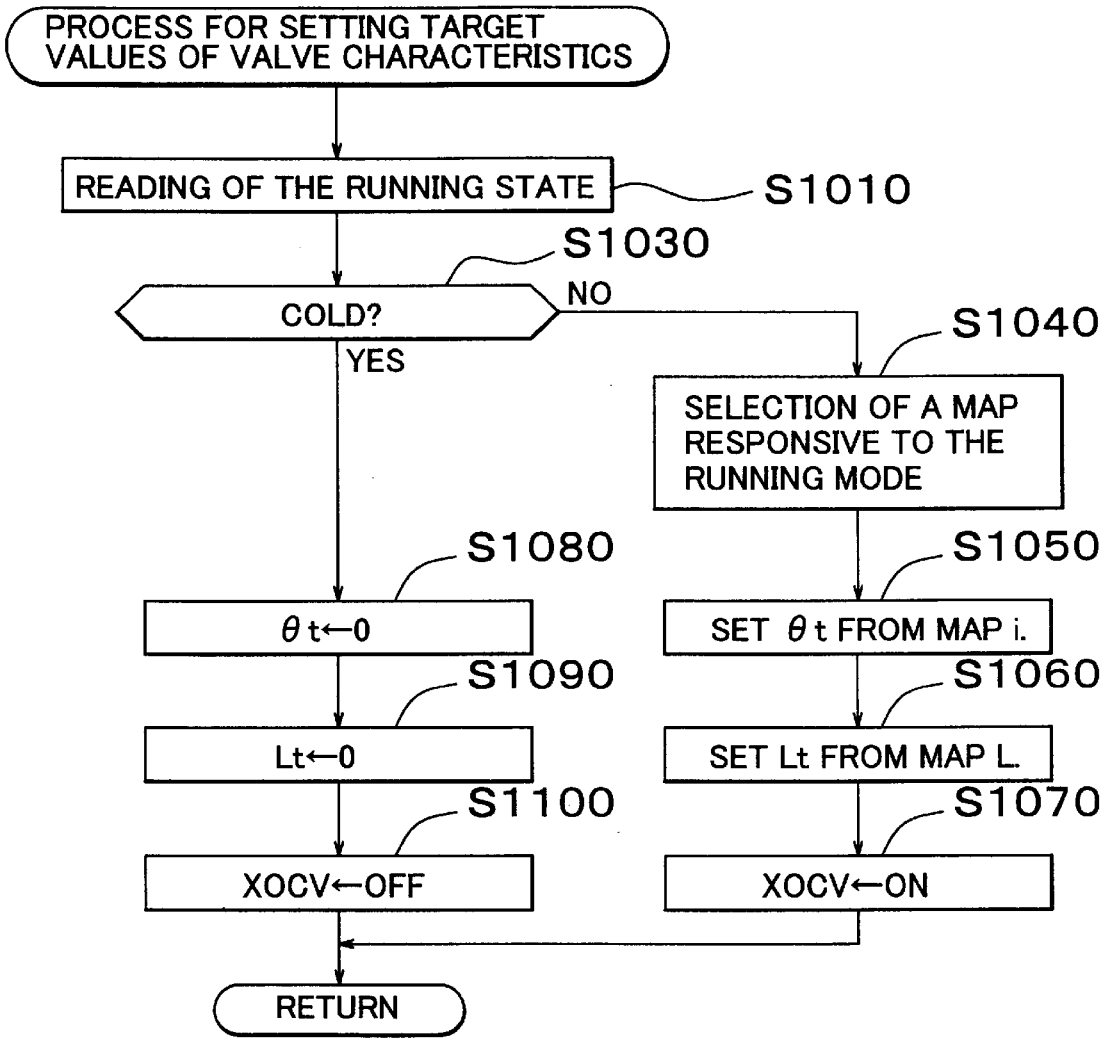
FIG. 10 is a flow chart of a process for setting target values of valve characteristics according to the embodiment.

One example of a process for setting target values of valve characteristics, which is carried out for the feedback control, is shown in a flow chart of FIG. 10. The process expresses the processing portion to be repeatedly performed cyclically after the starting of the engine 11 is completed.

As the process for setting target values of valve characteristics starts, first, the running state of the engine 11 is read by various types of sensors (S1010). In the first embodiment, an air intake amount GA obtained by a detected value of the airflow meter 80*a*, the number NE of revolutions of engine, which is obtained by a detected value of the RPM sensor 80*b*, a coolant temperature THW obtained from a detected value of the water temperature sensor 80*c*, a throttle opening degree TA obtained from a detected value of the throttle opening sensor 80*d*, a vehicle velocity Vt obtained from a detected value of the vehicle velocity sensor 80*e*, an advance value 10 of the intake cam 27, which is obtained by the relationship between a detected value of the cam angle sensor 80*f* and a detected value of the RPM sensor 80*b*, shaft position Ls of the intake side camshaft 22, which is obtained from a detected value of the shaft position sensor 80*g*, the entire close signal showing that no accelerator pedal is being stepped on, or an accelerator opening degree ACCP showing the amount of depression of the accelerator pedal, which are obtained by the accelerator opening degree sensor 80*h*, etc., are read in a working area of a RAM existing the ECU 80.

Figure 11A:
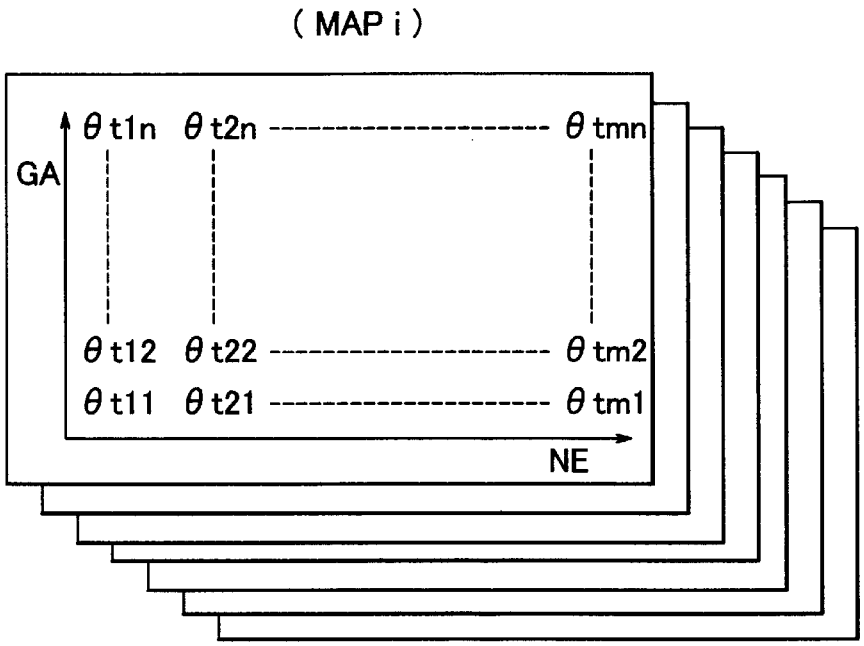
FIG. 11 is a view illustrating a map construction of a target advance value θt and target shaft position Lt, which are used for the process of setting target values of the valve characteristics according to the embodiment.
Figure 11B:
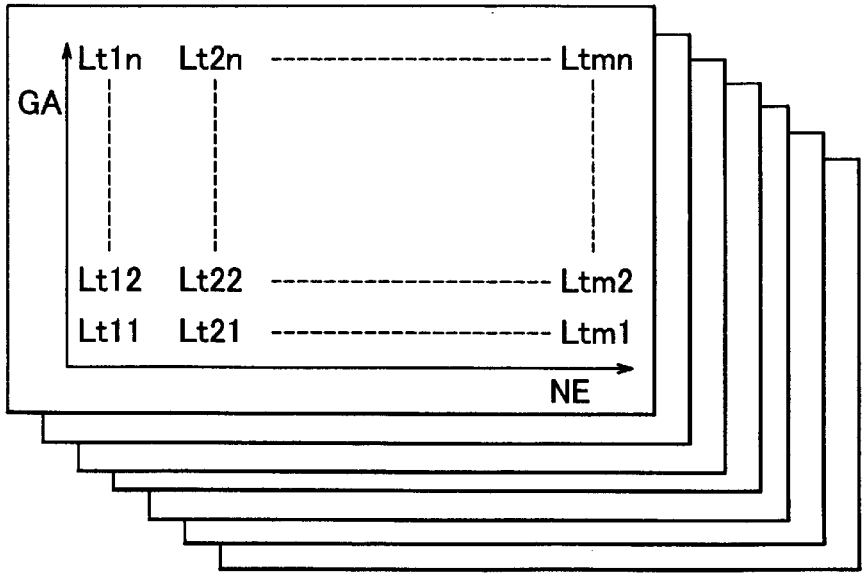

Next, it is determined (in S1030) whether or not the engine 11 is cold. For example, if the coolant temperature THW is 78° C. or less, the engine is determined to be cold. If the engine is not cold ([NO] in S1030), next, a map suited to the running mode of the engine 11 is selected (S1040). The ROM of the ECU 80 is provided, as shown in FIGS. 11(A) and 11(B), with maps i of target advance values θt set mode by mode in the running state such as idling, stoichimetric combustion running, lean combustion running, etc., when the engine is hot, and maps L of target shaft positions Lt. In Step S1040, the running mode is determined on the basis of the running state read in Step S1010, maps i and L corresponding to the running mode are, respectively, selected from groups of maps. These maps i and L are used to obtain necessary target values by using the engine load (herein, the air intake amount GA), and number NE of revolutions of the engine as parameters.

Figure 12:
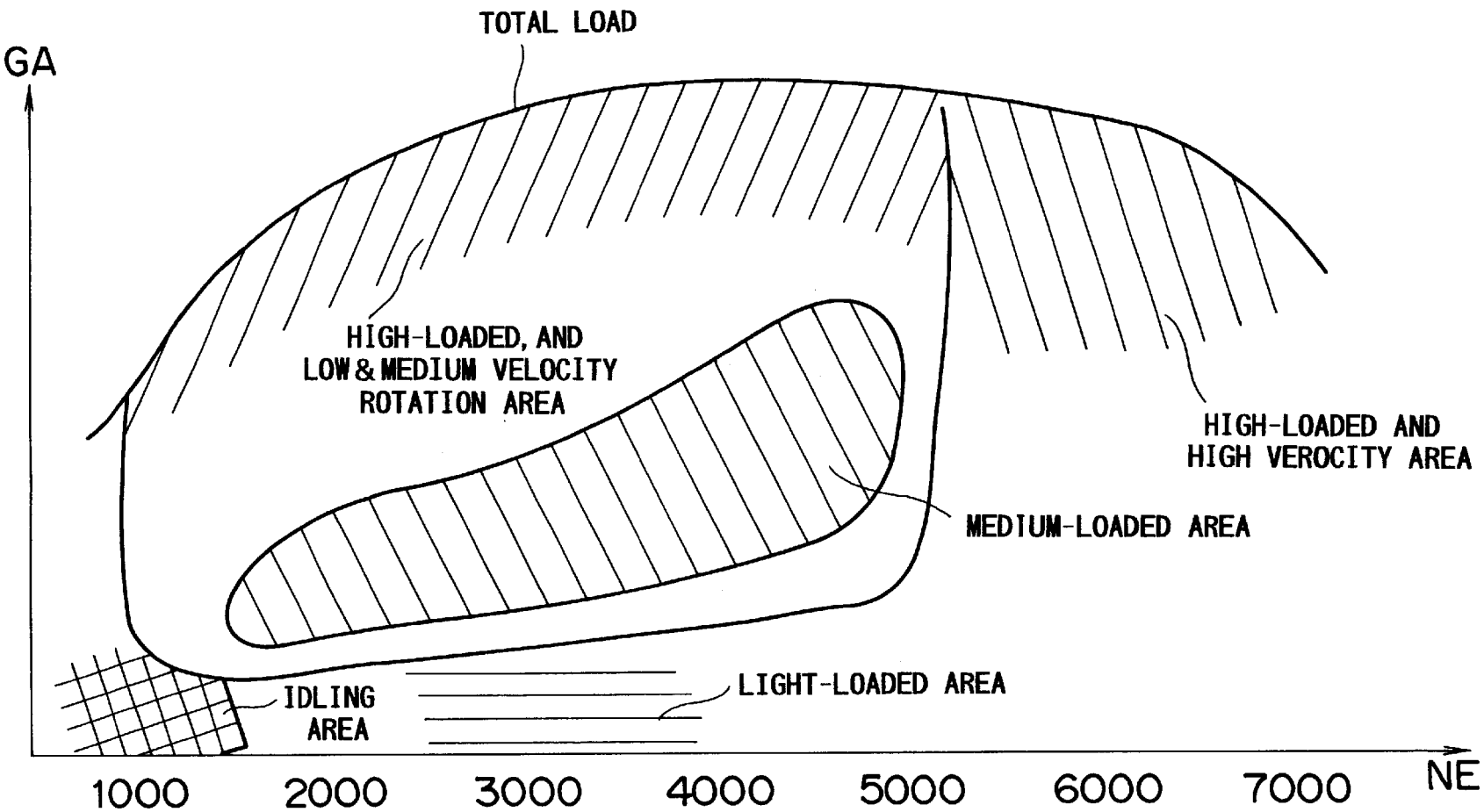
FIG. 12 is a view illustrating a domain construction in the map of a target advance value θt and target shaft position Lt, which are used for the process of setting target values of the valve characteristics according to the embodiment.

Also, regarding, for example, the valve overlap, the distribution of target advance values θt and target shaft positions Lt in the respective maps shown in FIGS. 11(A) and 11(B) is classified into areas shown in FIG. 12. That is, (1) in the idling area, the valve overlap is eliminated, and the blow-back of the exhaust gas is prevented from occurring to stabilize the combustion, wherein the engine rotation is stabilized, (2) in the light-loaded area, the valve overlap is minimized, and the blow-back of the exhaust gas is suppressed to stabilize the combustion, wherein the engine rotation is stabilized, (3) in the medium-loaded area, the valve overlap is slightly increased to increase the internal EGR ratio, thereby reducing the pumping loss, (4) in the high-loaded, low and medium velocity rotation area, the valve overlap is maximized to increase the cubic volume efficiency and to increase the torque, and (5) in the high-loaded and high velocity rotation area, the valve overlap is set in the range from a middle level to a large level to increase the cubic volume efficiency.

After maps i and L corresponding to the running mode are selected in Step S1040, a target advance value θt for controlling the advance value feedback is set (S1050) on the basis of the number NE of revolutions of engine and air intake amount GA in compliance with the selected map i. Next, a target shaft position Lt for controlling the shaft position feedback is set (S1060) on the basis of the number NE of revolutions of the engine and the air intake amount GA in compliance with the selected map L.

Next, [ON] is set (S1070) in the OCV drive flag XOCV that indicates drive of the first oil control valve 38 and the second oil control valve 62. Then, the process is terminated once.

On the other hand, when the engine is cold (S1030 is [YES]), [0] is established in the target advance value θt (S1080), and [0] is established in the target shaft position Lt (S1090). And, [OFF] is set in the OCV drive flag XOCV (S1100). The process is terminated.

Figure 13:
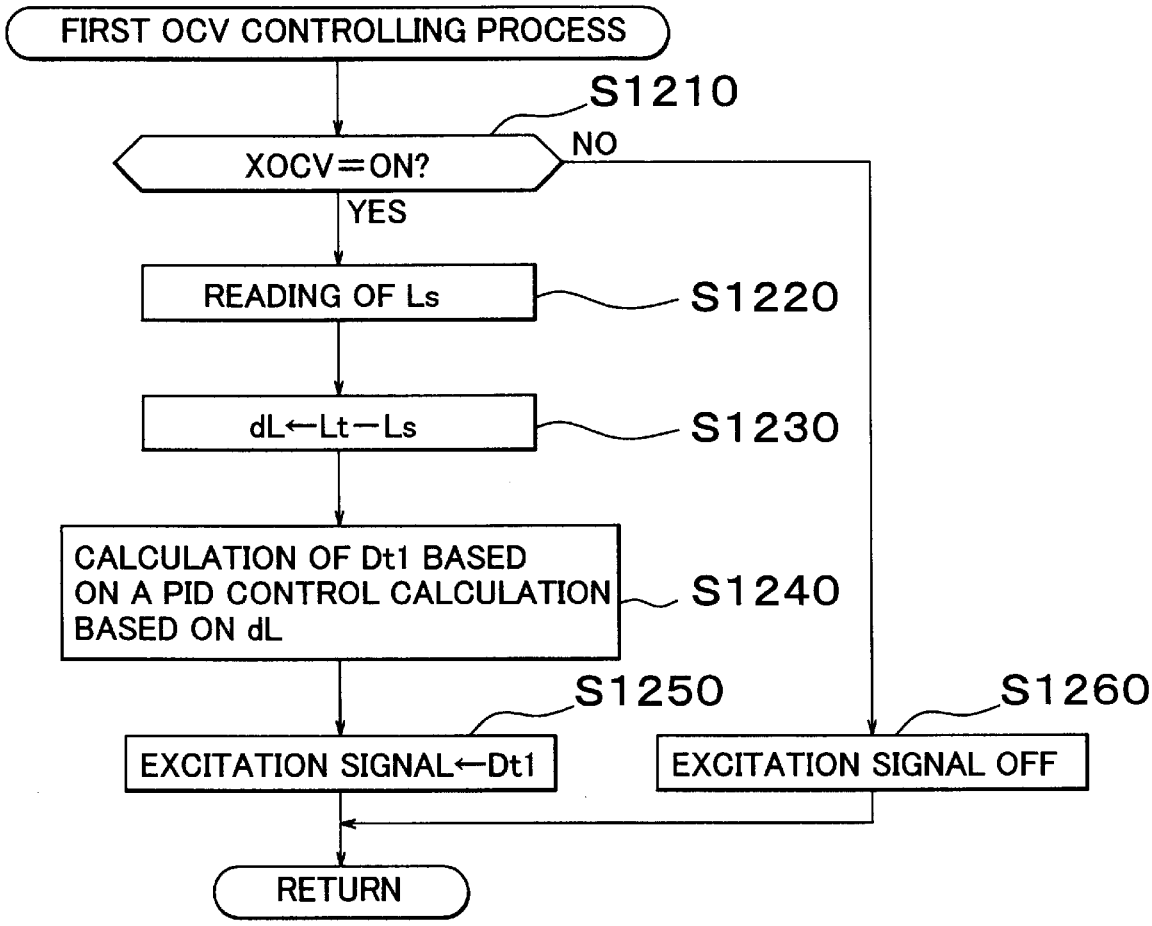
FIG. 13 is a flow chart for a valve controlling process of a first oil control valve (OCV) according to the embodiment.
Figure 14:
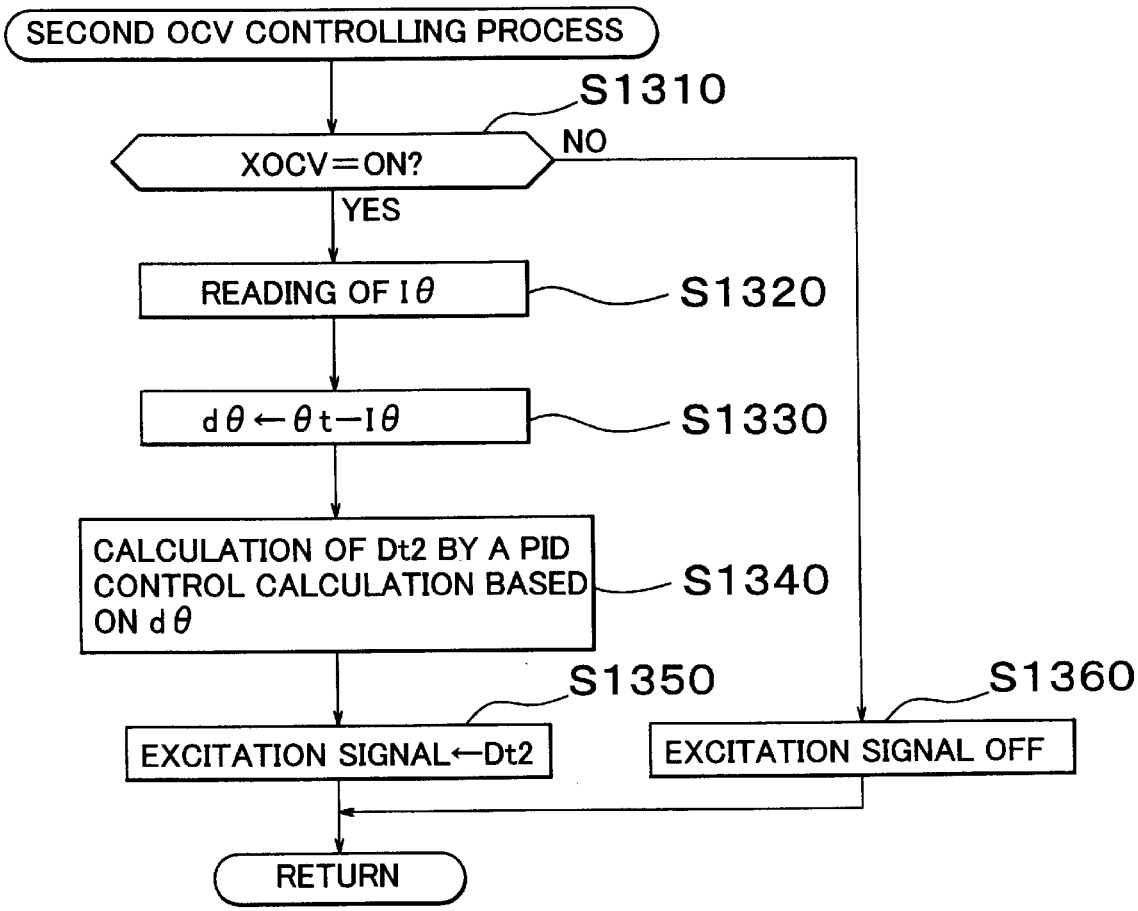
FIG. 14 is a flow chart for a valve controlling process of a second oil control valve (OCV) according to the embodiment.

FIG. 13 shows a flow chart of a process for controlling the first oil control valve 38, and FIG. 14 shows a flow chart of a process for controlling the second oil control valve 62. These processes express feedback control to achieve the target shaft position Lt and target advance value θt with respect to the intake side camshaft 22. These processes are cyclically repeated.

As the process for controlling the first oil control valve 38 in FIG. 13 is commenced, first, it is determined (in S1210) whether or not the OCV drive flag XOCV is [ON]. Since XOCV=[ON]) unless the engine is cold (that is, S1210 is [YES]), the actual shaft position Ls of the intake side camshaft 22, which is calculated from the detected value of the shaft position sensor 80*g*, is read (S1220).

Next, the deviation dL between the target shaft position Lt established in the process for setting target values of valve characteristics (FIG. 10) and the actual shaft position is calculated as in the following expression (1) (S1230).

$$dL \leftarrow Lt - Ls \tag{1}$$

The duty Dt1 for control with respect to the electromagnetic solenoid 38*k* of the first oil control valve 38 is calculated from the calculation of PID control based on the deviation dL (S1240), and an excitation signal to the electromagnetic solenoid valve 38*k* is established on the duty Dt1 (S1250). Then the process is terminated.

On the other hand, if XOCV=[OFF] when the engine is cold ([NO] in S1210, the excitation signal with respect to the electromagnetic solenoid 38*k* is [OFF], that is, the electromagnetic solenoid 38*k* is maintained in a non-magnetized state (S1260), and the process is terminated.

Thus, when the engine is cold (including cold idling), the first oil control valve 38 does not operate at all, wherein the lift-varying actuator 22*a* is not driven. In states other than when the engine is cold, that is, when the engine is hot, the first oil control valve 38 is controlled in response to the target shaft position Lt established according to the running state of the engine 11, and the intake side camshaft 22 is caused to move the target shaft position Lt by drive of the lift-varying actuator 22*a*.

Next, a description is given of a controlling process of the second oil control valve 62 in FIG. 14. Upon commencement of the controlling process, first, it is determined (in S1310) whether or not the OCV drive flag XOCV is [ON]. Since the XOCV=[ON] unless the engine is cold (that is, S1310 is [YES]), wherein the actual advance value Iθ of the intake cam 27, which is calculated from the relationship between the detected value of the cam angle sensor 80*f* and the detected value of the RPM sensor 80*b* is read (S1320).

Next, a deviation dθ between the target advance value θt established by the process for setting target values of valve characteristics (FIG. 10) and the actual advance value Iθ is calculated as in the following expression (2) (S1330).

$$d\theta \leftarrow \theta t - I\theta \quad (2)$$

And, the duty Dt2 for control with respect to the electromagnetic solenoid 62*k* of the second oil control valve 62 is calculated by a PID controlling calculation based on the deviation dθ (S1340). An excitation signal to the electromagnetic solenoid 62*k* is established on the basis of the duty Dt2 (S1350). Thus, the process is terminated once.

On the other hand, if the XOCV=[OFF] (S1310 is [NO]) when the engine is cold, next, the excitation signal with respect to the electromagnetic solenoid 62*k* is [OFF], that is, the electromagnetic solenoid 62*k* is maintained in a non-magnetized state (S1360), and the process is terminated once.

Thus, when the engine is cold including cold idling, the second oil control valve 62 does not operate at all, and the actuator 24 for varying a phase difference in rotation is not driven. If the engine is hot, the second oil control valve 62 is controlled in response to the target advance value θt established based on the running state of the engine 11, and the advance value of the intake side camshaft 22 is caused to move the target advance value θt by drive of the actuator 24 for varying a phase difference in rotation.

As described above, while the engine 11 is driven when the engine is still cold, both the first oil control valve 38 and the second oil control valve 62 are not controlled, and the lift-varying actuator 22*a* and the actuator 24 for varying a phase difference in rotation are never driven.

This is because when the engine is cold, the temperature is not sufficiently raised to bring about sufficient fluidity in the working oil, and both the lift-varying actuator 22*a* and the actuator 24 for varying a phase difference in rotation cannot be driven at a sufficiently high accuracy by the working oil supplied under compression from the oil pump P.

However, in a state where the lift-varying actuator 22*a* and actuator 24 for varying a phase difference in rotation are not driven in such a cold state, the intake side camshaft 22, which is interlocked with rotation of the crankshaft 15, receives moment in the delaying direction by friction with the cam follower 20*b* of the valve lifter 20*a*. At this time, since the electromagnetic solenoid 62*k* of the second oil control valve 62 is always in a non-magnetized state, the first oil pressure chamber 58 in the actuator 24 for varying a phase difference in rotation is in the state of discharging the internal working oil into the oil pan 13*a* through oil passages 48*e*, 48*d*, 48*c*, 44*e*, 44*d*, 44*c*, 14*c*, the second oil control valve 62 and the discharge passage 62*b*. Furthermore, the second oil pressure chamber 62 is in a state of receiving working oil from the oil pump P through the supply passage 62*a*, oil control valve 62, oil passages 14*d*, 44*i*, 44*h*, 44*f*, 24*c*, and 24*b*.

Therefore, it is maintained that, when idling immediately before the latest stop of the engine 11, the internal rotor 48 of the actuator 24 for varying a phase difference in rotation was in a state where the advance value is 0° CA as shown in FIG. 4. Even if the advance value exceeds 0° CA in the latest stop of the engine 11, the internal rotor 48 can immediately become 0° CA by friction with the cam follower 20*b*.

Further, regarding the lift-varying actuator 22*a*, there is a high possibility that, when idling immediately before the engine 11 last stops, the shaft position becomes Ls>0 mm to eliminate valve overlap. However, since the electromagnetic solenoid 38*k* of the first oil control valve 38 is in a non-magnetized state during the time from stop to start of the engine 11, the first oil pressure chamber 31 a of the lift-varying actuator 22*a* is in a state such that the internal working oil thereof is discharged to the oil pan 13*a* through the first oil control valve 38, and the discharge passage 38*b*. In addition, the second oil pressure chamber 31*b* is in a state such that working oil is supplied thereto from the oil pump P through the supply passage 38*a*, the first oil control valve 38, and the second supply and discharge passage 35.

As shown in FIG. 2, since the intake side camshaft 22 receives a thrust force in the direction F from the cam follower due to inclination of the cam surface 27*a*, the intake side camshaft 22 naturally returns to the shaft position Ls=0 mm during the time from the stop to start of the engine 11. Also, the thrust force is further strengthened by a pressing force of the coil spring 32*a*.

Therefore, when the engine 11 starts, since the shaft position naturally enters Ls=0 mm and enters a state of the advance value of 0° CA of the internal rotor 48, the valve overlap for cold running, that is shown at the shaft position Ls=0 in FIG. 9 can be automatically established. Also, when the engine 11 starts, the valve overlap for cold running is not excessive, and the closing timing of the intake valve 20 is set earlier. Therefore, in the starting, since there is no case where the opening and closing timing of the intake valve 20 is excessively adjusted to the delay side, the mixture that is once sucked in the combustion chamber 17 can be prevented from returning to the intake port 18 side. Also, since the opening and closing timing of the intake valve 20 is reasonable, and the valve overlap is not excessive although it exists, blow-back of the exhaust will not become excessive, wherein starting performance thereof is made favorable.

Also, as the engine 11 idles after start, when hot running, the intake side cam shaft 22 is adjusted to the target advance value θt and target shaft position Lt responsive to the running state of the engine 11 on the basis of the maps i and L. Regarding the valve overlap, the valve overlap is controlled so that it is eliminated, that is, the target shaft position becomes Lt=Lmax. Therefore, as in Ls=Lmax illustrated in FIG. 9, the valve overlap is eliminated, and blow-back can be prevented from occurring when hot idling.

On the other hand, as a cold idling state occurs after start, since both the lift-varying actuator 22*a* and actuator 24 for varying a phase difference in rotation are maintained in a non-driven state, the valve timing shown with respect to Ls=0 mm in FIG. 9 can be maintained. That is, an adequate valve overlap can be continuously maintained even when cold idling. Therefore, adequate blow-back of exhaust can be achieved.

In the first embodiment described above, a variable valve overlap control mechanism comprises: the lift-varying actuator 22*a* corresponds to the rotation axis direction shifter, the actuator 24 for varying a phase difference in rotation corresponds to the rotation phase difference adjuster, the helical splines 50 and 52 correspond to a coupler, the intake cam 27, valve lifter 20*a*, and coil spring 32*a* correspond to a rotation axis presser, and various types of sensors, 80*a* through 80*e*, and 80*h* correspond to the running state detector. Also, the process for setting target values of valve characteristics in FIG. 10 corresponds to a process as a valve overlap controller.

According to the first embodiment described above, the following characteristics are provided.

(i). Although no valve overlap is produced when hot idling, valve overlap is produced when cold idling. Thereby, in cold idling, carburetion of fuel in the combustion chamber and intake ports can be promoted by blow-back of exhaust from the exhaust ports and combustion chamber. Therefore, even though fuel injected from a fuel injector valve is adhered to the inner surface of the intake ports and combustion chamber when cold running, it can be immediately carbureted. Therefore, the mixture can be subject to a sufficient air-fuel ratio without depending on an increase of fuel. Combustion is stabilized still further than in the case where no valve overlap exists, and cold hesitation can be prevented from occurring, wherein drivability can be maintained in a comparatively favorable state. Furthermore, fuel efficiency and emission can be prevented from worsening without depending on an increase in fuel.

Since valve overlap is made smaller when hot idling, taking combustion stability when idling into consideration, the amount of the gas remaining in the combustion chamber is reduced, and the combustion can be sufficiently stabilized.

(ii). In particular, by construction of the helical splines 50 and 52 of the actuator 24 for varying a phase difference in rotation, a cam profile of the intake cam 27, and the lift-varying actuator 22*a*, a valve timing at which valve overlap for cold running can be achieved can be automatically secured when the actuator 24 for varying a phase difference in rotation and actuator 22*a* are not driven.

Therefore, even in a case where the lift-varying actuator 22*a* cannot be driven due to an insufficient output of oil pressure when cold running immediately after starting of the engine 11, it is possible to achieve a valve overlap for cold running during the time from the stop to start of the engine 11.

For this reason, only by maintaining the lift-varying actuator 22*a* in a non-driven state in a situation such that the lift-varying actuator 22*a* cannot be driven when cold idling after start of the engine 11, it is possible to achieve the valve overlap for cold running. And, after the engine is warmed up, it is possible to eliminate, for example, the required valve overlap to drive the lift-varying actuator 22*a*.

Accordingly, the mixture has a sufficient air-fuel ratio without depending on an increase of fuel when cold idling, and combustion is made more stable than in the case where the valve overlap is not increased, and cold hesitation can be prevented from occurring, wherein drivability can be maintained in a comparatively favorable state. Moreover, fuel efficiency and emission can be prevented from worsening without depending on an increase in fuel. And, the amount of the gas remaining in the combustion chamber is reduced when hot idling in which fuel carburetion is sufficient, and combustion can be sufficiently stabilized.

(iii). The intake side cam shaft 22 achieves drive of the intake valve 20 by an intake cam 27 whose profile is different in the direction of the rotation axis. And, by adjusting the position of the intake cam 27 by the lift-varying actuator 22*a* in the direction of the rotation axis, the valve lift of the intake valve 20 is consecutively adjusted, thereby enabling changes in the valve timing.

The intake cam 27 is formed so that the valve lift depending on the cam surface 27*a* consecutively changes in the direction S of the rotation axis, and it achieves a valve overlap for cold running in the position in the direction of the rotation axis, where the valve lift is the minimum, by means of the helical splines 50 and 52. A pressing force from the valve lifter 20*a* side that is brought into contact with the intake cam 27 and causes the valve lift of the intake valve 20 to follow the cam surface 27*a* by the profile of the cam surface 27*a* produces a thrust force in the intake side camshaft 22 in the direction along which the valve lift is minimized. Therefore, when the lift-varying actuator 22*a* is not driven, the intake side camshaft 22 can automatically move so that the valve lifter 20*a* is brought into contact with the position in the direction of the rotation axis where the valve lift is minimized, and the valve overlap for cold running is brought about. Also, the coil spring 32*a* produces a thrust force in the same direction and helps to bring about the valve overlap for cold running.

With such a simple construction, in a situation such that the lift-varying actuator 22*a* is not sufficiently driven when cold idling after start, it is possible to maintain a valve overlap for cold running by maintaining the lift-varying actuator 22*a* in a non-driven state. Thereby, it is possible to automatically achieve valve overlap for cold running when cold idling.

Next, a description is given of the second embodiment of the invention.

Figure 15:
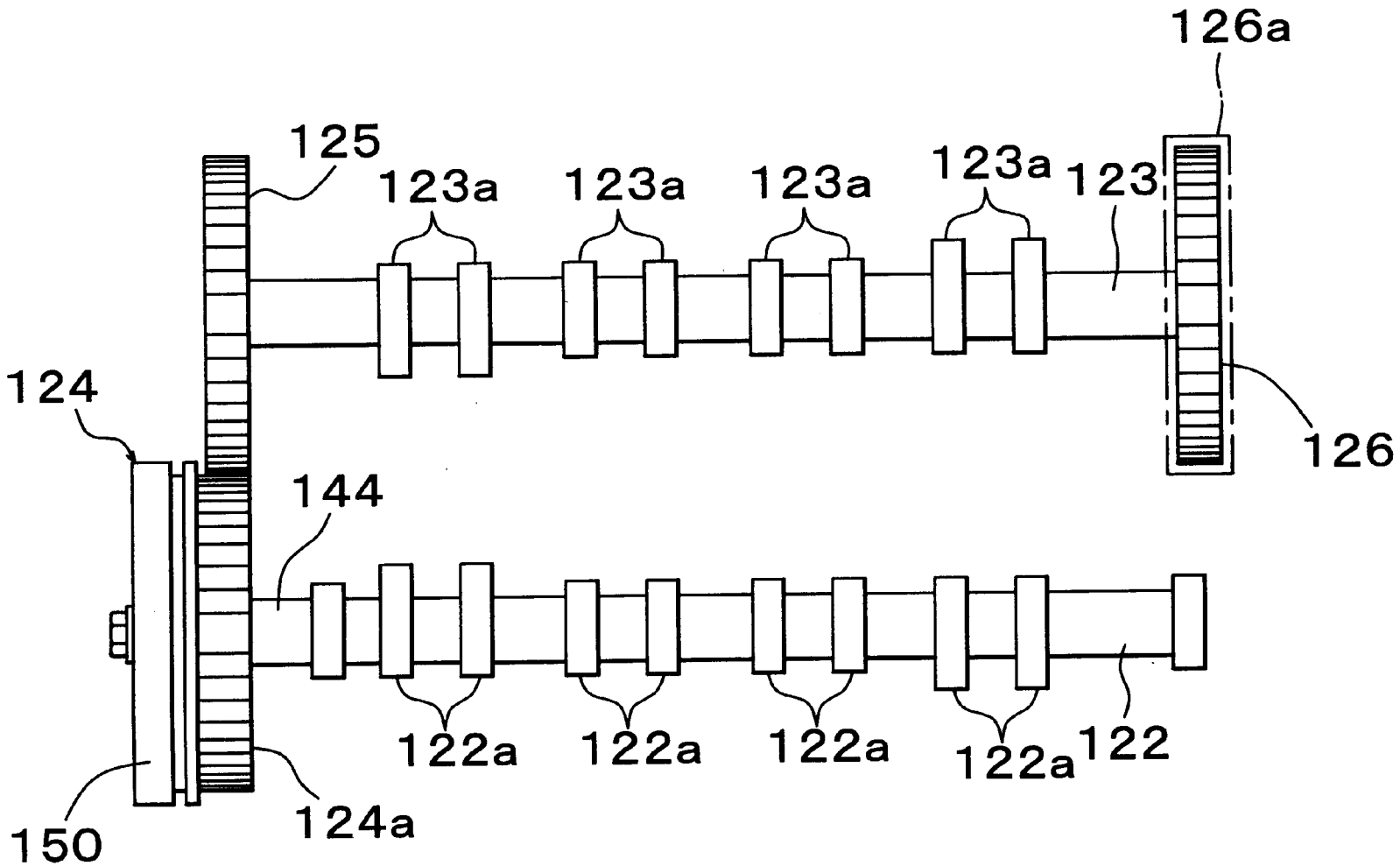
FIG. 15 is a view illustrating a valve operating system in an engine according to another embodiment of the invention.

FIG. 15 is an exemplary plan view of a valve operating system of a four-valve and four-cylinder engine in which the valve drive system is a DOHC and respective cylinders have two intake valves and two exhaust valves as the second embodiment. In the second embodiment, the point in which the intake side camshaft 122 is provided with a valve characteristics controlling apparatus as shown in FIG. 15 is identical to that in the first embodiment. However, only an actuator 124 for varying a phase difference in rotation is employed as the valve characteristics controlling apparatus, wherein no lift-varying actuator is employed. Further, an intake cam 122*a* and an exhaust cam 123*a* are formed as plain cams whose profiles are the same in the axial direction, and the intake side camshaft 122 is made so as not to move in the axial direction as in the exhaust side camshaft 123.

Herein, the intake side camshaft 122 is provided with eight intake cams 122*a*, and at the same time, the actuator 124 for varying a phase difference in rotation is provided at one end of the intake side camshaft 122. The actuator 124 for varying a phase difference in rotation is driven and rotated by a rotating force of a drive gear 125 secured at one end of the exhaust side camshaft 123. The exhaust side camshaft 123 is provided with eight exhaust cams 123*a*, wherein the aforementioned drive gear 125 is secured at one end thereof, and a cam pulley 126 is secured at the other end thereof. A timing belt 126*a* is suspended between the cam pulley 126 and a crank pulley fixed at one end of the crankshaft (not illustrated).

Figure 16:
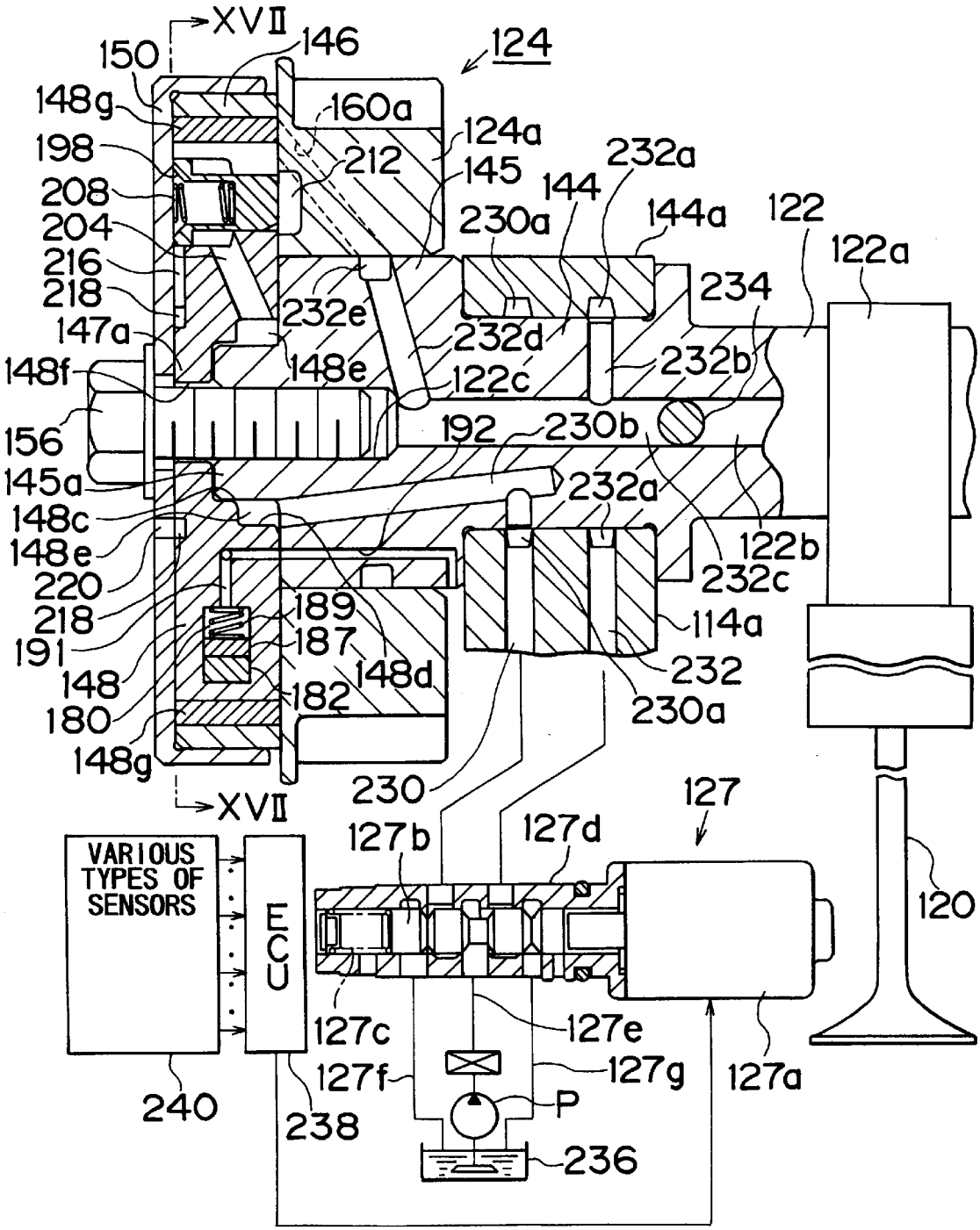
FIG. 16 is a view illustrating the construction of an actuator for varying a rotation phase difference according to the second embodiment shown in FIG. 15.

FIG. 16 shows a longitudinal sectional view (sectional view taken along the line XVI—XVI in FIG. 17 described later) of the actuator 124 for varying a phase difference in rotation at the position of the center axis and it shows a sectional view of an oil control valve 127 that drives the actuator 124 for varying a phase difference in rotation.

The suction side camshaft 122 is formed to be integrated with the journal 144. And, the intake side camshaft 122 is rotatably supported by a journal bearing 114*a* formed in the cylinder head and a bearing cap 144*a* at the journal 144 portion. Also, the intake side camshaft 122 is provided with a plain cam-shaped intake cam 122*a*, and the intake valve 122 is driven to open and close by rotation of the intake cam 122*a*. Further, a diameter-widened portion 145 that is larger than the journal 144 is provided at the end part of the intake side camshaft 122. The actuator 124 for varying a phase difference in rotation is attached to the tip end side of the diameter-widened portion 145.

The actuator 124 for varying a phase difference in rotation is provided with a driven gear 124*a*, an external rotor 146, an internal rotor 148 and a cover 150, etc.

Among them, the driven gear 124*a* is formed to be annular, and the diameter-widened portion 145 is inserted into an internal circular hole of the driven gear 124*a* so as to rotate relative to the driven gear 124*a*. The external rotor 146 is secured at the tip end face side of the driven gear 124*a*. The drive gear 125 secured at the tip end side of the exhaust side camshaft 123 described above is engaged with the driven gear 124*a*. Therefore, the external rotor 146 rotates in synchronization with the crankshaft (not illustrated) when the engine is driven (that is, it rotates rightward as shown by the arrow in FIG. 17 described later).

Figure 17:
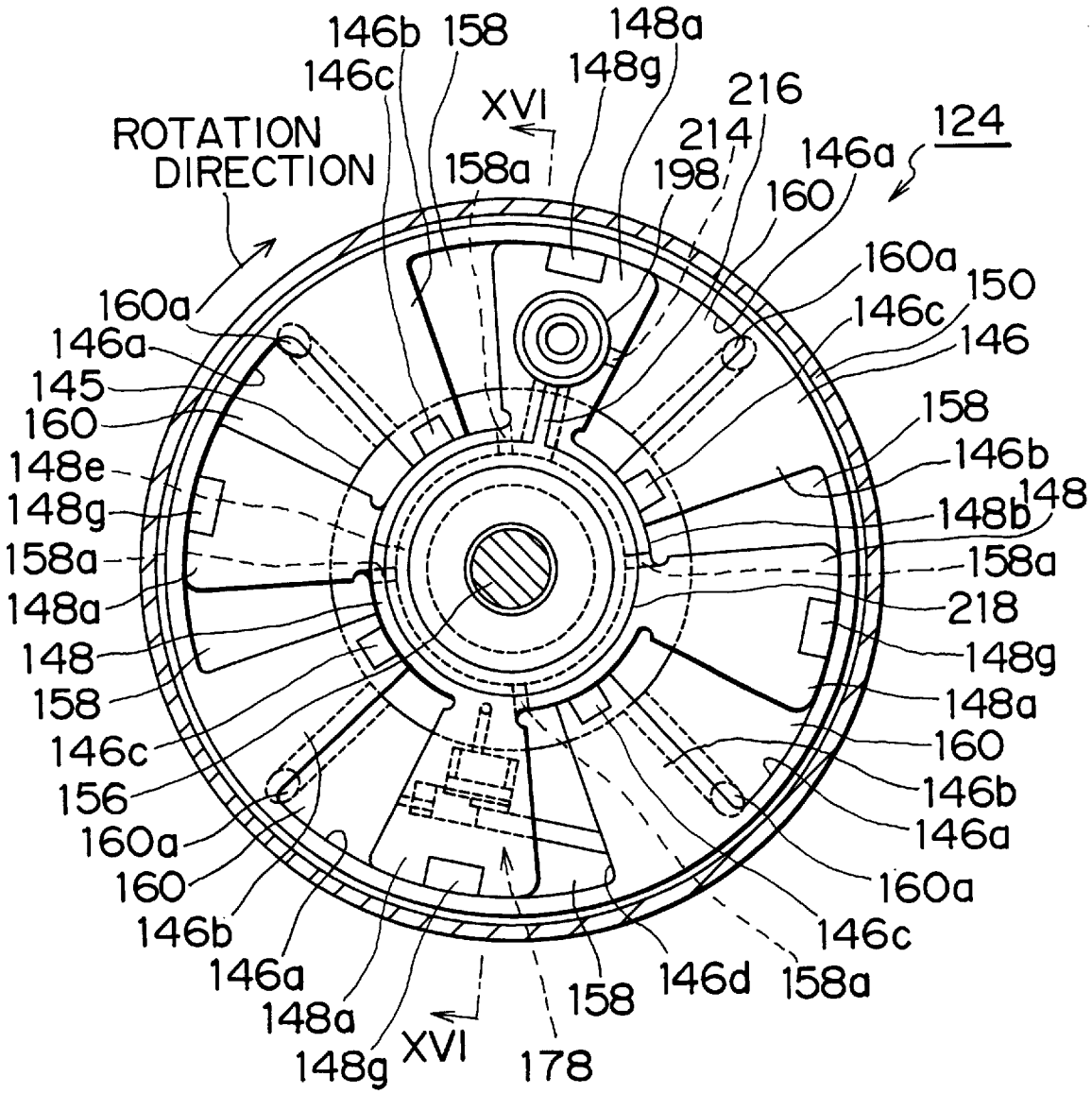
FIG. 17 is a cross-sectional view taken along the line XVII-XVII in FIG. 16.

FIG. 17 shows a sectional structure of the actuator 124 for varying a phase difference in rotation, which is taken along the line XVII—XVII in FIG. 16. The internal rotor 148 is disposed at the center of the external rotor 146. And, the first oil pressure chamber 158 and the second oil pressure chamber 160, which are sectioned by means of vanes 148*a* protruding from the outer circumference of a columnar axial portion 148*b* of the internal rotor 148, are formed in four recesses 146*a* formed on the inner circumferential portion of the external rotor 146.

A fitting hole 148*c* is secured at the diameter-widened portion 145 side of the intake side camshaft 122 on the axial portion 148*b* of the internal rotor 148. A protrusion 145*a* formed at the tip end of the diameter-widened portion 145 is fitted in the fitting hole 148*c*. Thereby, the internal rotor 148 is attached so that it integrally rotates without rotating relative to the intake side camshaft 122. A staged part 148*d* is formed at an open end of the fitting hole 148*c*. An annular oil passage 148*e* is formed by the side of the staged part 148*d*, the outer circumferential surface of the protrusion 145*a* and the tip end face of the diameter-widened portion 145.

As shown in FIG. 17, grooves are formed at the tip end faces of the respective protrusion-shaped parts 146*b* that section the recesses 146*a* in the external rotor 146, and a sealing member 146*c* is accommodated in the respective grooves. The respective sealing members 146*c* are slidably adhered to the outer circumferential surface of the axial part 148*b* of the internal rotor 148 by spring members incorporated therein. In addition, grooves are formed at the tip end faces of the respective vanes 148*a* in the internal rotor 148, and sealing members 148*g* are accommodated in the respective grooves. And, the respective sealing members 148*g* are slidably adhered to the inner circumferential surface of the recess 146 of the external rotor 146 by spring members incorporated therein. Thereby, the first oil pressure chamber 158 and the second oil pressure chamber 160 are formed in an oil-tight state, excluding oil passages through which working oil is supplied and discharged.

As shown in FIG. 16, the cover 150 is attached in close contact with the external rotor 146 so as to rotate relatively thereto at the tip end face side of the external rotor 146. The internal surface of the cover 150 is closely adhered to the tip end face side of the internal rotor 148. An attaching hole 147*a* having a slightly larger diameter than the center hole 148*f* of the internal rotor 148 is formed at the central portion of the cover 150. And, a bolt 156 that couples the intake side camshaft 122, internal rotor 148 and cover 150 altogether is inserted from the attaching hole 147*a* so that they can rotate integrally. The bolt 156 passages through the center hole 148*f* of the internal rotor 148, and is screwed in a female screw portion 122*c* formed at the center axis portion from the protrusion 145*a* of the intake side camshaft 122 to the diameter-widened portion 145.

By such a construction, the respective recesses 146*a* of the external rotor 146 are enclosed by the diameter-widened portion of the intake side camshaft 122, driven gear 124*a*, internal rotor 148 and cover 150.

Figure 18:
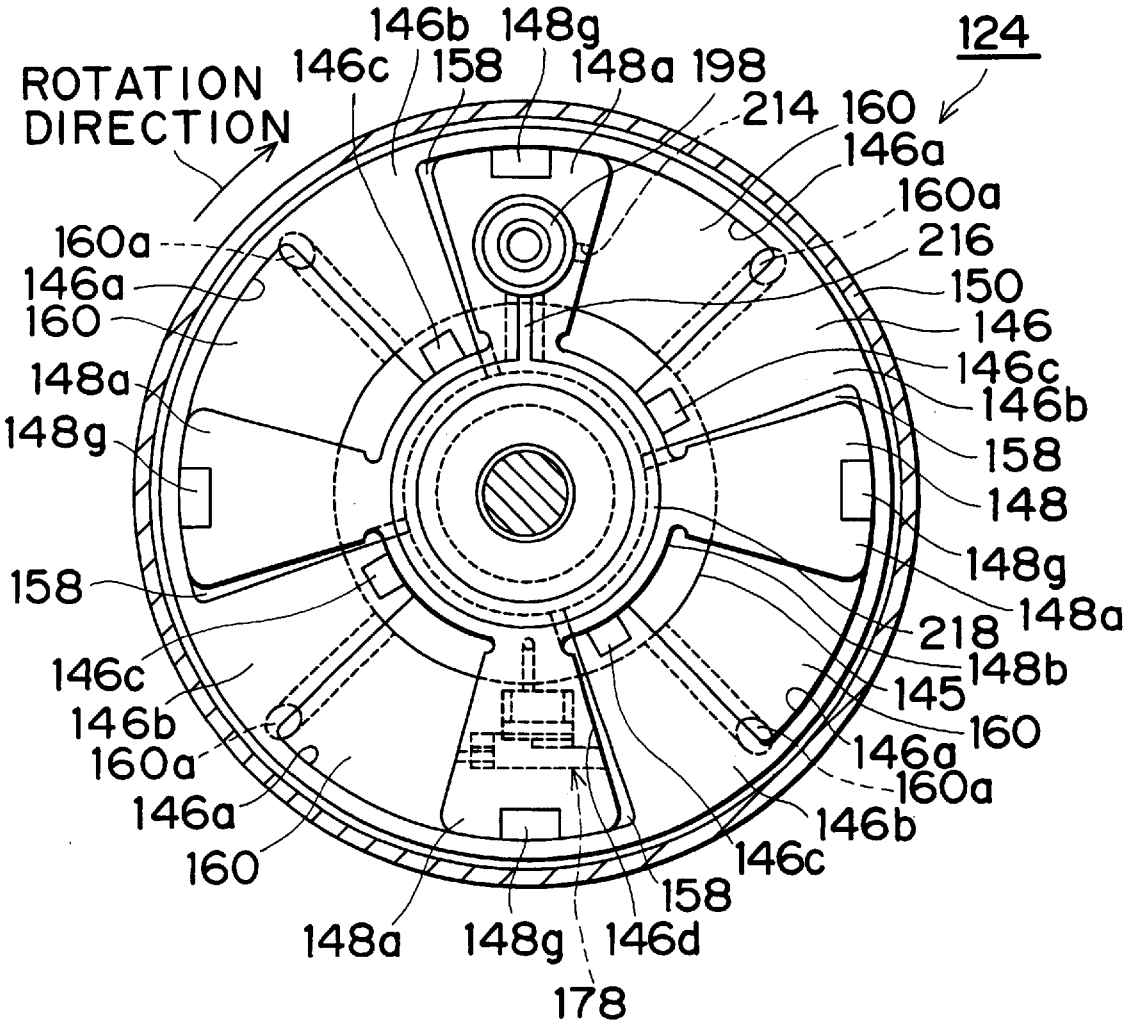
FIG. 18 is a view illustrating operations of the actuator for varying a rotation phase difference according to the second embodiment shown in FIG. 16.

As described above, the respective recesses 146*a* of the external rotor 146 are sectioned by the first oil pressure chamber 158 and the second oil pressure chamber 160 by means of the respective vanes of the internal rotor 148. And, as the external rotor 146 and the internal rotor 148 rotate relative to each other in the direction that widens the second oil pressure chamber 160 and reduces the first oil pressure chamber 158 by the respective vanes 148*a*, the valve timing of the intake valve 120 opened and closed by the intake cam 122*a* is adjusted in the delay side. And, as the adjustment in the delay side is further progressed, one vane 148*a* is, as shown in FIG. 18, brought into contact with the side face 146*d* of the protrusion-shaped part 146*b* since the respective vanes 148*a* reduce the first oil pressure chamber 158. By the contacting thereof, the relative rotation of the internal rotor 148 and external rotor 146 is regulated and they enter the most delayed position, wherein the valve timing of the intake valve is adjusted to the most delayed timing. The most delayed timing is such that, in an engine according to the second embodiment, no valve overlap is provided, and a valve opening and closing timing of the intake valve 120 that enables stabilized combustion, can be brought about when hot idling.

Figure 19:
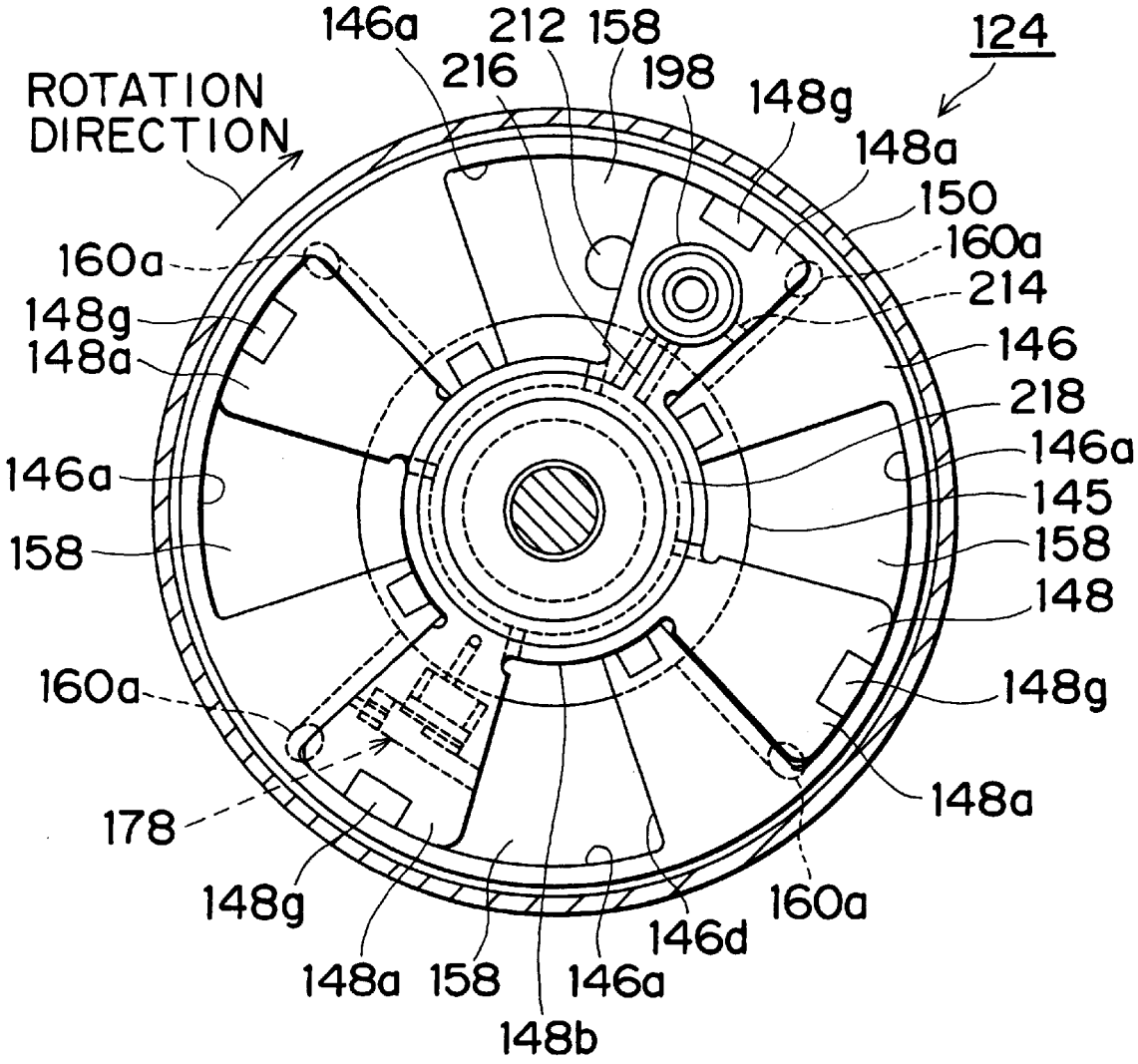
FIG. 19 is a view illustrating operations of the actuator for varying a rotation phase difference according to the second embodiment shown in FIG. 16.

On the contrary, as the external rotor 146 and the internal rotor 148 relatively rotate in the direction that the respective vanes widen the first oil pressure chamber 158 and reduce the second oil pressure chamber 160, the valve timing of the intake valve 120 is adjusted to the advance side. As such adjustment to the advance side is progressed, since the respective vanes 148*a* reduce the second oil pressure chamber 160 as shown in FIG. 19, the respective vanes 148*a* are brought into contact with the side of the protrusion-shaped part 146*b*. By this contacting, the relative rotation of the internal rotor 148 and external rotor 146 is regulated, and they enter the most advanced position, wherein the valve timing of the intake valve 120 is adjusted to the most advanced timing. The most advanced timing brings about the maximum valve overlap in the engine according to the second embodiment. Where the engine is highly loaded and rotates at a low to middle revolution speed, the opening and closing timing of the intake valve 120 ensures combustion having a high cubic volume efficiency.

As described above, when the internal rotor 148 is disposed at the most delayed phase (advance value is 0° CA), one vane 148*a* is brought into contact with the side face 146*d* of the protrusion-shaped part 146*b* of the external rotor 146. The vane 148*a* is provided with a cold idling timing setting part 178. When the engine is just started or when cold idling, the cold idling timing setting part 178 is to cause the valve timing of the intake valve to be set to a valve timing (this valve timing is called "cold idling timing") that is established to an advanced side to some degrees (that is, at an advance value where some valve overlap exists) rather than the most delayed timing.

Figure 33:
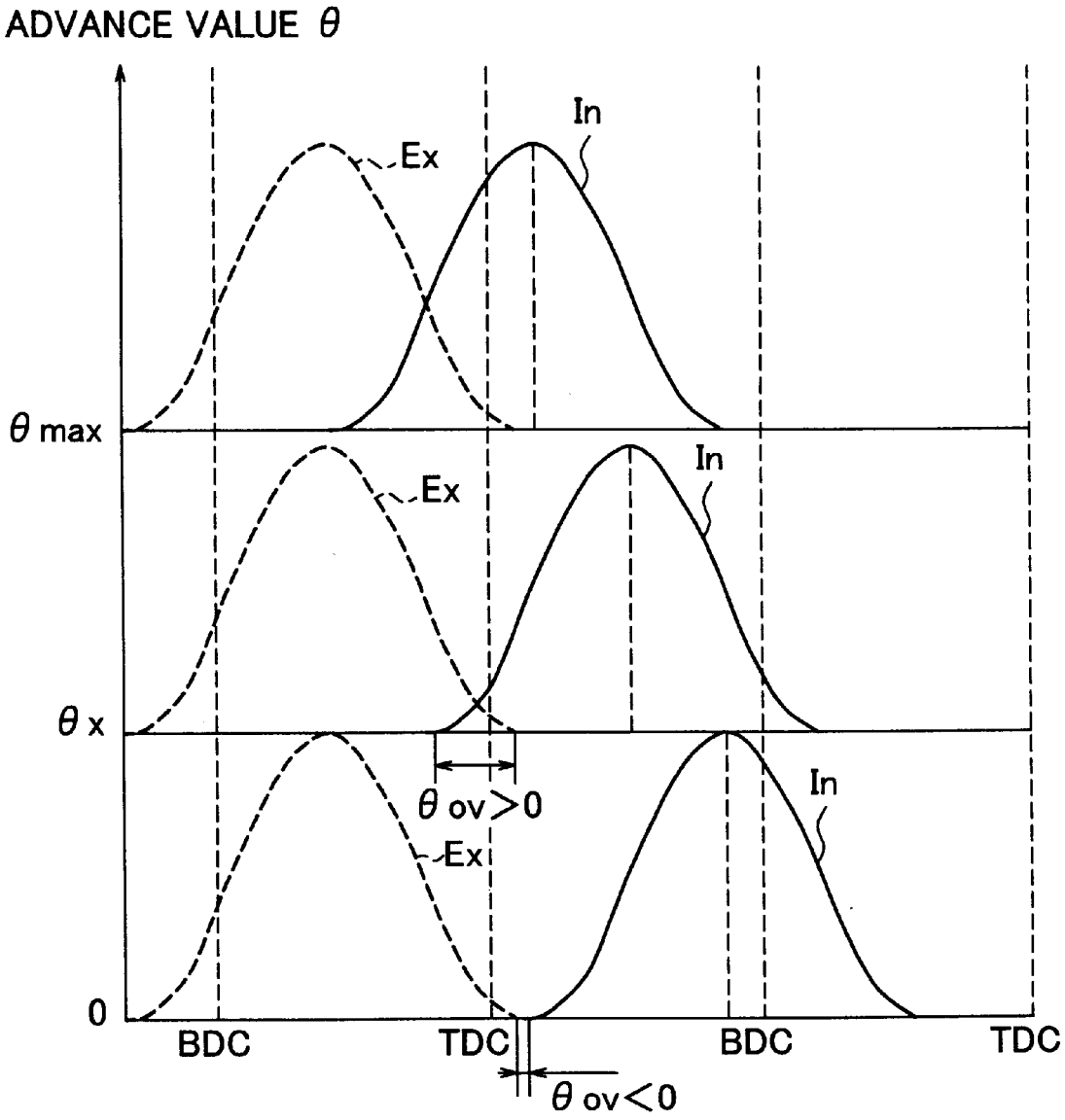
FIG. 33 is a view illustrating the lift patterns of the exhaust valve and intake valve according to the second embodiment shown in FIG. 16.

For example, as in FIG. 33 that shows the relationship between the lift pattern In of the intake valve 120 and lift pattern Ex of the exhaust valve, the valve timing of the intake valve 120 is set to an advance value of $\theta=\theta x$. Also, the advance value $\theta=0$ indicates the most delayed position of the valve timing of the intake valve 120, and the advance value $\theta=\theta max$ indicates the most advanced position of the valve timing of the intake valve 120.

Since, in the cold idling timing ($\theta=\theta x$), the closing timing of the intake valve 120 is not excessively adjusted to the delay side, a mixture that is once sucked in the combustion chamber when starting the engine can be prevented from returning to an intake pipe. Also, the opening timing advance of the intake valve 120 is reasonable, and the valve overlap $\theta ov$ is not excessive, wherein the blow-back of exhaust will not become excessive. Therefore, starting performance of the engine can become favorable.

In addition, at the cold idling timing ($\theta=\theta x$), an adequate blow-back of exhaust is produced by adequate valve overlap $\theta ov$ when cold idling, and a favorable opening timing can be proposed, at which fuel carburetion in the combustion chamber and in the intake port can be progressed.

Also, such cold idling timing has been determined through experiments in advance so that the aforementioned performance can be satisfied in compliance with various types of engines.

Hereinafter, a detailed description is given of a construction of the cold idling timing setting part 178.

Figure 20:
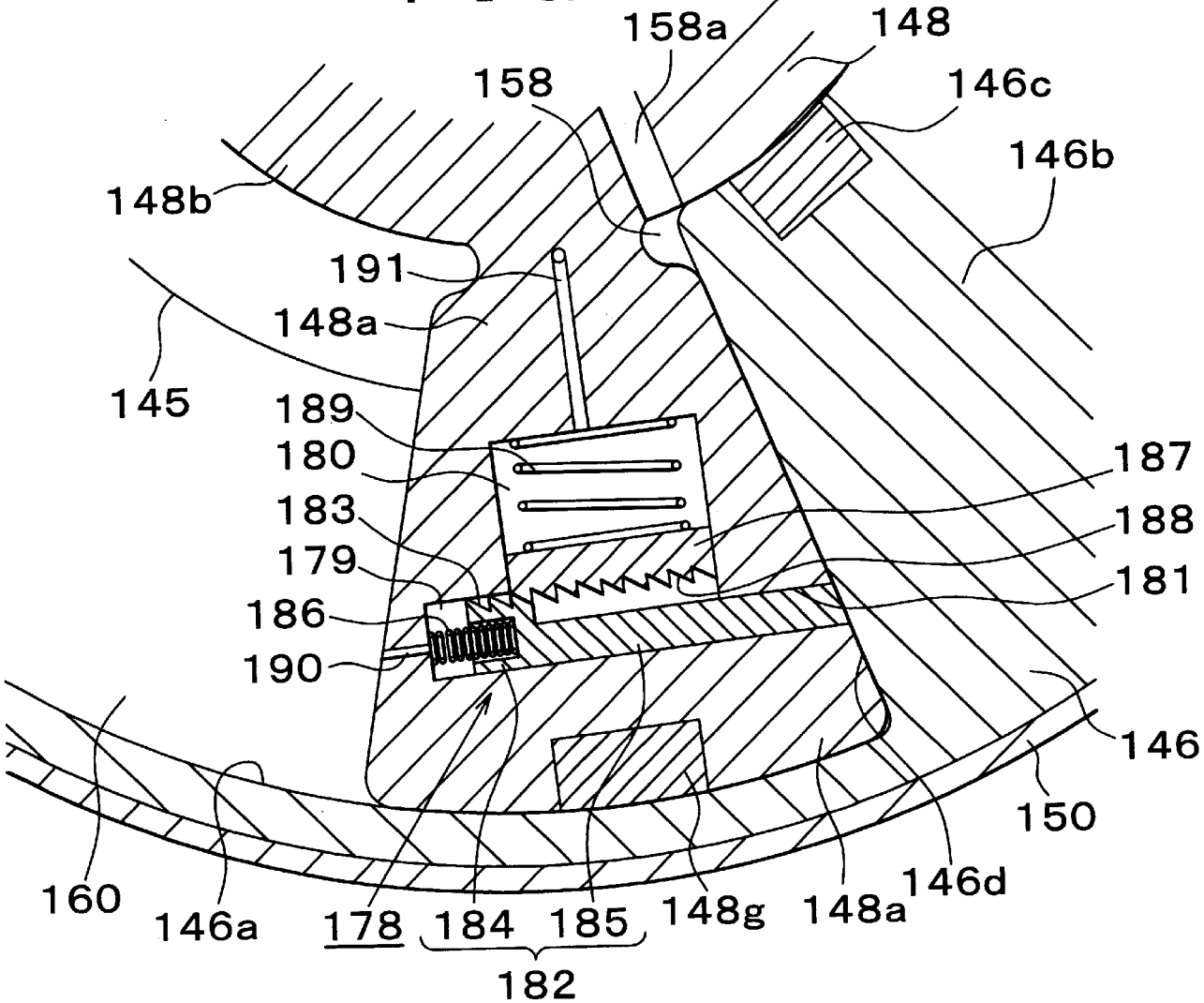
FIG. 20 is a view illustrating the construction of a cold idling timing setter according to the second embodiment shown in FIG. 16.
Figure 21:
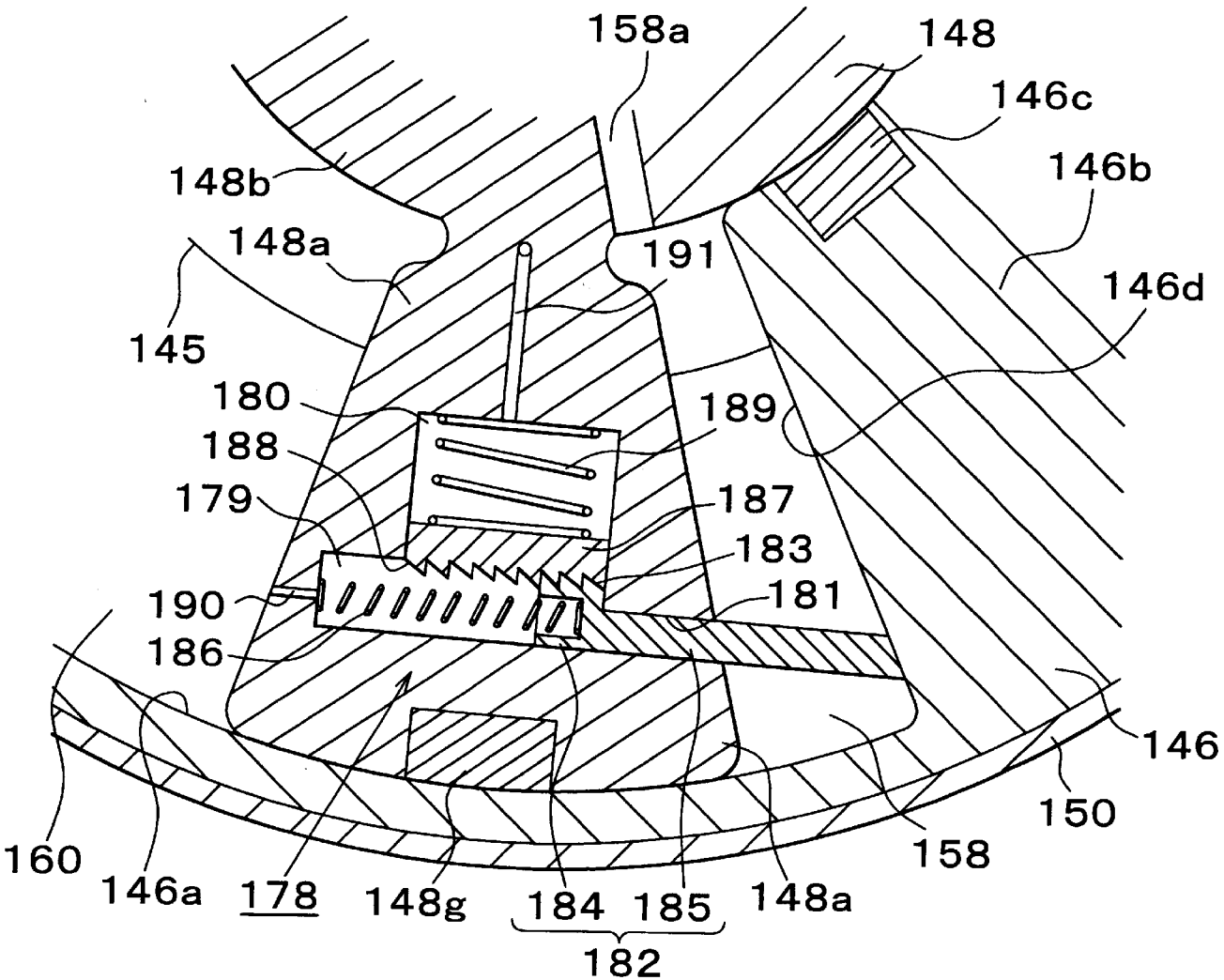
FIG. 21 is a view illustrating operations of a cold idling timing setter according to the second embodiment shown in FIG. 16.
Figure 22:
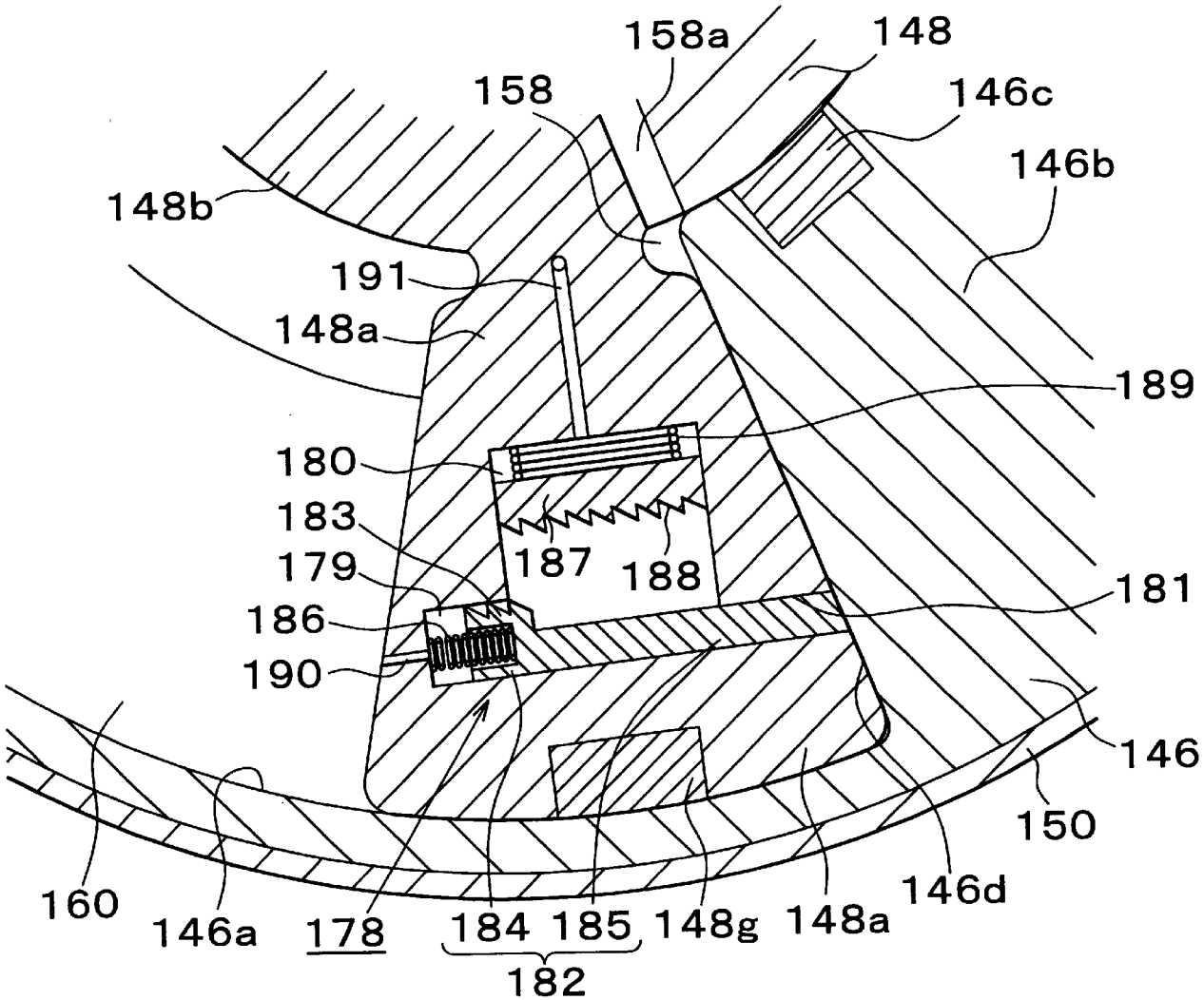
FIG. 22 is a view illustrating operations of a cold idling timing setter according to the second embodiment shown in FIG. 16.

FIG. 20 through FIG. 22 show enlarged views of the cold idling timing setting part 178. As shown in FIG. 20, the first retaining chamber 179 extending in the tangential direction with respect to the direction of the relative rotation of the internal rotor 148 with respect to the external rotor 146 is provided inside one vane 148*a*. The first retaining chamber 179 is open to the first oil pressure chamber 158 side through its outlet and inlet hole 181. Further, the second retaining chamber 180 that communicates with the first retaining chamber 179 and extends almost in the diametrical direction of the internal rotor 148 is secured at the center axis side from the first retaining chamber 179.

In the first retaining chamber 179, a push pin 182 is reciprocably disposed in the direction along which the first retaining chamber 179 extends. That is, the push pin 182 is retained so as to protrude through the outlet and inlet hole 181 toward the side face 146*d* of the protrusion-shaped part 146*b* at the external rotor 146, which forms the first oil pressure chamber 158.

The push pin 182 is provided with a body portion 184 having a toothed part 183 formed at the second retaining chamber 180 side and a pin portion 185 formed so as to extend from the body portion 184 to the outlet and inlet hole 181 side. The body portion 184 is slidably formed in the direction along which the first retaining chamber 179 extends in the first retaining chamber 179, and the pin portion 185 is formed so as to be slidable in the outlet and inlet hole 181 in the same direction and so as to protrude from the outlet and inlet hole 181 into the first oil pressure chamber 158. In addition, at the body portion 184 side of the push pin 179 in the first retaining chamber 179, a compression coil spring 186 that presses the push pin 182 toward the first oil pressure chamber 158 side is disposed between the body portion 184 and the inner wall surface of the first retaining chamber 179.

The state shown in FIG. 20 indicates a state where the body portion 184 is disposed at the position (called a "retreated position") where it is moved extremely toward the second oil pressure chamber 160 side in the first retaining chamber 179 against the pressing force of the compression coil spring 186. In this state, the pin portion 185 does not protrude from the outlet and inlet hole 181 to the inside of the first oil pressure chamber 158, and the pin portion 185 is completely sunk in the outlet and inlet hole 181.

To the contrary, the state shown in FIG. 21 indicates a state where the body portion 184 is pressed by the compression coil spring 186 and is disposed at the position (called a "protruded position") where it is moved extremely toward the first oil pressure chamber 158 side in the first retaining chamber 179. In this state, the pin portion 185 extremely protrudes from the outlet and inlet hole 181 into the inside of the first oil pressure chamber 158. And, where the push pin 182 is disposed at the protruded position and the tip end thereof is brought into contact with the side face 146*d* of the protrusion-shaped part 146*b* at the external rotor 146, the internal rotor 148 is disposed at a rotation phase where the aforementioned cold idling timing is brought about.

Respective teeth of the toothed portion 183 formed at the body part 184 are formed of a perpendicular plane perpendicular to the moving direction of the push pin 182 and an inclined plane extending to the first oil pressure chamber 158 side in order to prevent the push pin 182 from returning to the inside of the first retaining chamber 179 as necessary.

A stopper block 187 is reciprocably disposed in the diametrical direction of the internal rotor 148 in the second retaining chamber 180. The stopper block 187 is provided, at The first retaining chamber 179 side, with a toothed part 188 that is engageable with the toothed part 83 of the body portion 184 of the push pin 182. Respective teeth of the toothed part 188 are formed of a perpendicular plane perpendicular in the moving direction of the push pin 182 and an inclined plane extending from the top part of the perpendicular plane to the second oil pressure chamber 160 side. In addition, a compression coil 189 that presses the stopper block 187 toward the first retaining chamber 179 side is provided in the second retaining chamber 180.

As shown in FIG. 20 and FIG. 21, when the stopper block 187 is pressed by the compression coil spring 189 and is disposed at the position (called an "engaged position") where the stopper block 187 is moved extremely toward the first retaining position 179 side in the second retaining chamber 180, the toothed part 188 of the stopper block 187 is engaged with the toothed part 183 of the push pin 182. To the contrary, as shown in FIG. 22, when the stopper block 187 is extremely moved to the position (called a "disengaged position") at the center side of the internal rotor 148 in the second retaining chamber 180 against the pressing force of the compression force 189, the toothed part 188 of the stopper block 187 is disengaged from the toothed part 183 of the push pin 182.

FIG. 22 shows a state where the first oil pressure chamber 158 is disposed at the retreated position against a pressing force of the compression coil spring 180 by the tip end of the push pin 182 being pressed to the side face 146*d* of the protrusion-shaped part 146*b* in the external rotor 146 where the first oil pressure chamber 158 is reduced. FIG. 20 shows a state where the toothed part 183 of the push pin 182 is engaged with the toothed part 188 of the stopper block 187 by the stopper block being further moved to the engaged position.

FIG. 21 shows a state where, since the internal rotor 148 rotates to the advance side relative to the external rotor 146 in a state such that the toothed parts 183 and 188 are engaged with each other as shown in FIG. 20, the first oil pressure chamber 158 is enlarged and the push pin 182 is moved to the protruded position by a pressing force of the compression coil spring 186. As shown above, in a state where the toothed parts 183 and 188 are engaged with each other, the push pin 182 can move to protrude into the first oil pressure chamber 158 by the sliding of both the inclined planes of the toothed parts 183 and 188. However, in the reverse movement of the push pin 182, since the perpendicular planes of the toothed parts 183 and 188 are brought into contact with each other, the tip end of the push pin 182 cannot be returned in the outlet and inlet hole 181 even though it is pressed from the side face 146*d* of the protrusion-shaped part 146*b* in the external rotor 146. However, if the stopper block 187 moves to the disengaged position, the engagement of the toothed parts 183 and 188 is released. If the toothed part 183 and the toothed part 188 are disengaged from each other like this, the tip end of the push pin 182 is pressed by the side face 146*d* of the protrusion-shaped part 146*b* in the external rotor 146, whereby the push pin 182 can be returned into the outlet and inlet hole 181.

Also, the first retaining chamber 179 is provided with an oil port 190 that communicates with the second oil pressure chamber 160 side. Compressed oil is introduced into the second oil pressure chamber 180 via the oil port 190 and the first retaining chamber 179, so that the compressed oil is applied from the toothed part 188 side of the stopper block 187. Further, the second retaining chamber 180 is provided with an air supply and exhaust passage 191 at the compression coil spring 189 side. The air supply and exhaust passage 191 communicates with an air passage 192 secured so that it can communicate with the outside at the diameter-widened portion 145 of the intake side camshaft 122 as shown in FIG. 16.

Figure 23:
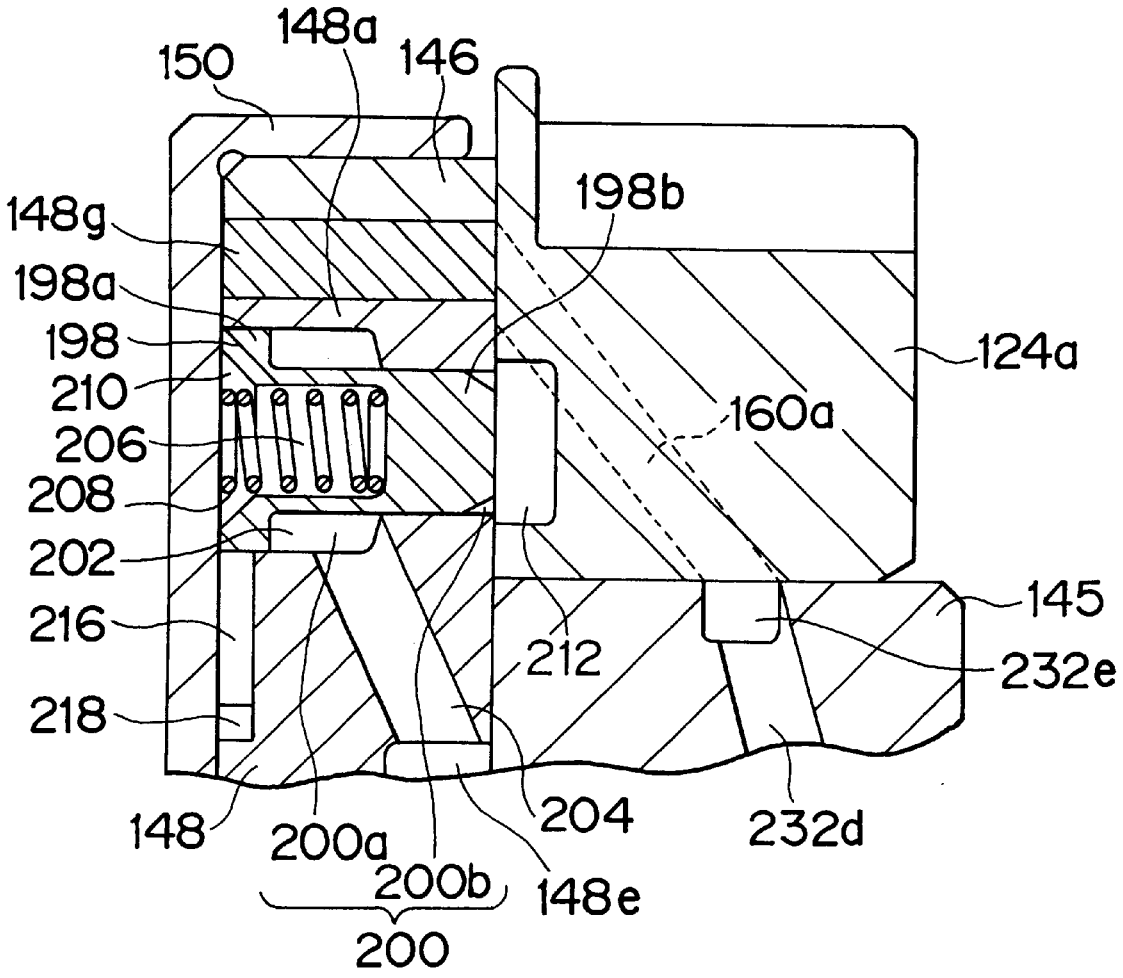
FIG. 23 is a view illustrating a construction of a lock pin and its surrounding according to the second embodiment shown in FIG. 16.
Figure 24:
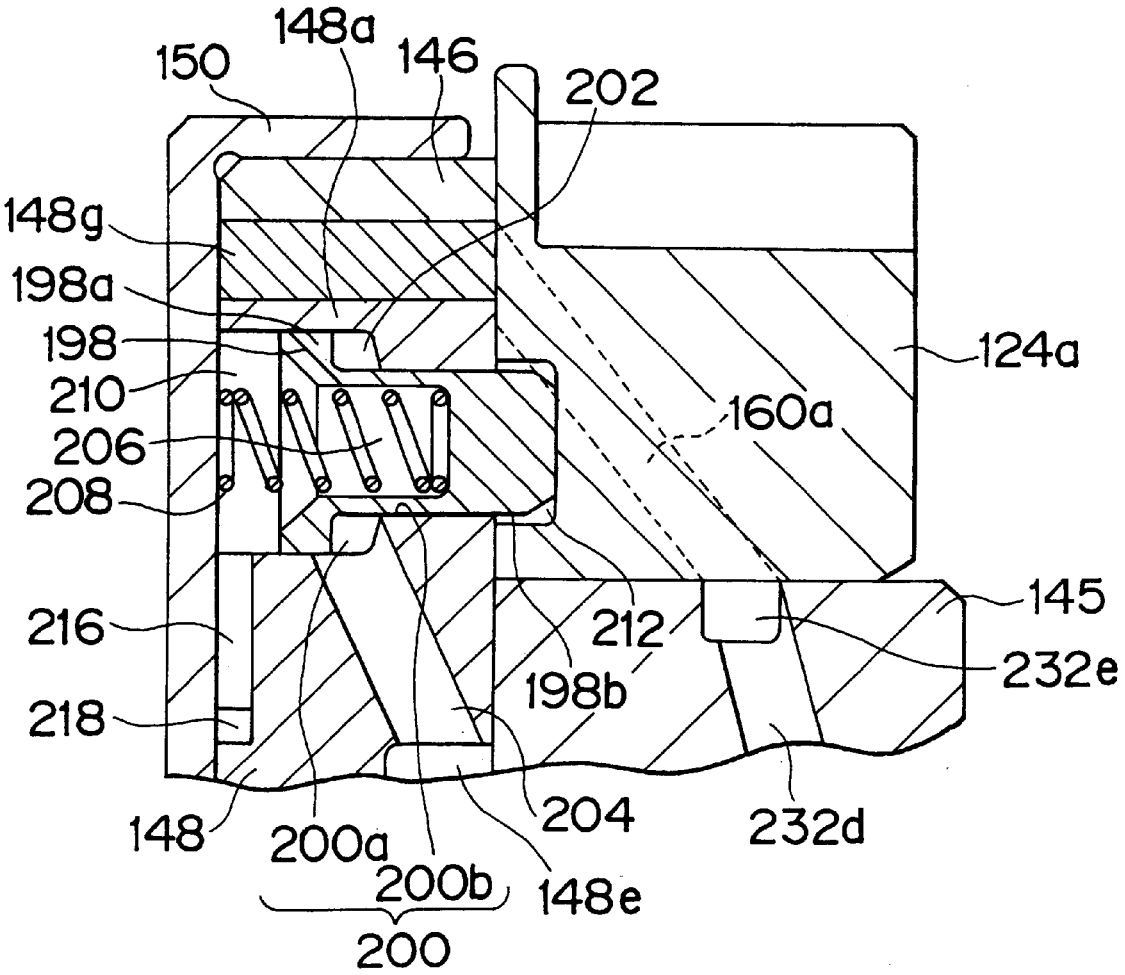
FIG. 24 is a view illustrating operations of the lock pin according to the second embodiment shown in FIG. 16.

As shown in FIG. 16 and FIG. 17, a lock pin 198 that regulates, as necessary, the relative rotation between the internal rotor 148 and the external rotor 146 is secured at another vane 148*a* separate from the vane 148*a* in which the cold idling timing setting part 178 is provided. In the vane 148*a* in which the lock pin 198 is provided, as shown in FIG. 23 and FIG. 24, a retaining hole 200 extending in the direction of the center axis and having a circular section is provided. The retaining hole 200 consists of a large diameter part 200*a* at the cover 150 side and a small diameter part 200*b* at the driven gear 124*a* side. The lock pin 198 is retained in the retaining hole 200 so as to be movable in the direction of the center axis.

The lock pin 198 is like a rotary body and is provided with a diameter-widened portion 198*a* that is slidably brought into contact with the large diameter part 200*a* of the retaining hole 200 and an axial portion 198*b* that is slidably brought into contact with the small diameter part 200*b*. The entire lock pin 198 is formed so that the length thereof in the direction of the center axis is slightly shorter than the entire length of the retaining hole 200. Also, the diameter-widened portion 198*a* of the lock pin is formed shorter than the large diameter part 200*a* of the retaining hole 200, and the axial part 198*b* of the lock pin 198 is formed longer than the small-diameter part 200*b* of the retaining hole 200. An annular oil chamber 202 is formed between the inner circumferential surface of the large diameter part 200*a* of the retaining hole 200 and the outer circumferential surface of the axial part 198*b* of the lock pin 198. An oil passage 204 extending from the aforementioned annular oil passage 148*e* is caused to communicate with the oil chamber 202.

Further, a spring hole 206 extending from the end face of the diameter widened part 198*a* in the direction of the center axis is secured in the lock pin. A compression coil spring 208 that is brought into contact with the inner surface of the cover 150 and presses the lock pin 198 to the driven gear 124*a* side is disposed on the inner surface of the cover 150. Also, a back pressure chamber 210 is formed at the end face side of the diameter widened part 198*a* of the lock pin 198 by the inner circumferential surface of the spring hole 206, the inner circumferential surface of the large diameter part 200*a*, and the inner surface of the cover 150.

Figure 25:
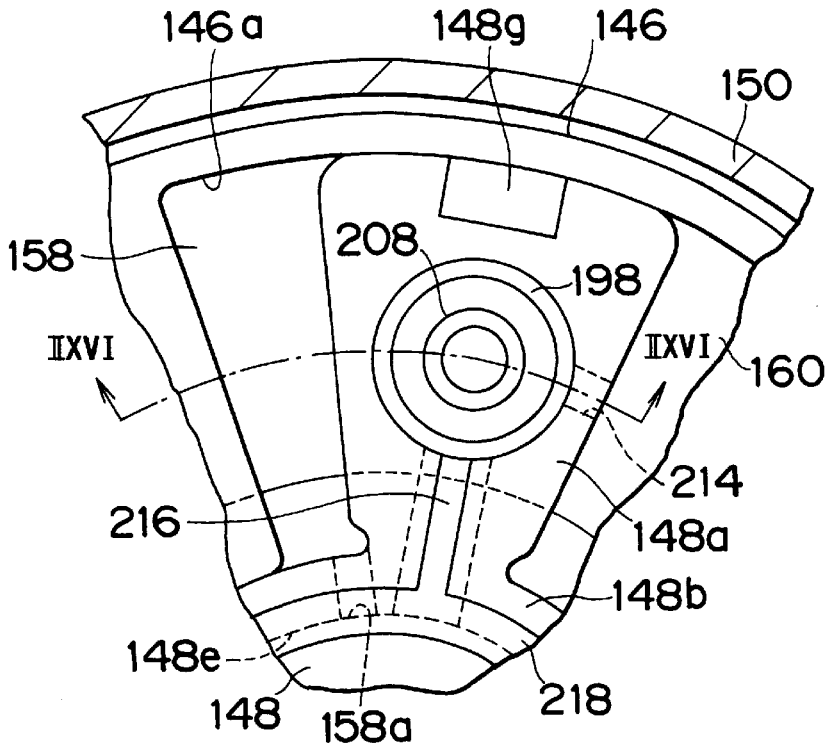
FIG. 25 is a view illustrating the construction of the lock pin and its surrounding according to the second embodiment shown in FIG. 16.
Figure 26:
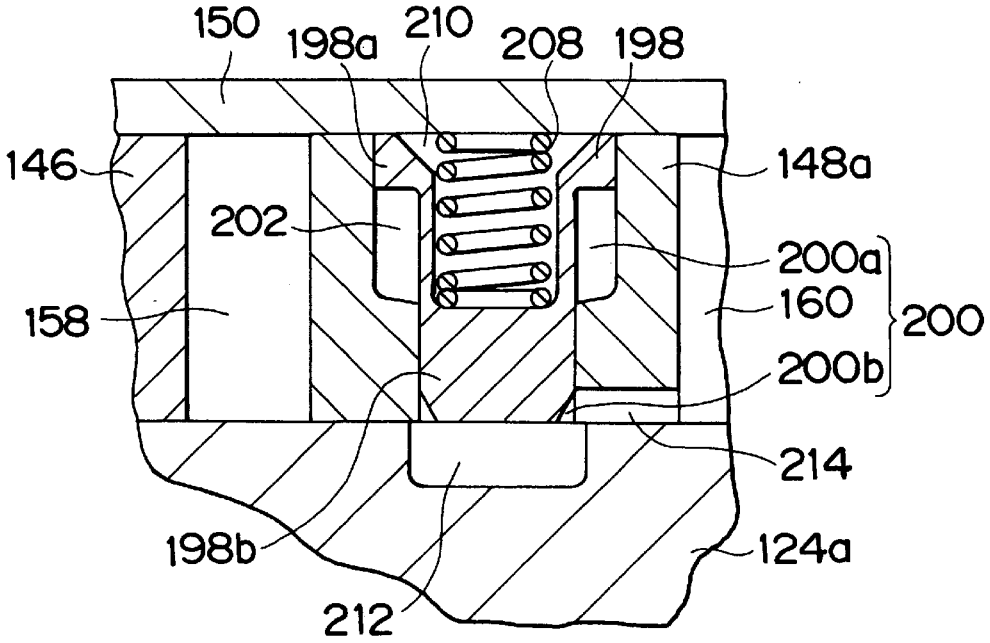
FIG. 26 is a cross-sectional view taken along the line IIXVI-IIXVI in FIG. 25.

On the other hand, an engaging hole 212 that is formed so as to have a slightly larger diameter than the small diameter part 200*b* of the retaining hole 200 is secured on the tip end face of the driven gear 124*a* exposed to the inside of the recess 146*a* of the external rotor 146. The engaging hole 212 is, as shown in FIG. 24, provided to couple the internal rotor 148 with the external rotor 146, so that no relative rotation can be permitted when the engaging hole 212 is engaged with the lock pin 198 moved to the driven gear 124*a* side. As shown in FIG. 25 and FIG. 26 (in the sectional view taken along the line IIXVI—IIXVI in FIG. 25), an oil groove 214 that is caused to communicate with the second oil pressure chamber 160 is caused to communicate with the engaging hole 212.

By the construction described above, the lock pin 198 is movable between the retreated position where the end face at the diameter widened part 198*a* side is brought into contact with the inside surface of the cover 150 and the end part at the axial part 198*b* side does not protrude from the internal rotor 148 to the driven gear 124*a* side as shown in FIG. 23, and the engaged position where the end face at the diameter widened part 198*a* side is separated from the inside surface of the cover 150 and a part of the axial part 198*b* is inserted into the engaging hole 212 of the driven gear 124*a* as shown in FIG. 24.

The positional relationship between the engaging hole 212 of the driven gear 124*a* and the lock pin 198 of the internal rotor 148 is set so that the intake valve 120 is set to the above-described cold idling timing in a state where the lock pin 198 is engaged in the engaging hole 212 and the internal rotor 148 is coupled to the external rotor 146 so that no relative rotation can be permitted therebetween. That is, as shown in FIG. 21, at a phase difference in rotation between the internal rotor 148 and the external rotor 146 in a state where the push pin 182 most extremely protrudes into the first oil pressure chamber 158, the internal rotor 148 and the external rotor 146 are caused to communicate with each other.

The back pressure chamber 210 of the lock pin 198 is caused to communicate with the annular groove 218 by a communication groove 216 as shown in FIG. 18 and FIG. 19. The annular groove 218 is a groove annularly formed around the center axis at the end face at the cover 150 side at the axial portion 148*b* of the internal rotor 148. The communication groove 216 is formed, as shown in FIG. 24, so that the back pressure chamber 210 is caused to communicate with the annular groove 218 when the lock pin 198 is separated from the inside face of the cover 150 by a pressing force of the compression coil spring 208. Also, as shown in FIG. 16, an air hole 220 that communicates with the annular groove 218 is provided in the cover 150. Therefore, the back pressure chamber 210 is caused to communicate with the atmosphere via the communication groove 216, annular groove 218 and air hole 220.

Working oil is supplied to and discharged from the first oil pressure chamber 158 and the second oil pressure chamber 160 of the actuator 124 for varying a phase difference in rotation from the engine side to the intake side camshaft 122. Hereinafter, a description is given of a construction of oil passages, which are provided in order to supply working oil to and discharge the same from the first oil pressure chamber 158 and the second oil pressure chamber 160.

As shown in FIG. 16, an advance side head oil passage 230 to supply working oil to and discharge the same from the respective first oil pressure chambers 158, and a delay side head oil passage 232 that supplies working oil to and discharge the same from the respective second oil pressure chambers 160 are provided in the journal bearing 114*a* formed in the cylinder head.

An annular oil groove 230*a* that communicates with the advance side head oil passage 230 and an annular oil passage 232*a* that communicates with the delay side head oil passage 232 are provided on the inner circumferential surface of the journal bearing 114*a* and bearing cap 144*a*.

At the diameter widened portion 145 side of the intake side camshaft 122, an oil passage 230*b* that causes the annular oil passage 230*a* to communicate with the annular oil passage 148*e* is provided. Also, advance side supply and discharge oil grooves 158*a* (FIG. 17 and FIG. 25) that cause the oil passage 148*e* to communicate with the respective first oil pressure chambers 158 are respectively provided on the end face at the driven gear 124*a* side of the internal rotor 148. Therefore, the respective first oil pressure chambers 158 communicate with the advance side head oil passage 230 through the advance side supply and discharge oil groove 158*a*, oil passage 148*e*, oil passage 230*b* and annular oil groove 230*a*.

On the other hand, the annular oil groove 232*a* is caused to communicate with the oil hole 232*b* with respect to the throughhole 122*b* formed at the center axis portion of the intake side camshaft 122. The throughhole 122*b* portion that is caused to communicate with the oil port 232*b* forms an oil passage 232*c* by both ends thereof being blocked by the above-described bolt 156 and glove 234. The oil passage 232*c* is caused to communicate with the annular oil groove 232*e* formed on the outer circumferential surface of the diameter widened portion 145 in the circumferential direction by an oil hole 232*d* formed in the diameter widened portion 145. Furthermore, the delay side supply and discharge passage 160*a* formed in the driven gear 124*a* is caused to communicate with the annular oil groove 232*e*. The delay side supply and exhaust passage 160*a* communicates with the respective second oil pressure chambers 160. Accordingly, the respective second oil pressure chamber 160 are caused to communicate with the delay side head oil passage 232 via the delay side supply and discharge oil passage 160*a*, annular oil groove 232*e*, oil hole 232*d*, oil passage 232*c*, oil hole 232*b*, and annular oil groove 232*a*.

The advance side head oil passage 230 and delay side head oil passage 232 are respectively connected to the oil control valve 127. The oil control valve 127 has basically the same construction and function as those of the oil control valve referred to in the first embodiment described above and detailed description thereof is omitted.

Consideration is taken into the case where, by the drive of an engine, sufficient working oil is supplied from the oil pump P to the oil control valve 127 side. In this case, when the electromagnetic solenoid 127*a* is not magnetized, as shown in FIG. 16, the spool 127*b* is disposed at one end side (the right side in FIG. 16) of the casing 127*d* by a pressing force of the coil spring 127. Thereby, the oil pump P side supply passage 127*e* is connected to the delay side head oil passage 232, and the working oil from the oil pump P is supplied to the delay side head oil passage 232 side. Also, the advance side head oil passage 230 is connected to the discharge oil passage 127*f* side of the oil pan 236. Thereby, working oil is supplied to the respective second oil pressure chambers 160, and the second oil pressure chambers 160 are expanded, wherein working oil is discharged from the respective first oil pressure chambers 158, and the first oil pressure chambers 158 are reduced. Accordingly, the internal rotor 148 rotates relative to the delay side with respect to the external rotor 146. And, this causes the valve timing of the intake valve 120 to change in the delay direction and the valve overlap changes in the direction of reduction.

At this time, oil pressure supplied from the first oil pressure chamber 158 side to the oil chamber 202 through the advance side supply and discharge groove 158*a*, oil passage 148*e*, and oil passage 204 and supplied from the second oil pressure chamber 160 side to the engaging hole 212 through the oil groove 214 causes the lock pin 198 to be retained at the retreated position. Therefore, the internal rotor 148 and the external rotor 146 can relatively rotate.

In addition, the stopper block 187 of the cold idling timing setting part 178 moves from the engaged position to the disengaged position by oil pressure supplied from the second oil pressure chamber 160 to the second retaining chamber 180 via the oil hole 190 and the first retaining chamber 179, and the stopper block 187 is retained there. As a result, the push pin 182 protrudes from the retreated position to the first oil pressure chamber 158 side by a pressing force of the compression coil spring 186. In this case, the tip end of the push pin 182 may be brought into contact with the side face 146*d* of the external rotor 146 side protrusion 146*b* by the relative rotation of the internal rotor 148 to the delay side. In this case, the push pin 182 is returned from the protruded position to the retreated position side by oil pressure that further presses the internal rotor 148 to the delay side. Therefore, in a case where working oil is sufficiently supplied by the drive of an engine, the internal rotor 148 shown in FIG. 22 can rotate relative to the most delayed position, and the valve timing of the intake valve 120 can be adjusted to the most delayed timing without any hindrance.

Figure 27:
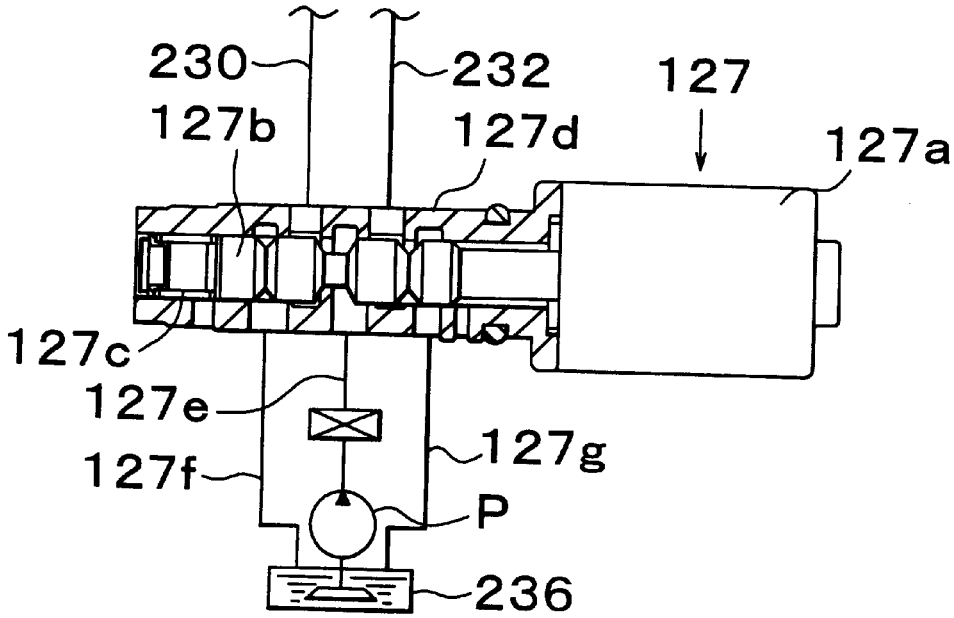
FIG. 27 is a view illustrating operations of an oil control valve according to the second embodiment shown in FIG. 16.

Further, when a current is supplied to the electromagnetic solenoid 127*a*, the spool 127*b* is disposed, as shown in FIG. 27, by the excitation of the electromagnetic solenoid 127*a* at the other end side (the left side in FIG. 27) of the casing 127*d* against the pressing force of the coil spring 127*c*, whereby the supply oil passage 127*e* at the oil pump P side is connected to the advance side head oil passage 230, and working oil from the oil pump P is supplied to the advance side head oil passage 230 side. Furthermore, the delay side head oil passage 232 is connected to the discharge oil passage 127*g* to the oil pan 236. Therefore, working oil is supplied to the respective first oil pressure chambers 158, and the chambers 158 are expanded while working oil is discharged from the respective second oil pressure chamber 160, and they are reduced. The internal rotor 148 rotates relative to the advance side with respect to the external rotor 146. Thereby, the valve timing of the intake valve 120 changes in the hastening direction, wherein the valve overlap changes in the increasing direction.

At this time, as described above, by oil pressure supplied from the first oil pressure chamber 158 side to the oil chamber 202 and supplied from the second oil pressure chamber 160 side to the engaging hole 212, the lock pin 198 is retained at the retreated position. As a result, the internal rotor 148 and the external rotor 146 can relatively rotate. Also, since the first oil pressure chamber 158 is expanded, the internal rotor 148 can relatively rotate regardless of whether or not the push pin 182 protrudes. Therefore, the valve timing of the intake valve 120 can be adjusted to the most advanced timing without any hindrance.

Figure 28:
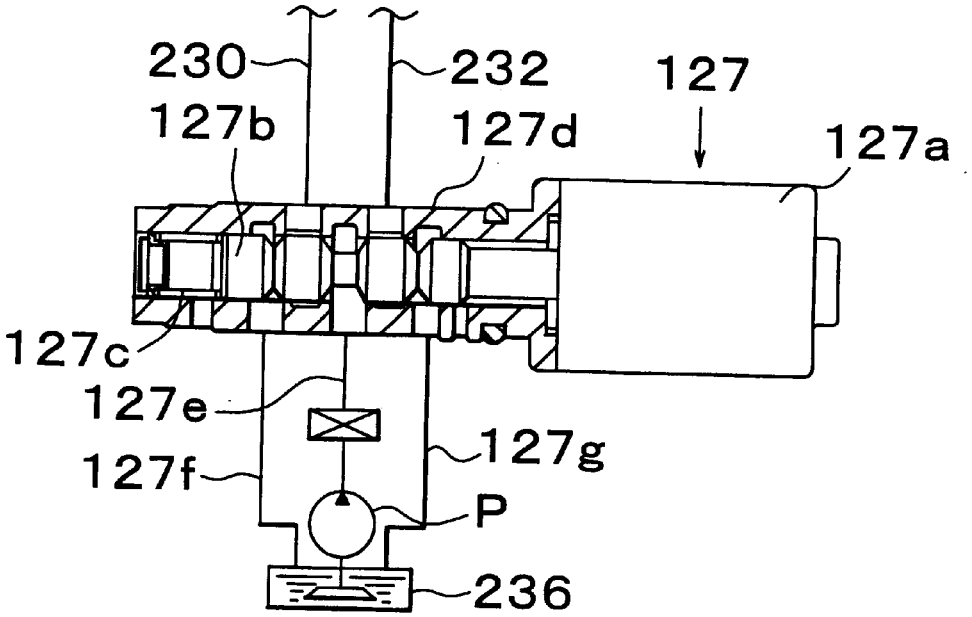
FIG. 28 is a view illustrating operations of an oil control valve according to the second embodiment shown in FIG. 16.

In addition, as shown in FIG. 28, supply of working oil to and discharge of the same from the respective first oil pressure chambers 158 and respective second oil pressure chambers 160 are stopped if both the advance side head oil passage 230 and the delay side head oil passage 232 are blocked by controlling the duty of a signal with respect to the electromagnetic solenoid 127*a*. Accordingly, since the oil pressure of the respective oil pressure chambers 158 and respective second oil pressure chambers 160 is retained, the internal block 148 stops relative rotation with respect to the external rotor 146, whereby the valve timing of the intake valve 120 and valve overlap thereof are maintained in a state where the relative rotation stops.

At this time, the lock pin 198 is maintained at the retreated position. Since the internal rotor 14 stops relative rotation, no hindrance is produced due to any state of the push pin 182.

In addition, as the engine stops, the oil pump P stops, causing the supply of working oil to the oil control valve 127 to stop. The ECU 238 stops controlling of the oil control valve 127. Therefore, oil pressure in the first oil pressure chamber 158 and the second oil pressure chamber 160 is released. As a result, the relative rotation of the internal rotor 148 and the external rotor 146 is not regulated by the relationship between oil pressure in the first oil pressure chamber 158 and that in the second oil pressure chamber 160.

While the external rotor 146 is rotating by inertia rotation immediately after the engine stops, the internal rotor 146 relatively rotates with respect to the external rotor 146 in the delay side due to a reaction from the intake valve 120 side and is disposed at the most delayed position.

Since oil pressure in the oil chamber 202 or the engaging hole 212 is completely released after the internal rotor 148 moved to the most delayed position, the lock pin 198 is pressed to the driven gear 124*a* side by a pressing force of the compression coil spring 208. At this time, since the lock pin 198 is removed from the position of the engaging hole 212 at the driven gear 124*a* side, the lock pin 198 is brought into contact with the end face of the driven gear 124*a*. That is, the engine stops in a state where the internal rotor 148 is not integrated with the external rotor 148 since the lock pin 198 is not engaged in the engaging hole 212.

Further, regarding the cold idling timing setting part 178, when the internal rotor 148 and external rotor 146 relatively rotate by a reaction from the intake valve 120 and the internal rotor 148 is disposed at the most delayed position, the stopper block 187 is retained in a disengaged position by the remaining oil pressure that exceeds the pressing force of the compression coil spring 189. Therefore, the push pin 182 receives a pressure exceeding the pressing force of the compression coil spring 186 from the side face 146*d* of the protrusion-shaped part 146*b* at the external rotor 146 side, and is pushed to the retreated position as shown in FIG. 22.

As the remaining oil pressure is eliminated from the first oil pressure chamber 158 and the second oil pressure chamber 160, the stopper block 187 moves from the disengaged position to the engaged position by the pressing force of the compression coil spring 189. As a result, the toothed part 188 of the stopper block 187 is engaged with the toothed part 183 of the push pin 182 as shown in FIG. 20.

Figure 29:
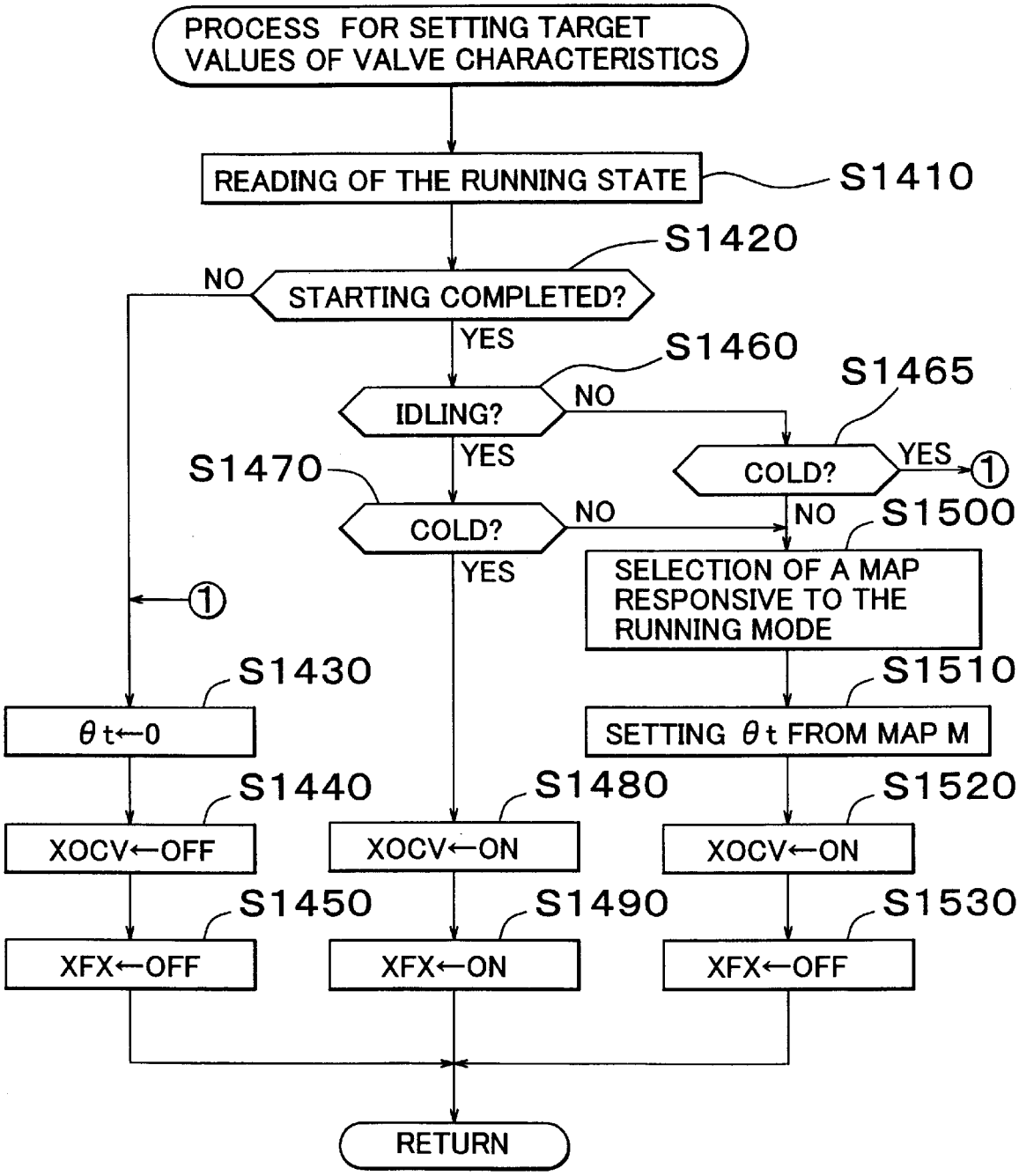
FIG. 29 is a flow chart of a process for setting target values of valve characteristics according to the second embodiment shown in FIG. 16.
Figure 30:
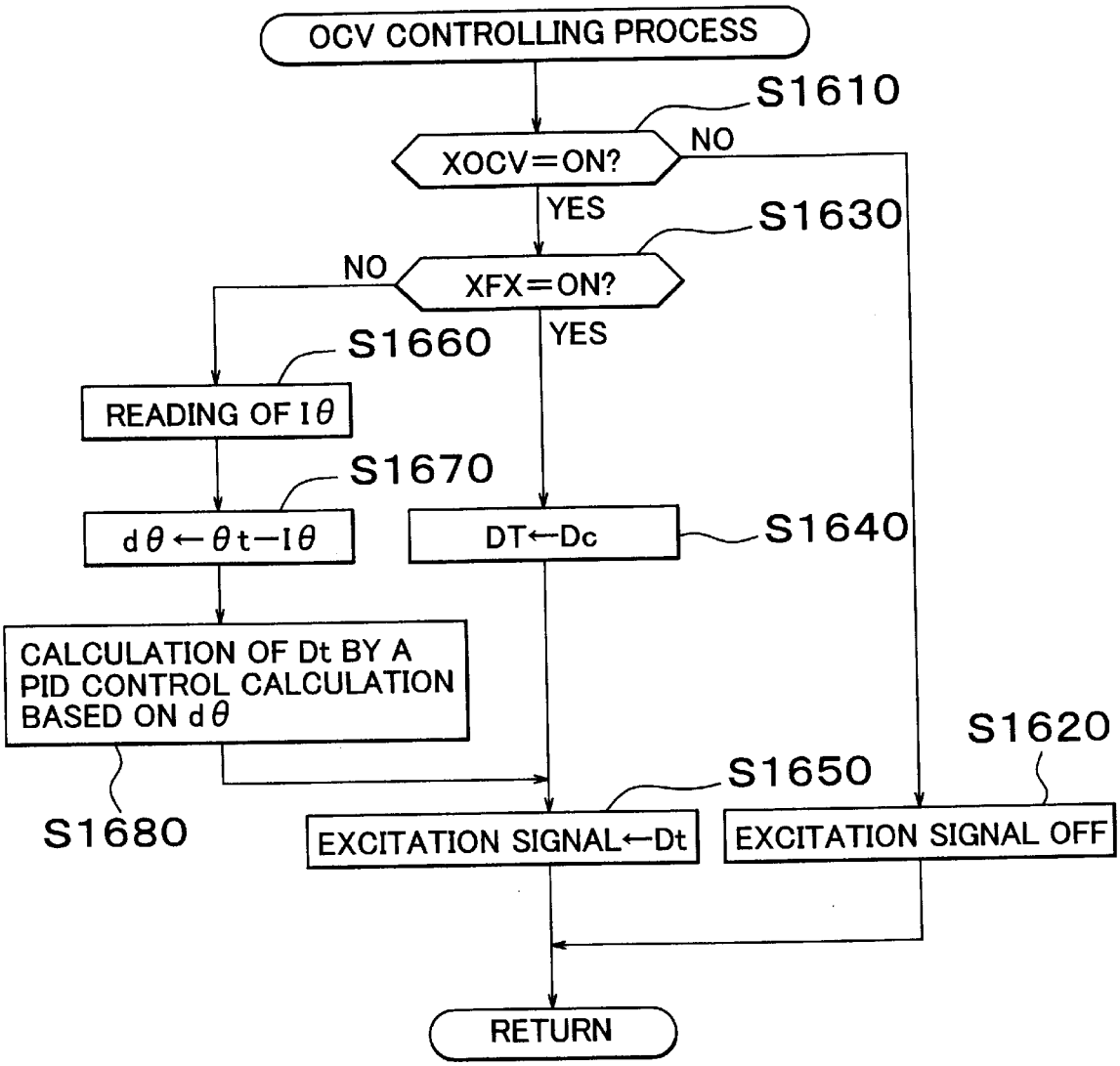
FIG. 30 is a flow chart of a process for controlling an oil control valve (OCV) in the second embodiment shown in FIG. 16.

Next, a description is given of operation of the actuator 124 for varying a phase difference in rotation after the start of an engine in compliance with a process for setting target values of valve characteristics of the intake valve 120, which is carried out by the ECU 238. FIG. 29 is a flow chart showing a process for setting target values of valve characteristics of the intake valve 120, and FIG. 30 is a flow chart showing the process of controlling an oil control valve (OCV). These processes are cyclically repeated after turning the ignition switch on.

As the process for setting target values of valve characteristics is commenced, first, the running state of the engine is read by various types of sensors 240 (S1410). In the second embodiment, the following are read in the working area of a RAM existing in the ECU 238, that is, status of the starter switch, amount GA of intake air obtained from a detected value of an airflow meter, number NE of revolutions of the engine, which is obtained from a detected value of an RPM sensor secured at the crankshaft, coolant temperature THW obtained from a detected value of the water temperature sensor secured in the cylinder block, throttle opening degree TA obtained from a detected value of the throttle opening sensor, vehicle velocity Vt obtained from a detected value of the vehicle velocity sensor, an entire close signal showing that the accelerator pedal is not depressed, which is obtained from the accelerator opening sensor secured at the accelerator pedal or accelerator opening ACCP showing the amount of depression of the accelerator pedal, and advance value Iθ of the intake cam obtained from the relationship between a detected value of the cam angle sensor and a detected value of the RPM sensor.

Next, it is determined (in S1420) whether or not the starting of the engine is completed. Where the number NE of revolutions of the engine is lower than the reference number of times of revolutions to determine the engine drive, or where the starter switch is in a state of [ON], the engine is in a state before starting or is now starting, wherein it is determined that the starting is still not completed ([NO] in S1420), and next, [0] is set in the target advance value θt (S1430). And, [OFF] is set in the OCV drive flag XOCV (S1440), and [OFF] is set in the OCV block flag XFX (S1450). Then, the process is terminated once.

At this time, in the OCV controlling process (FIG. 30), first, it is determined (S1610) whether or not the OCV drive flag XOCV is [ON]. Since XOCV=[OFF] is established in the process for setting target values of valve characteristics (FIG. 29) ([NO] in S1610), an excitation signal for the electromagnetic solenoid 127*a* is [OFF], that is, the electromagnetic solenoid 127*a* is maintained in a non-magnetized state (S1620). Then, the process is terminated once.

Thus, if, before completion of the starting, the oil control valve 127 does not operate at all, the actuator 124 for varying a phase difference in rotation is not driven. Therefore, when starting the engine, if the crankshaft is rotated by the starter in order to start the engine, the external rotor 146 is driven and rotated. However, the internal rotor 148 is driven and rotated in a state where it is at the most delayed position (FIG. 33: θ=θ).

Figure 31:
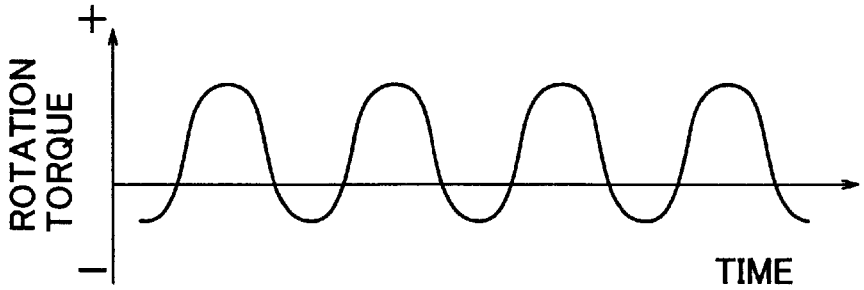
FIG. 31 is a view illustrating states produced at the intake side camshaft in cranking in the engine according to the second embodiment shown in FIG. 16.

Since the intake valve 120 is driven to open and close in the cranking, the intake side camshaft 122 is subject, as shown in FIG. 31, to a rotating torque, which cyclically changes between the positive side and the negative side, from the intake valve side via the intake cam 122*a*. For the duration while the rotating torque becomes negative, the internal rotor 148 rotates to the advance side relative to the external rotor 146.

In the relative rotation to the advance side, the vane 148*a* in which the cold idling timing setting part 178 is mounted slightly parts from the protrusion-shaped part 146*b* at the external rotor 146 side, and the first oil pressure chamber 158 is slightly expanded. At this time, although the toothed part 183 of the push pin 182 of the cold idling timing setting part 178 is engaged with the toothed part 183 of the stopper block 187, movement thereof in the direction protruding into the first oil pressure chamber 158 is permitted by the compression coil spring 186. Therefore, the push pin 182 pressed by the compression coil spring 186 protrudes from the outlet and inlet hole 181 into the first oil pressure chamber 158, which is slightly expanded, until the push pin 182 is brought into contact with the side face 146*d* of the protrusion-shaped 146*b* at the external rotor 146 side.

Next, for the duration while the rotating torque is made positive, the internal rotor 148 rotates to the delay side relative to the external rotor 146. However, the push pin 182 no longer returns into the outlet and inlet 181 by engagement of the toothed parts 183 and 188 with the stopper block 187 side. Therefore, the interval between the vane 148*a* of the internal rotor 148 and the protrusion-shaped part 146*b* of the external rotor 146 is maintained, wherein the first oil pressure chamber 158 no longer contracts for the duration while the rotating torque is made positive.

When the rotating torque is negative next, the first oil pressure chamber 158 is further expanded, and in line therewith, the push pin 182 pressed by the compression coil spring 186 is caused to protrude in the further expanded first oil pressure chamber 158, wherein the rotating torque is next made positive, and the protruding state thereof is maintained.

By repeatedly applying a negative rotating torque and positive rotating torque to the intake side camshaft 122 during the starting of the engine, the first oil pressure chamber 158 is gradually expanded. As the push pin 182 is caused to fully protrude, the first oil pressure chamber 158 stops expanding. As a result, while the cranking is being carried out, the internal rotor 148 rotates to the advance side relative to the external rotor 146, and the valve timing of the intake valve 120 becomes a cold idling timing (FIG. 33: $\theta=\theta x$).

As the internal rotor 148 relatively rotates as it is in the cold idling timing, the lock pin 198 that is sliding in a contacted state with the end face of the driven gear 124*a* is opposed to the engaging hole 212. Therefore, as shown in FIG. 24, the axial portion 198*b* of the lock pin 198 is advanced into the engaging hole 212 by the pressing force of the compression coil spring 208. As a result, when the engine is started, the relative rotation of the internal rotor 148 with the external rotor 146 is regulated in the state of cold idling timing, and the valve timing of the intake valve 120 is fixed at the cold idling timing.

Therefore, when the engine is started, since the closing timing of the intake valve 120 is not excessively adjusted to the delay side, a mixture once sucked in the combustion chamber can be prevented from returning to an intake tube. Also, since the advance value of the opening timing of the intake valve 120 is reasonable and the valve overlap $\theta ov$ does not become excessive, the blow-back of exhaust will not become excessive. Accordingly, the startability can be made favorable.

As the engine drive is started ([YES] in S1420) by repeating the aforementioned processes (Steps S1410 through S1450, and Steps S1610, S1620) during the cranking, it is next determined (S1460) whether or not the engine is idle. Herein, for example, in a case where the vehicle velocity Vt is 4 km per hour or less, and the accelerator opening sensor outputs an entirely closed signal, it is determined that the status of the engine is in idle.

When idling ([YES] in S1460), it is determined whether or not the engine is cold (S1470). For example, if the coolant temperature THW is 78° C. or less, it is determined that the engine is cold. When the engine is cold ([YES] in S1470), that is, herein, if the engine is in cold idling, [ON] is set for the OCV drive flag XOCV (S1480), and [ON] is set for the OCV block flag XFX (S1490). Then, the process is terminated once.

Thereby, first, in the OCV controlling process (FIG. 30), the OCV drive flag XOCV is determined to be [ON] ([YES] in S1610). Next, it is determined (S1630) whether or not the OCV block flag XFX is [ON]. Herein, since XFX=[ON] is set in the process for setting target values of valve characteristics (that is, [YES] in S1630), fixed duty Dc is established in the duty Dt of an excitation signal for the electromagnetic solenoid 27*a* (S1640). The excitation signal is formed (S1650) on the basis of the duty Dt in which the fixed duty Dc is established. Then, the process is terminated once.

In the case where a corresponding excitation signal is outputted to the electromagnetic solenoid 127*a*, the value of the fixed duty Dc is made into duty control to position the spool 127*b* as shown in FIG. 28. That is, in FIG. 28, the advance side head oil passage 230 and the delay side head oil passage 232 are interrupted by the spool 127*b* from the oil pump P side supply oil passage 127*e* and exhaust oil passages 127*f* and 127*g*.

Thereby, no working oil is supplied to or discharged from the first oil pressure chamber 158 via the advance side head oil passage 230, and no working oil is supplied to or discharged from the second oil pressure chamber 160 via the delay side head oil passage 232. Therefore, a low-pressure state when starting the engine is maintained in the first oil pressure chamber 158 and the second oil pressure chamber 160. That is, a non-driven state of the actuator 124 for varying a phase difference in rotation will be continued.

For this reason, the lock pin 198 is continuously inserted in the engaging hole 212 at the driven gear 124*a* side, and the engine is started in a state where the phase difference in rotation between the internal rotor 148 and the external rotor 146 is fixed. Accordingly, in the case of the cold idling, the valve timing of the intake valve 120 is maintained at the cold idling timing (FIG. 33: $\theta=\theta x$) even if the engine is driven. Therefore, with reasonable blow-back of exhaust by an adequate valve overlap $\theta ov$, carburetion of fuel can be promoted in the combustion chamber and intake ports.

Figure 32:
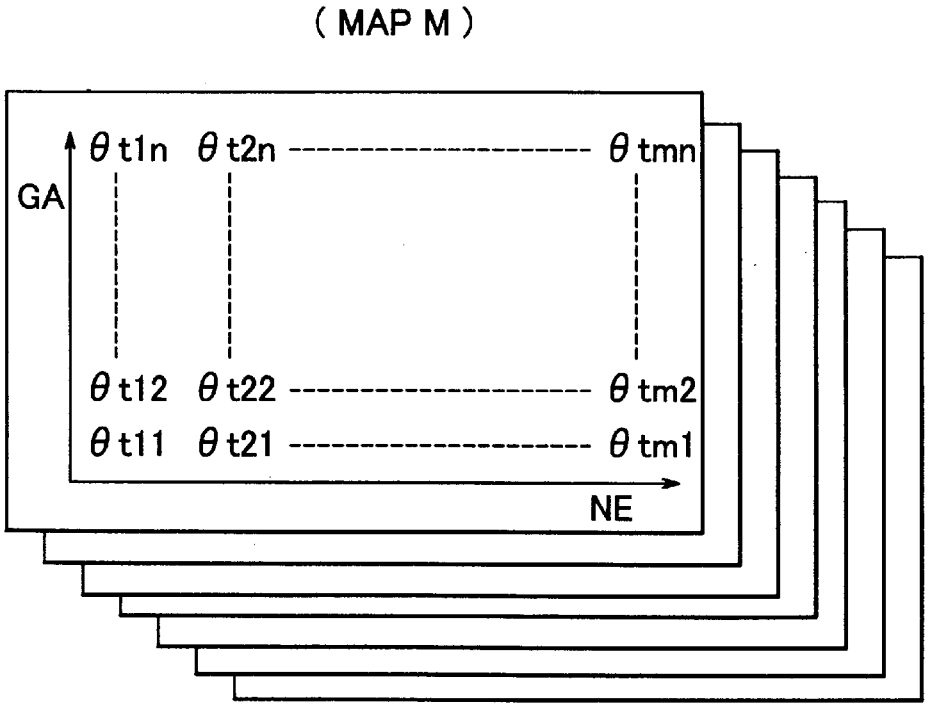
FIG. 32 is a view illustrating a map construction of a target advance value θt used in the process for setting target values of the valve characteristics according to the second embodiment shown in FIG. 16.

As it is determined ([NO] in S1470) that the engine is not cold, but is hot, as the engine temperature is raised after such a cold idling state is continued for a while, a map suited to the running mode of the engine is next selected (S1500). The ROM of the ECU 238 is provided with a map M in which target advance values $\theta t$ are established for respective running modes such as idling, stoichimetric combustion running, and lean combustion running, etc., after the engine is warmed up, that is, when hot running, as shown in FIG. 32. In Step S1500, a running mode is determined (at this time, [Idling] is determined) based on the running state read in Step S1410, wherein a map M corresponding to the running mode is selected from a group of maps. The map M is used to obtain an adequate target valve value $\theta t$ by using the engine load (herein, the air intake amount VA) and number NE of revolutions of the engine serving as parameters.

Also, as far as, for example, the valve overlap is concerned, the distribution of target values θt in the map M shown in FIG. 32 are similar to the description of the aforementioned embodiment with reference to FIG. 12.

After the map M corresponding to the running mode is selected in Step S1500, the target advance values θt for controlling the advance value feedback are established from the number NE of revolutions of the engine and air intake amount GA on the basis of the selected map M (S1510). Next, [ON] is established in the OCV drive flag XOCV expressing the drive of the oil control valve 127 (S1520), and [OFF] is established in the OCV block flag XFX (S1530). Then, the process is terminated.

Thereby, first, in the OCV controlling process (FIG. 30), the OCV drive flag XOCV is determined to be [ON] ([YES] in S1610), and next, the OCV block flag XFX is determined to be [OFF] ([NO] in S1630). Therefore, the actual advance value 10 of the intake cam, which is calculated from the relationship between the detected value of the cam angle sensor and that of the PRM sensor, is read (S1660). And, a deviation dθ between the target advance value θt established in Step S1510 of the process (FIG. 29) for setting target values of valve characteristics and the actual advance value Iθ is calculated by the following expression (3).

$$d\theta \leftarrow \theta t - I\theta \tag{3}$$

And, duty Dt for control with respect to the electromagnetic solenoid 127*a* of the oil control valve 127 is calculated (S1680) by a PID control calculation based on the deviation dθ, and an excitation signal to the electromagnetic solenoid 127*a* based on the duty Dt is established (S1650). Then, the process is terminated.

Since the oil control valve 127 will be controlled by the duty Dt for control, which is adjusted in response to the running state, the spool 127*b* frequently changes its position by the electromagnetic solenoid 127*a*, wherein the actuator 124 for varying a phase difference in rotation will be started and driven.

A high pressure working oil is thereby supplied from the oil pump P side supply oil passage 127*e* into the first oil pressure chamber 158 and the second oil pressure chamber 160. Therefore, the oil pressure in the first oil pressure chamber 158 and the second oil pressure chamber 160 is raised. Accordingly, oil pressure is supplied from the first oil pressure chamber 158 side into an oil chamber 202 via the advance side supply and discharge oil groove 158*a*, oil passage 148*e*, and oil passage 204, and from the second oil pressure chamber 160 side to the engaging hole 212 via the oil groove 214. The lock pin 198 is returned to the retreated position by the oil pressure, thereby releasing the engagement of the driven gear 124*a* with the engaging hole 212. As a result, relative rotation between the internal rotor 148 and external rotor 146 is enabled.

In addition, by oil pressure supplied from the second oil pressure chamber 160 in the second retaining chamber 180 via the oil hole 190 and the first retaining chamber 179, the stopper block 187 of the cold idling timing setting part 178 moves from the engaged position to the disengaged position and is retained there. At this time, the push pin 182 protrudes to the first oil pressure chamber 158 side by the pressing force of the compression coil spring 186. However, even if the tip end of the push pin 182 is brought into contact with the side face 146*d* of the protrusion-shaped part 146*b* at the external rotor 146 side since the stopper block 187 moves to the disengaged position and is retained there, the push pin 182 can be pushed back from the protruded position to the retreated position side by relative rotation of the internal rotor 148 to the delay side. Therefore, since the internal rotor 148 can be relatively rotated to the most delayed position shown in FIG. 22, the valve timing of the intake valve 120 can be adjusted to the most delayed timing (FIG. 33: θ=0) without any hindrance.

Furthermore, regarding the relative rotation of the internal rotor 148 to the advance side, the lock pin 198 is retained at the retreated position as described above. As a result, relative rotation between the internal rotor 148 and the external rotor 146 will be enabled. Also, since the first oil pressure chamber 158 is about to be enlarged, the internal rotor 148 can be relatively rotated in the advancing direction regardless of whether or not the push pin 182 protrudes. Accordingly, the valve timing of the intake valve 120 can be adjusted to the most advanced timing (FIG. 33: θ=θmax) without any hindrance.

Also, if both the advance side head oil passage 230 and delay side head oil passage 232 are blocked by the spool 127*b*, as shown in FIG. 28, by controlling the duty with respect to the electromagnetic solenoid 127*a* after oil pressure is supplied to the first oil pressure chamber 158 and the second oil pressure chamber 160, supply of working oil to and discharge thereof from the respective first oil pressure chambers 158 and the respective second oil pressure chambers 160 are stopped. Thereby, the already supplied high pressure working oil will be maintained in the respective first oil pressure chambers 158 and the respective second oil pressure chambers 160, and the lock pin 198 is maintained at the retreated position. However, the internal rotor 148 stops rotation relative to the external rotor 146. Therefore, the valve timing of the intake valve 120 may be retained in a state where the relative rotation stops.

In addition, where the running mode enters any of statuses other than idling when hot ([NO] in S1460), it is next determined (S1465) whether or not the engine is cold. Since the engine is hot ([NO] in S1465), the processes of Steps S1500 through S1530 described above are carried out. Thus, the running mode in a non-idling state when hot is determined, and the target advance value θt is established. Furthermore, the duty control to drive the actuator 124 for varying a phase difference in rotation is carried out by the OCV controlling process (FIG. 30) (S1660 through S1680, and S1650).

Also, in a case where a non-idling state is brought about when cold ([NO] in S1460, and [YES] in S1465), steps S1430 through S1450 are carried out, and the actuator 124 for varying a phase difference in rotation is maintained in a non-driven state in the OCV controlling process (FIG. 30) (S1620).

Further, in the case where the engine is stopped, as described above, oil pressure of both the first oil pressure chamber 158 and the second oil pressure chamber 160 is released, and the relative rotation between the internal rotor 148 and the external rotor 146 will not be regulated by the relationship between the oil pressure in the first oil pressure chamber 158 and the second oil pressure chamber 160. And, while the external rotor 146 is rotated by inertia rotation immediately after the engine is stopped, the internal rotor 148 rotates relative to the external rotor 146 by a reaction from the intake valve 120 side and is disposed at the most delayed position (FIG. 33: θ=0).

And, after the internal rotor 148 moved to the most delayed position, the lock pin 198 is brought into contact with the end face of the driven gear 124*a*. In addition, after the push pin 182 is pushed in to the retreated position by the side face 146*d* of the protrusion-shaped part 146*b* at the external rotor 146 side, the toothed part 188 of the stopper block 187 is engaged with the toothed part 183 of the push pin 182. Thereby, the push pin 182 will be returned to the state before the starting of the engine, which is shown in FIG. 20.

In the second embodiment described above, the actuator 124 for varying a phase difference in rotation corresponds to a rotation phase difference adjuster, the cold idling timing setting part 178 and engaging mechanism including the lock pin 198 and -engaging hole 212 correspond to the non-drive valve overlap setter, and various types of sensors 240 corresponds to the running status detector. Further, the process for setting target values of valve characteristics in FIG. 29 is equivalent to a process serving as the valve overlap controller operative for a variable valve overlap control mechanism.

The following characteristics are provided by the second embodiment described above.

(i). In the second embodiment, it is possible to adjust the valve timing of the intake valve 120 by the actuator 124 for varying a phase difference in rotation, whereby it is also possible to adjust the valve overlap.

When the cranking is carried out, the cold idling timing setting part 178 and the engaging mechanism including the lock pin 198 and engaging hole 212 can naturally bring about a cold valve overlap in the actuator 124 for varying a phase difference in rotation.

Therefore, in the case where the actuator 124 for varying a phase difference in rotation cannot be driven due to an insufficient output of oil pressure, etc., when the engine is still cold after it starts, supply of oil pressure to the actuator 124 for varying a phase difference in rotation by the oil control valve 127 is stopped if it is determined that the engine is in cold idling, whereby it is possible to maintain a cold valve overlap.

And, since supply of oil pressure to the actuator 124 for varying a phase difference in rotation is commenced by the oil control valve 127, the engaging mechanism including the lock pin 198 and engaging hole 212, and the cold idling timing setting part 178 are released. Accordingly, the actuator 124 for varying a phase difference in rotation will be able to be driven when hot, the phase difference in rotation can be adjusted as optionally, wherein it is possible to achieve a required valve overlap in response to the running state.

Therefore, in the cold idling state, the mixture can be made into a sufficient air-fuel ratio without depending on an increase in fuel, wherein combustion will be stabilized still further than in a case where the valve overlap is not increased, and it is possible to prevent cold hesitation from occurring. Further, it is possible to maintain the drivability in a comparatively favorable state. Still further, fuel efficiency and emission can be prevented from worsening without depending on an increase in fuel. Accordingly, the amount of the remaining gas in the combustion chamber can be reduced in a hot idling in which fuel carburetion is sufficient, and sufficient stability of combustion can be secured.

(ii). In a cold idling state, since a cold valve overlap can be achieved without the use of a lift-varying actuator, it contributes to a lowering of the engine weight.

(iii). The valve timing of the intake valve 120 when the engine is started is established at the advance side cold idling timing (FIG. 38: $\theta=\theta x$) rather than the delay timing (FIG. 33: $\theta=0$). Therefore, when the engine is started or is in a cold timing state, the mixture that is admitted in the combustion chamber once is returned into an intake tube, and the actual compression ratio is lowered without excessively adjusting the open and close timing to the delay side, wherein it will not become difficult to start the engine. On the other hand, by adjusting the open and close timing to the delay side as much as possible in other running areas during the running of the engine, an intake inertia effect can be increased, and output characteristics can be improved, wherein pumping loss can be reduced, and fuel efficiency can be improved.

(iv). An engaging mechanism is provided, which includes a lock pin that fixes the internal rotor 148 relatively rotated to the cold idling timing by the cold idling timing setting part 178 at the cold idling timing position, and the engaging hole 212. Therefore, relative rotation between the internal rotor 148 and the external rotor 146 is prohibited until the engine is driven and the cold idling state is terminated.

As a result, it is possible to securely prevent the internal rotor 148 and the external rotor 146 from fluctuating from a phase difference in rotation corresponding to a cold idling timing due to fluctuations of a rotating torque applied to the intake side camshaft 122 when the engine is started and is in a cold idling state.

Also, the push pin 182 can be prevented from colliding with the side face 146*d* of the protrusion-shaped part 146*b* at the external rotor 146 side. Therefore, when the engine is started or is in a cold idling state, the valve timing of the intake valve 120 is retained at the cold idling timing at high accuracy, whereby it is possible to maintain a heightened ability to start the engine and to stabilize combustion of the engine in a cold idling state.

Still further, it is possible to prevent a tapping noise from being generated when the engine is started or is in a cold idling state, and it is also possible to prevent the push pin 182 and the side of 146*d* of the protrusion-shaped part 146*b* at the external rotor 146 side from being damaged or worn.

Next, an example of a third embodiment is decribed below.

Figure 34:
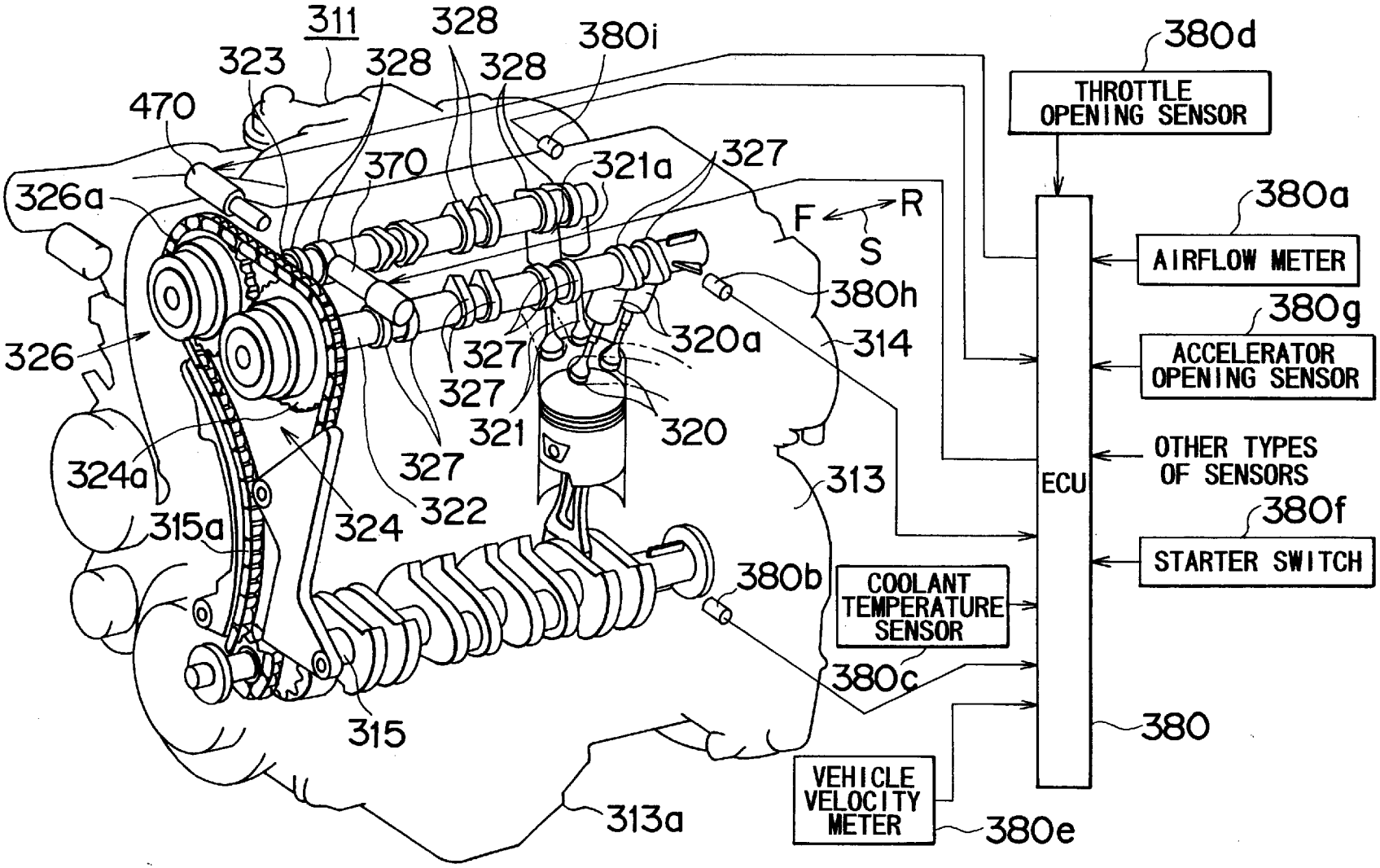
FIG. 34 is a view of the general configuration illustrating the valve operating system in the engine according to a third embodiment of the present invention.

In the third embodiment, as shown in FIG. 34, both an intake side camshaft 322 and an exhaust side camshaft 323 are, respectively, provided with lift-varying actuators 324 and 326. Of them, the first lift-varying actuator 324 is able to displace the intake side camshaft 322 in the direction of the rotation axis, whereby the lift of the intake cam 327 is varied by an intake cam 327 formed as a three-dimensional cam, and at the same time, the phase difference in rotation between the intake valve 320 and the exhaust valve 321 can be adjusted. Therefore, the intake side camshaft 322 is supported in a cylinder head 314 of an engine 311 so as to be movable in the direction of the rotation axis.

Figure 35:
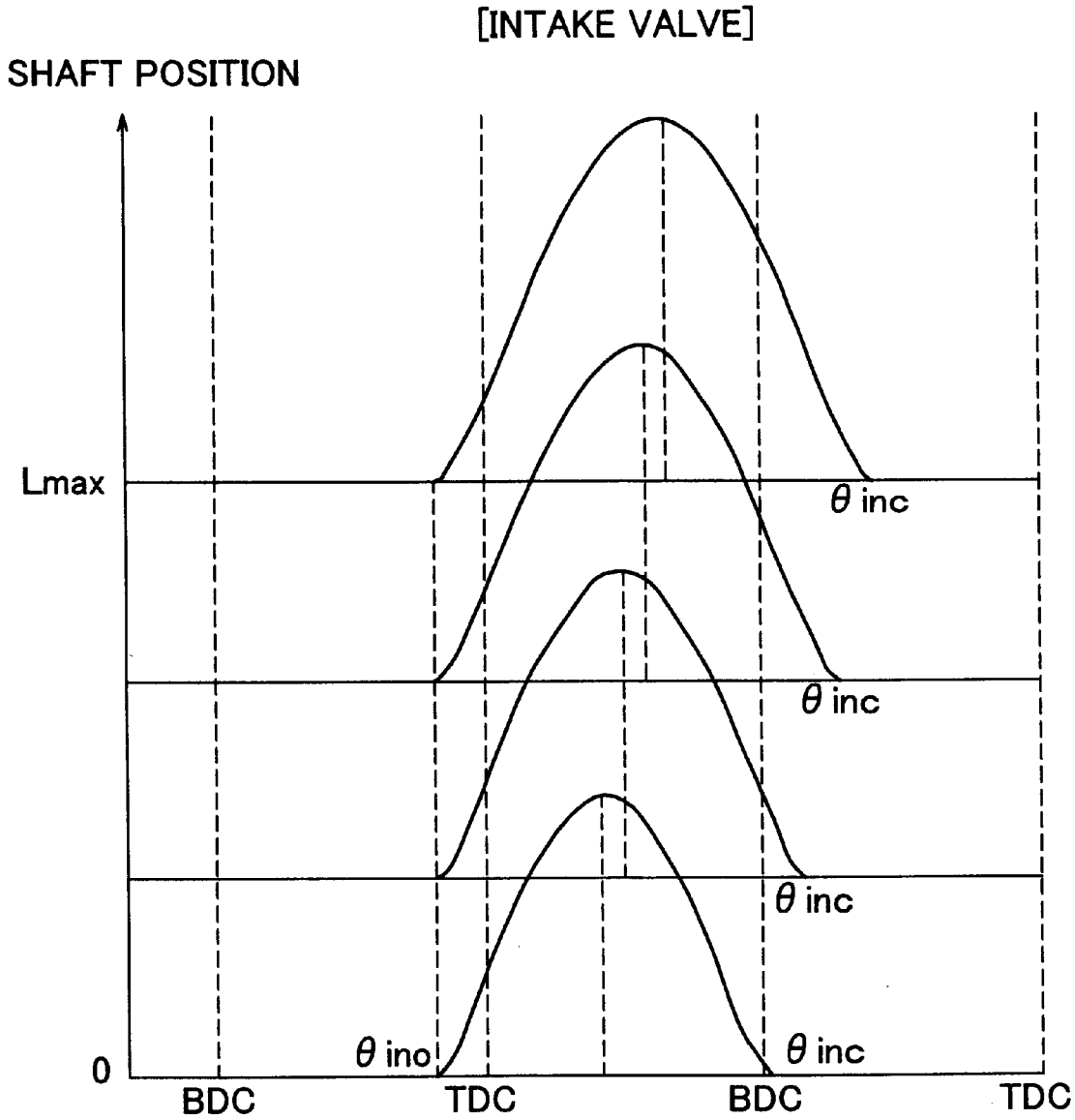
FIG. 35 is a view illustrating the lift patterns of the intake valve according to the third embodiment shown in FIG. 34.

In addition, the intake cam 327 is formed similar to that described with reference to FIG. 7 and FIG. 8 in connection with the first embodiment. Also, the valve timing is, as shown in FIG. 35, generally delayed by the first lift-varying actuator 324 in compliance with an increase in the displacement of the shaft position of the intake side camshaft 322, and is most delayed at the maximum shaft position Lmax. However, since an operation angle is increased in line with an increase in the shaft position, the open timing $\theta$ino of the intake valve 320 is made into the same crank angular phase regardless of the shaft position. On the other hand, the close timing $\theta$inc of the intake valve 320 is made into the most advanced state where the displacement of the shaft position is 0, and is made into the most delayed state where it is at the maximum shaft position Lmax.

In other words, the second lift-varying actuator 326 is used to change the position of the exhaust side camshaft 323 in the direction of the rotation axis, whereby the lift of the exhaust valve 321 is varied by the exhaust cam 328 formed as a three-dimensional cam. Accordingly, the exhaust side camshaft 323 is supported in the cylinder head 314 of the engine 311 so as to be movable in the direction of the rotation axis.

Figure 36:
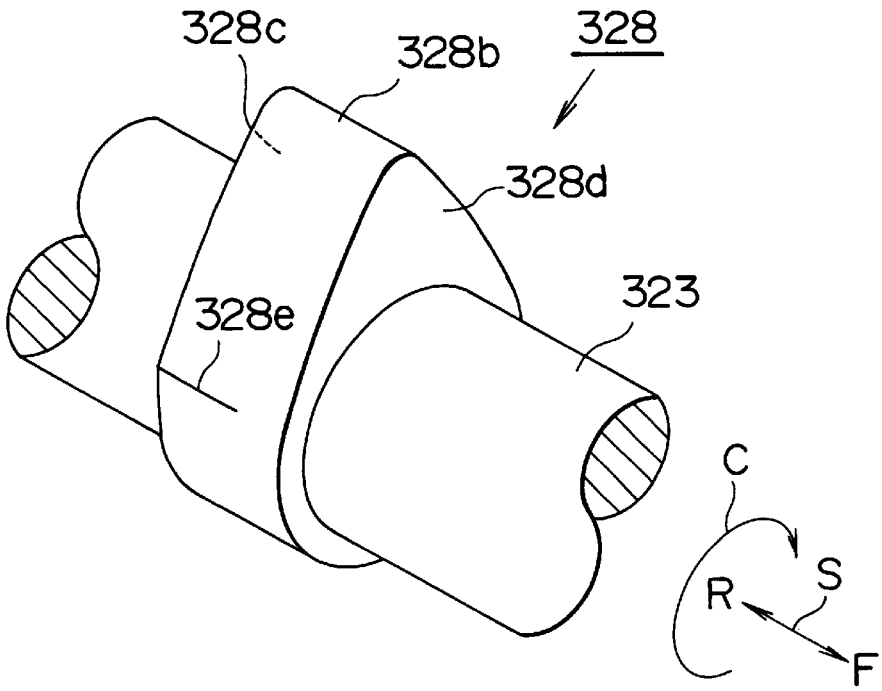
FIG. 36 is a perspective view of the intake cam according to the third embodiment shown in FIG. 34.
Figure 37:
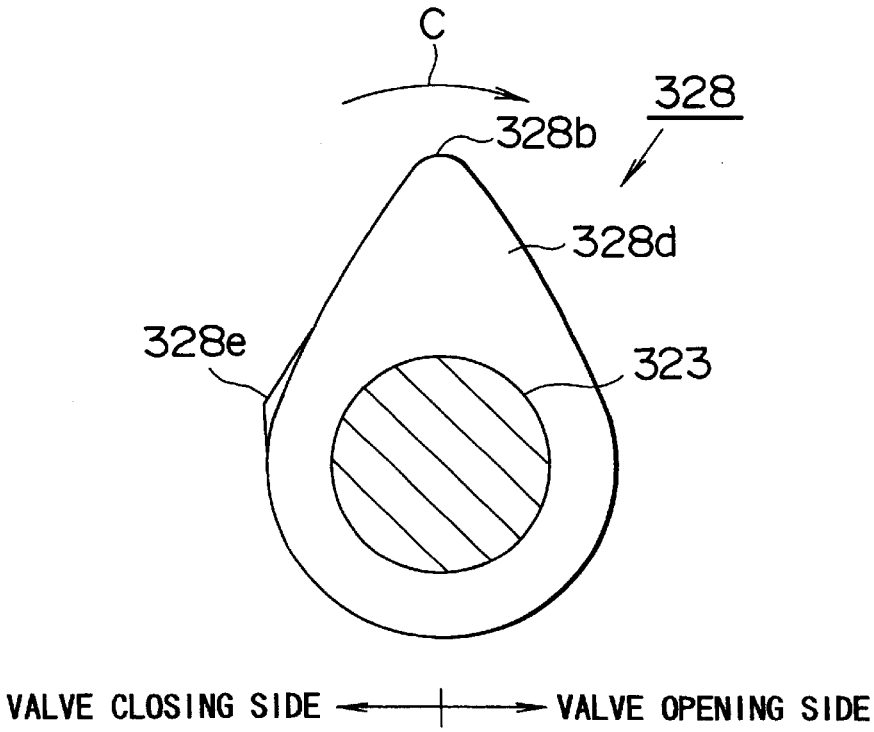
FIG. 37 is a front view of the intake cam according to the third embodiment shown in FIG. 34.
Figure 38:
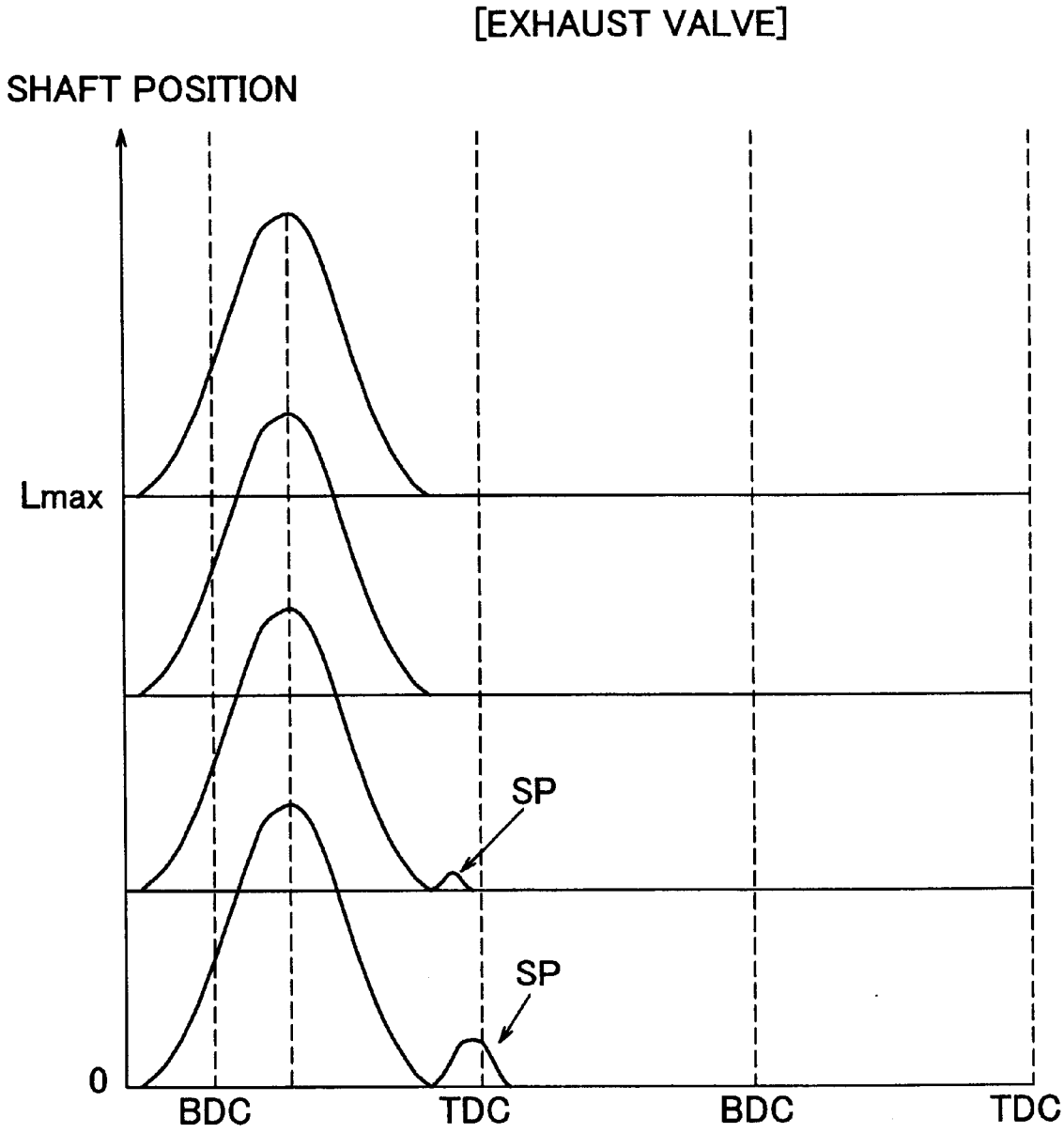
FIG. 38 is a view illustrating the lift patterns of the exhaust valve according to the third embodiment shown in FIG. 34.

The exhaust cam 328 is a three-dimensional cam having a cam profile such as shown in the perspective view of FIG. 36 and the front elevational view of FIG. 37. Although, in the exhaust cam 328, only the main nose 328*b* is secured at the forward end face 328*d* side, the main nose 328*b* and sub-nose 328*e* are provided at the rearward end face 328*c* side. Also, regarding the profile other than the sub-nose 328*e*, the profile at the forward end face 328*d* side is substantially identical to that at the rearward end face 328*c* side. Since such a sub-nose 328*e* is provided in the exhaust cam 328, the valve timing of the exhaust valve 321 is adjusted by the second lift-varying actuator 326 as shown in FIG. 38. That is, although the operation angle and lift are the maximum where the exhaust side camshaft 323 is at the shaft position 0, a sub-peak SP is made smaller in compliance with the increase in the displacement of the exhaust side camshaft 323, and the sub-peak SP will be completely distinguished at the maximum shaft position Lmax.

Figure 39:
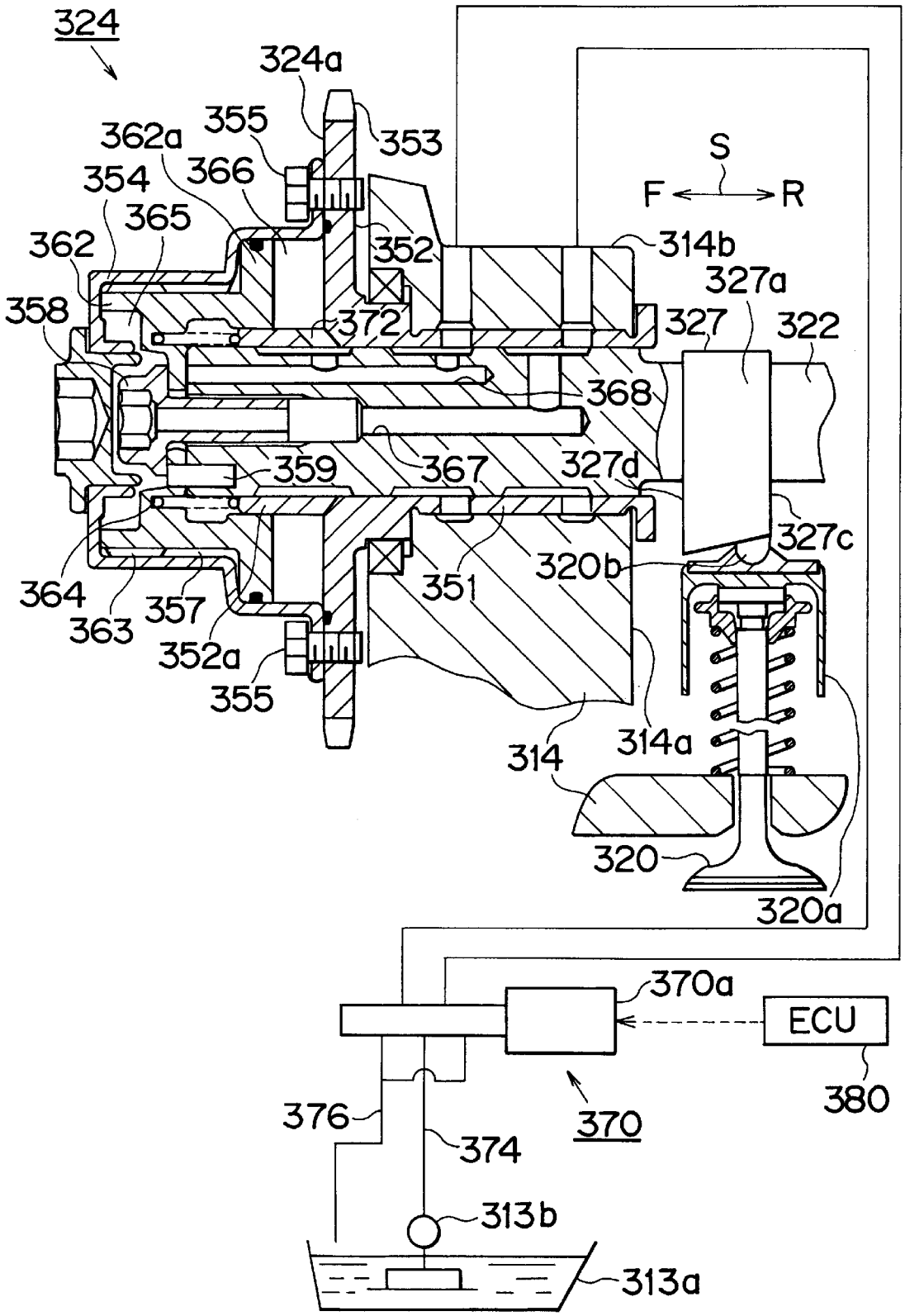
FIG. 39 is a view illustrating the construction of the first lift-varying actuator of the intake side camshaft according to the third embodiment shown in FIG. 34.

Next, with reference to FIG. 39, a detailed description is given of the first lift-varying actuator 324 that adjust the valve characteristics of the intake cam 327 by shifting the intake side camshaft 322 in the direction of the rotation axis.

A timing sprocket 324*a* that constitutes a part of the first lift-varying actuator 324 is composed of a cylindrical part 351 through which the intake side camshaft 322 passes, a disk part 352 protruding from the outer circumference of the cylindrical part 351, and a plurality of outer teeth 353 secured on the outer circumferential surface of the disk part 352. The cylindrical part 351 of the timing sprocket 324*a* is rotatably supported at a journal bearing 314*a* and a camshaft bearing cap 314*b* of the cylinder head 314. The intake side camshaft 322 passes through the cylindrical part 351 so as to be movable in the direction S of the rotation axis and relatively rotatable with respect to the cylindrical part 351.

Further, a cover 354 is secured so as to cover the end portion of the intake side camshaft 322, which is fixed at the timing sprocket 324*a* by a bolt 355. Left-threaded type helical splines 357 that spirally extend in the direction S of the rotation axis of the intake side camshaft 322 are arrayed in a plurality of rows and are provided along the circumferential direction at the position in the inner circumferential surface of the cover 354 corresponding to the end portion of the intake side camshaft 322.

On the other hand, a cylindrically formed ring gear 362 is fixed by a hollow bolt 358 and a pin 359 at the tip end of the intake side camshaft 322. A left-threaded type helical spline 363 that is engaged with the cover 354 side helical spline 357 is provided at the outer circumferential surface of the ring gear 362. Thus, the ring gear 362 is made movable in the direction S of the rotation axis of the intake side camshaft 322 along with the intake side camshaft 322. A compressed spring 364 is disposed between the tip end part of the cylindrical part 352*a* secured at the tip end side of the disk part 352 and the ring gear 362, and the ring gear 362 is pressed in the direction F of the direction S of the rotation axis.

Where the ring gear 362 moves in the direction R of the direction S of the rotation axis due to the ring gear 362 being left-threaded, the intake side camshaft 322 varies the phase difference in rotation to the delay side with respect to the exhaust side camshaft 323 and crankshaft 315 (FIG. 34). Also, where the ring gear 362 moves in the direction F, it varies the phase difference in rotation to the advance side. Thereby, as shown in FIG. 35, it becomes possible to adjust the valve characteristics of the intake valve 320.

In the first lift-varying actuator 324 thus constructed, the crankshaft 315 rotates by the drive of the engine 311, and the rotation is transmitted to the timing sprocket 324*a* via the timing chain 315*a*. The rotation of the timing sprocket 324*a* is transmitted to the intake side camshaft 322 via the engagement part of the cover 354 side helical spline 357 with the ring gear 362 side helical spline 363 in the first lift-varying actuator 324. And, the intake cam 327 rotates in line with the rotation of the intake side camshaft 322, where the intake valve 320 is driven to open and close in line with the profile of the cam surface 327*a* of the intake cam 327.

Next, a description is given of a structure to hydraulically control the movement of the above-described ring gear 362 in the first lift-varying actuator 324.

Since the outer circumferential surface of the disk-shaped ring part 362*a* of the ring gear 362 is closely brought into contact with the inner circumferential surface of the cover 354 so as to slide in the axial direction, the interior of the cover 354 is sectioned by the first lift pattern side oil pressure chamber 365 and the second lift pattern side oil pressure chamber 366. The first lift pattern control oil passage 367 and the second lift pattern control oil passage 368 that are, respectively, connected to the first lift pattern side oil pressure chamber 365 and the second lift pattern side oil pressure chamber 366 are caused to communicate with the interior of the intake side camshaft 322.

The first lift pattern control oil passage 367 communicates with the first lift pattern side oil pressure chamber 365 through the interior of the hollow bolt 358, and at the same time, is connected to the first oil control valve 370 through the interior of the camshaft bearing cap 314*b* and cylinder head 314. Also, the second lift pattern control oil passage 368 communicates with the second lift pattern side oil pressure chamber 366 through an oil passage 372 in the cylindrical part 351 of the timing sprocket 324*a*, and at the same time, is connected to the first oil control valve 370 through the interior of the camshaft bearing cap 314*b* and cylinder head 314.

On the other hand, a supply passage 374 and a discharge passage 376 are connected to the first oil control valve 370. And, the supply passage 374 is connected to the oil pan 313*a* via the oil pump 313*b*, and the discharge passage 376 is directly connected to the oil pan 313*a*.

The first oil control valve 370 is provided with an electromagnetic solenoid 370*a*, and the internal structure thereof is identical to that of the oil control valve referred to in the second embodiment. Therefore, the detailed description thereof is omitted.

In a demagnetized state of the electromagnetic solenoid 370*a*, working oil in the oil pan 313*a* is supplied from the oil pump 313*b* to the second lift pattern side oil pressure chamber 366 of the first lift-varying actuator 324 through the supply passage 374, the first oil control valve 370 and the second lift pattern control oil passage 368, depending on the communication state of the interior ports. Also, the working oil in the first lift pattern side oil pressure chamber 365 of the first lift-varying actuator 324 is discharged into the oil pan 313*a* via the first lift pattern control oil passage 367, the first oil control valve 370, and discharge passage 376. As a result, the ring gear 362 moves to the first lift pattern side oil pressure chamber 365 in the cover 354, causing the intake side camshaft 322 to move in the direction F. Therefore, the contacted position of the cam follower 320*b* with respect to the cam surface 327*a* of the intake cam 327 becomes the end face (hereinafter called a "rearward end face") 327*a* side in the direction R of the intake cam 327 as shown in FIG. 39.

Figure 40:
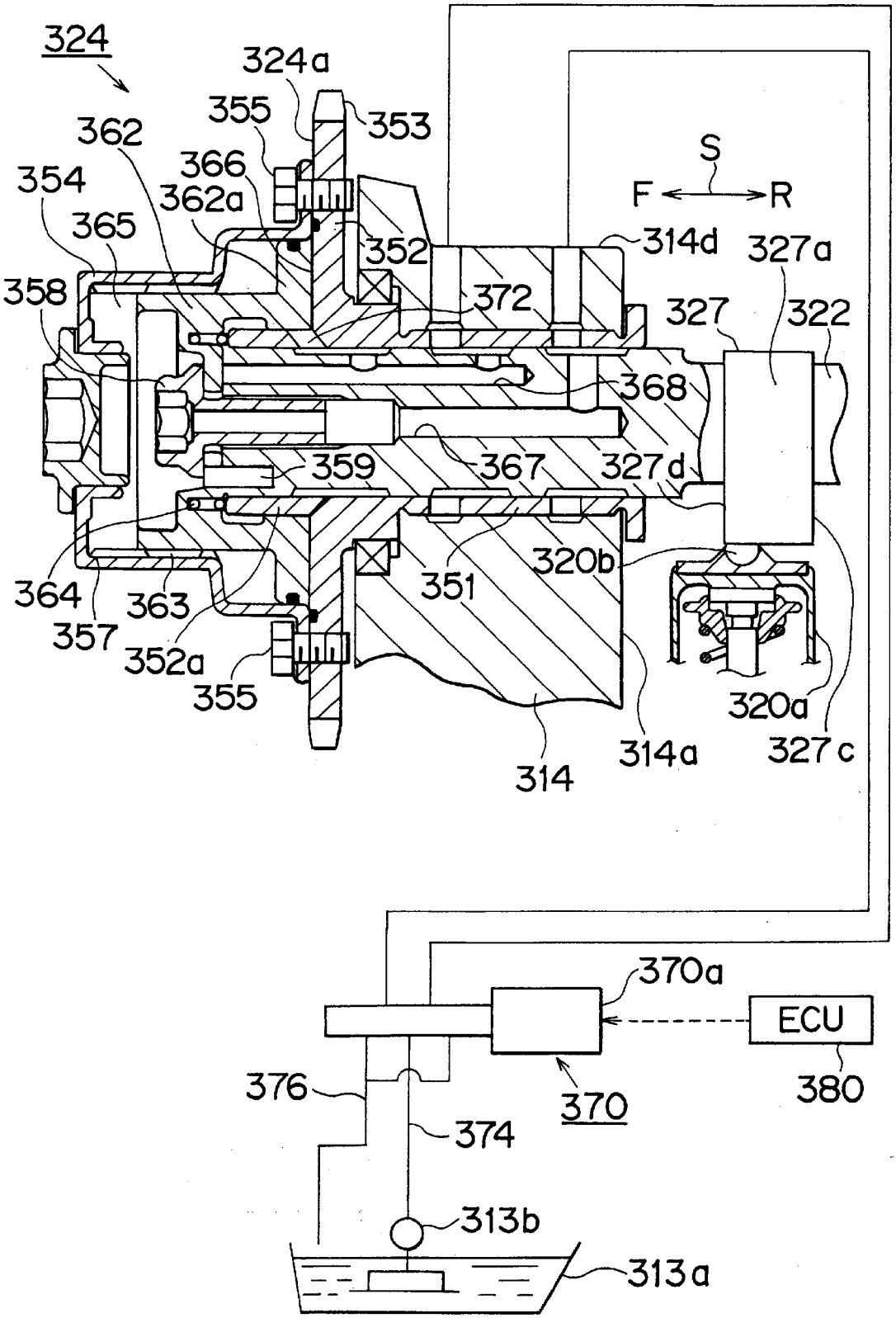
FIG. 40 is a view illustrating operations of the first lift-varying actuator according to the third embodiment shown in FIG. 34.

On the other hand, when the electromagnetic solenoid 370*a* is magnetized, the working oil in the oil pan 313*a* is supplied from the oil pump 313*b* to the first lift pattern side oil pressure chamber 365 of the first lift-varying actuator 324 via the supply passage 374, the first oil control valve 370 and the first lift pattern control oil passage 367, depending on the communication state of ports in the first oil control valve 370. The working oil existing in the second lift pattern side oil pressure chamber 366 is discharged into the oil pan 313*a* via the oil passage 372, the second lift pattern control oil passage 368, the first oil control valve 370, and discharge passage 376. As a result, the ring gear 362 is caused to move toward the second lift pattern side oil pressure chamber 366, and the contacted position of the cam follower 320*b* with respect to the cam surface 327*a* is varied toward the end face (hereinafter called a "forward end face") 327*d* side in the direction F of the intake 327 as shown in FIG. 40.

Further, by controlling the duty of a current supplied to the electromagnetic solenoid 370*a* in a state where sufficient oil pressure is supplied from the oil pump 313*b*, movement of the working oil is prohibited by blocking ports in the first oil control valve 370, wherein supply of the working oil to and discharge thereof from the first lift pattern side oil pressure chamber 365 and the second lift pattern side oil pressure chamber 366 will not be carried out. Therefore, working oil is charged and retained in the first lift pattern side oil pressure chamber 365 and the second lift pattern side oil pressure chamber 366 to cause the ring gear 362 to stop movement in the direction of the rotation axis. As a result, the valve lift of the intake cam 327 is maintained at a fixed level, and a valve timing and a phase difference in rotation of the intake cam 327 with respect to the exhaust side camshaft 323 and crankshaft 315 are maintained at values when the ring gear 362 has stopped.

Figure 41:
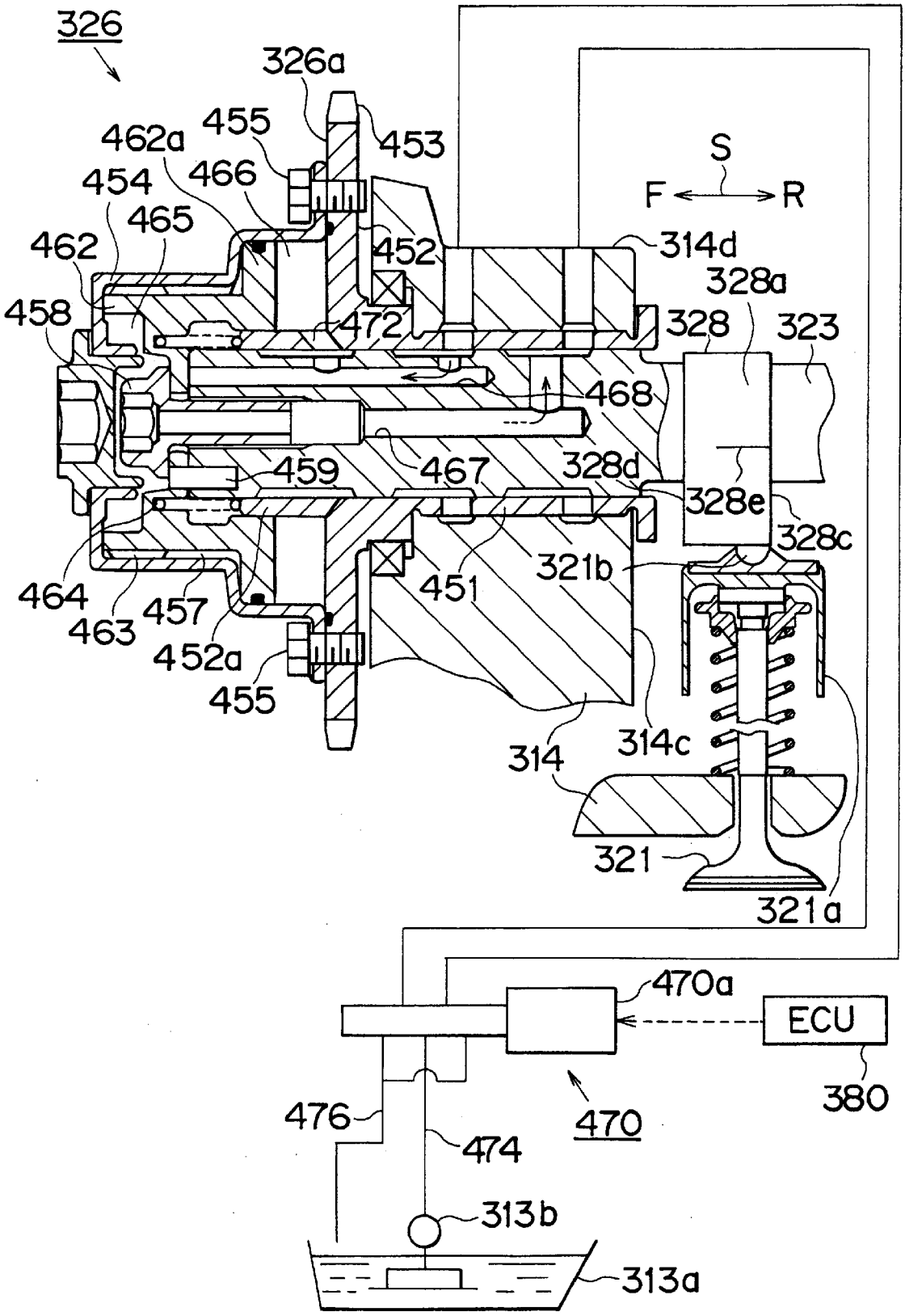
FIG. 41 is a view illustrating the construction of the second lift-varying actuator of the exhaust side camshaft according to the third embodiment shown in FIG. 34.

FIG. 41 shows a construction of the second lift-varying actuator 326 that adjusts the valve characteristics of the exhaust cam 328 by displacing the exhaust side camshaft 323 in the direction of the rotation axis.

The timing sprocket 326*a* that constitutes a part of the second lift-varying actuator 326 includes a cylindrical part 451 through which the exhaust side camshaft 323 passes, a disk part 452 protruding from the outer circumferential surface of the cylindrical part 451, and a plurality of outer teeth 453 secured on the outer circumferential surface of the disk part 452. The cylindrical part 451 of the timing sprocket 326*a* is rotatably supported at the camshaft-bearing cap 314*d* along with the journal bearing 314. And, the exhaust side camshaft 323 passes through the cylindrical part 451 so as to be movable in the direction S of the rotation axis.

Also, a cover 454 is secured in the timing sprocket 326*a* so that it covers the end portion of the exhaust side camshaft 323 and is fixed by bolts 455. Straight splines 457 that linearly extend in the direction of the rotation axis of the exhaust side camshaft 323 are arrayed in a plurality of rows along the same direction and provided at a position corresponding to the end portion of the exhaust side camshaft 323 on the inner circumferential surface of the cover 454.

On the other hand, a cylindrically formed ring gear 462 is fixed at the tip end of the exhaust side camshaft 323 by a hollow bolt 458 and a pin 459. A straight spline 463 that is engaged with the straight spline 457 at the cover 454 side is provided on the outer circumferential surface of the ring gear 462. Thus, the ring gear 462 is made movable in the direction of the rotation axis of the exhaust side camshaft 323 along with the exhaust side camshaft 323. Also, a compressed spring 464 is disposed between the tip end part of the cylindrical part 452*a* secured at the tip end face of the disk part 452 and the ring gear 462, thereby causing the ring gear 462 to be pressed in the direction F in the direction S of the rotation axis.

Thus, the cover 454 and ring gear 462 are coupled to each other by straight splines 457 and 463, whereby even if the ring gear 462 moves in any of the directions R and F in the direction S of the rotation axis, as shown in FIG. 38, the exhaust side camshaft 323 maintains a phase difference in rotation with respect to the intake side camshaft 322 and crankshaft 315 (FIG. 34). However, where the ring gear 462 moves in the direction F of the direction S of the rotation axis, a sub-peak SP is brought about as shown in FIG. 38. Thus, although no phase difference in rotation varies in the exhaust side camshaft 323 in the second lift-varying actuator 326, it differs from the first lift-varying actuator 324 in whether or not the sub-peak SP is produced.

In the second lift-varying actuator 326 thus constructed, the crankshaft 315 rotates by the drive of the engine 311, and the rotation is transmitted to the timing sprocket 326*a* via the timing chain 315*a*. Rotation of the timing sprocket 326*a* is transmitted to the exhaust side camshaft 323 via an engagement part, in which the cover 454 side straight spline 457 is engaged with the ring gear 462 side straight spline 463, in the second lift-varying actuator 326. And, the exhaust cam 328 rotates in line with the rotation of the exhaust side camshaft 323, and the exhaust valve 321 is opened and closed in response to the profile of the cam surface 328*a* of the exhaust cam 328.

Also, the structure to hydraulically control movement of the above-described ring gear 462 in the second lift-varying actuator 326 is substantially identical to that of the first lift-varying actuator 324. That is, since the outer circumferential surface of the disk-shaped ring part 462*a* of the ring gear 462 is brought into close contact with the inner circumferential surface of the cover 454 so as to be movable in the axial direction, the interior of the cover 454 is sectioned by the first lift pattern side oil pressure chamber 465 and the second lift pattern side oil pressure chamber 466. And, the first lift pattern control oil passage 467 and the second lift pattern control oil passage 468 that are, respectively, connected to the first lift pattern side oil pressure chamber 465 and the second lift pattern side oil pressure chamber 466 communicates with the interior of the exhaust side camshaft 323 in the interior of the exhaust side camshaft 323.

The first lift pattern control oil passage 467 passes through the hollow bolt 458 and communicates with the first lift pattern side oil pressure chamber 465, and at the same time, passes through the camshaft bearing cap 314*d* and cylinder head 314 and communicates with the second oil control valve 470. Furthermore, the second lift pattern control oil passage 468 communicates with the second lift pattern side oil pressure chamber 466, passing through the oil passage 472 in the cylindrical part 451 of the timing sprocket 326*a*, and at the same time, connects with the second oil control valve 470, passing through the camshaft bearing cap 314*d* and cylinder head 314.

On the other hand, as a supply passage 474 and an exhaust passage 476 are connected to the second oil control valve 470, the supply passage 474 is connected to the oil pan 313*a* via the oil pump 313*b* connected to the first oil control valve 370 while the exhaust passage 476 is directly connected to the oil pan 313*a*.

The second oil control valve 470 is provided with an electromagnetic solenoid 470*a*. The interior structure thereof is identical to that of the oil control valve referred to in the second embodiment. Therefore, detailed description thereof is omitted.

In a demagnetized state of the electromagnetic solenoid 470*a*, working oil in the oil pan 313*a* is supplied from the oil pump 313*b* to the second lift pattern side oil pressure chamber 466 of the second lift-varying actuator 326 via the supply passage 474, the second oil control valve 470, the second lift pattern control oil passage 468 and oil passage 472 on the basis of communication states of the interior ports. Also, working oil existing in the first lift pattern side oil pressure chamber 465 of the second lift-varying actuator 326 is discharged into the oil pan 313*a* via the first lift pattern control oil passage 467, the second oil control valve 470 and the exhaust passage 476. As a result, the ring gear 462 moves to the first lift pattern side oil pressure chamber 456 in the cover 454, and the exhaust side camshaft 323 is caused to move in the direction F. Accordingly, the contacted position of the cam follower 321*b* with respect to the cam surface 328*a* of the exhaust cam 328 is made into the end face (hereinafter called a "rearward end face") 328*c* side of the direction R of the exhaust cam 328 shown in FIG. 41.

Figure 42:
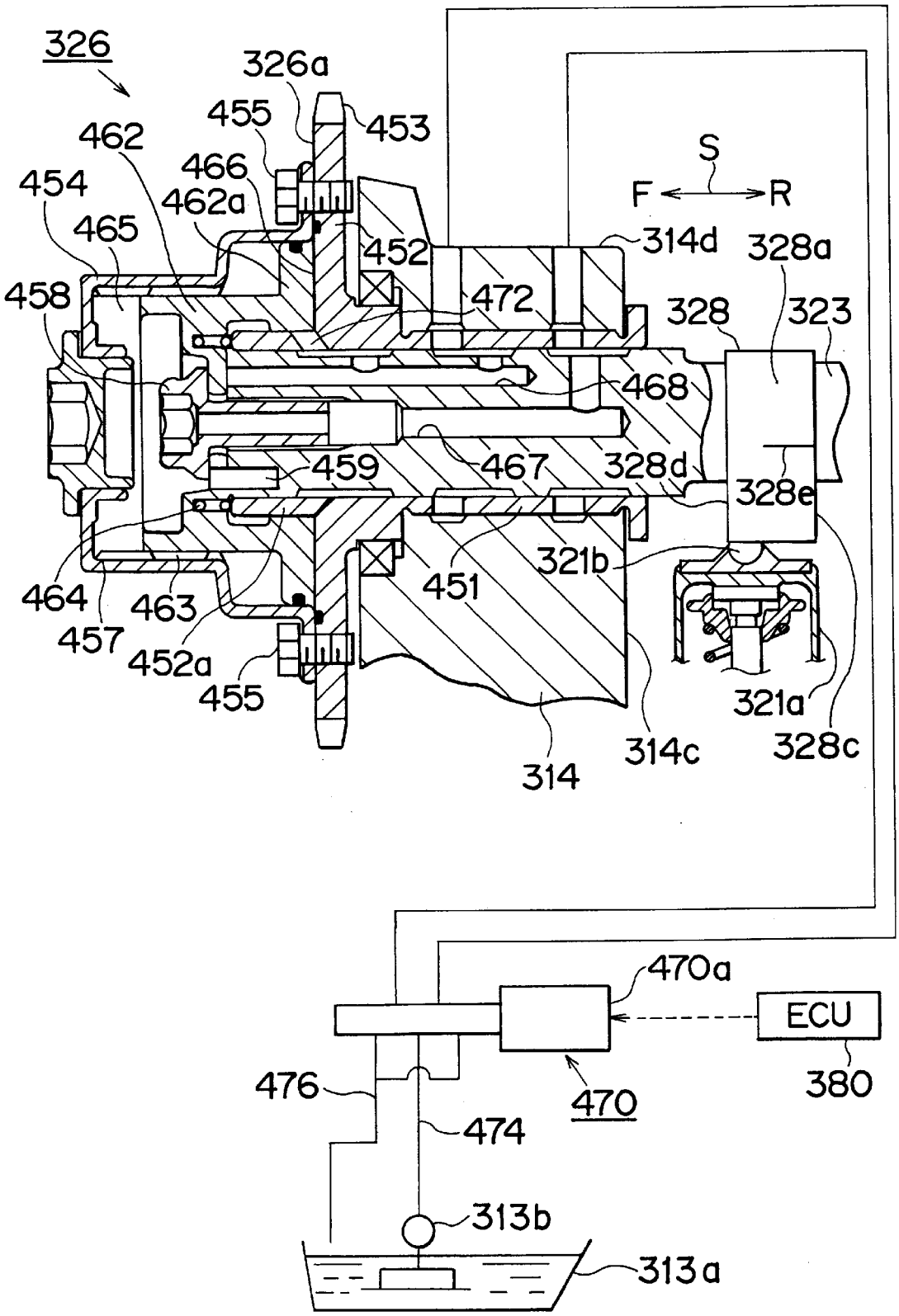
FIG. 42 is a view illustrating operations of the second lift-varying actuator according to the third embodiment shown in FIG. 34.

On the other hand, when the electromagnetic solenoid 470*a* is excited, working oil in the oil pan 313*a* is supplied from the oil pump 313*b* to the first lift pattern side oil pressure chamber 465 of the second lift-varying actuator 326 via the supply passage 474, the second oil control valve 470, and the first lift pattern control passage 467. Working oil existing in the second lift pattern side oil pressure chamber 466 is discharged into the oil pan 313*a* via the oil passage 472, the second lift pattern control oil passage 468, the second oil control valve 470 and the discharge passage 476. As a result, the ring gear 462 moves to the second lift pattern side oil pressure chamber 466, and the contacted position of the cam follower 321*b* with respect to the cam surface 328*a* changes to the end face (hereinafter called a "forward end face") 328*d* side in the direction F of the exhaust cam 328 as shown in FIG. 42.

Further, by controlling the duty of a current supplied to the electromagnetic solenoid valve 470*a* in a state where oil pressure is sufficiently supplied from the oil pump 313*b*, ports in the second oil control valve 470 are blocked to prohibit movement of the working oil. In such a case, supply of the working oil to and discharge thereof from the first lift pattern side oil pressure chamber 465 and the second lift pattern side oil pressure chamber 466 will not be carried out. Accordingly, working oil is charged and retained in the first lift pattern side oil pressure chamber 465 and the second lift pattern side oil pressure chamber 466, whereby the movement of the ring gear 462 in the direction of the rotation axis is stopped. Accordingly, the lift pattern of the exhaust valve 321 is retained at the pattern that appeared when the ring gear 462 is stopped.

The ECU 380 (FIG. 34) that controls the first oil control valve 370 and the second oil control valve 470 is composed of electronic circuits in which logical circuits are mainly employed. The ECU 380 detects various types of data including the running statuses of the engine 311 on the basis of an airflow meter 380*a* that detects the air intake amount GA into the engine 311, a RPM sensor 380*b* that detects the number NE of times of revolutions per minute of the engine based on rotation of the crankshaft 315, a coolant temperature sensor 380*c* that is secured in the cylinder block and detects the coolant temperature THW of the engine 311, a throttle opening degree sensor 380*d* that detects the open degree of a throttle valve (not illustrated), a vehicle velocity sensor 380*e* that detects the running velocity of a vehicle in which the engine 311 is incorporated, a starter switch 380*f*, an accelerator opening degree sensor 380*g* that detects the degree of opening of the accelerator and the entirely closed state thereof, and various other types of sensors.

Further, the ECU 380 detects the shaft position of the intake side camshaft 322 in the direction S of the rotation axis from the first shaft position sensor 380*h*, and detects the shaft position of the exhaust side camshaft 323 in the direction S of the rotation axis from the second shaft position sensor 380*i*.

Accordingly, the ECU 380 adjusts the moving position of the intake side camshaft 322 and exhaust side camshaft 323 in the direction S of the rotation axis by outputting a control signal to the first oil control valve 370 and the second oil control valve 470. Thereby, the valve timing and valve overlap of the intake cam 327 are adjusted by feedback control.

Figure 43:
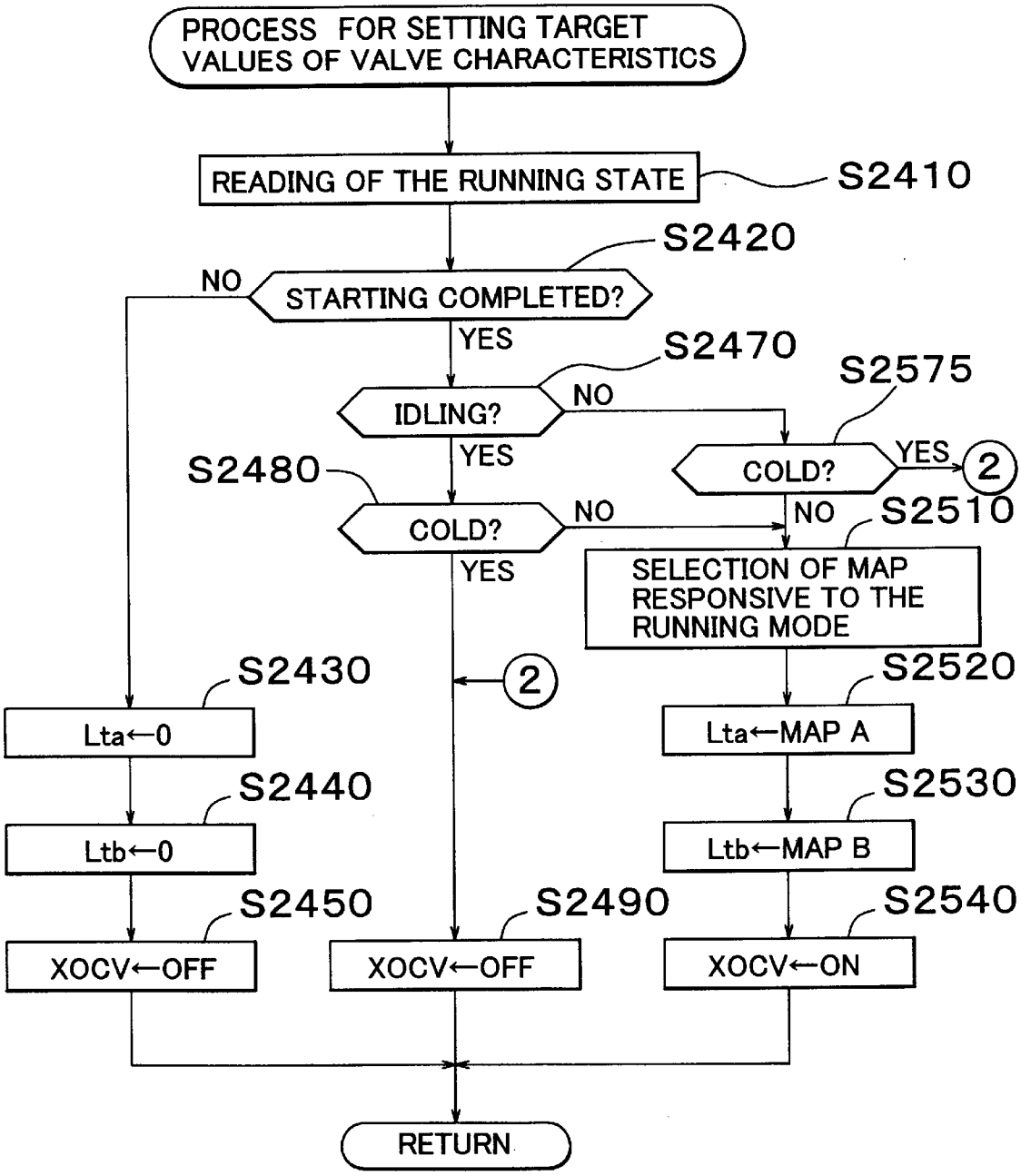
FIG. 43 is a flow chart of a process for setting target values of the valve characteristics according to the third embodiment shown in FIG. 34.
Figure 44:
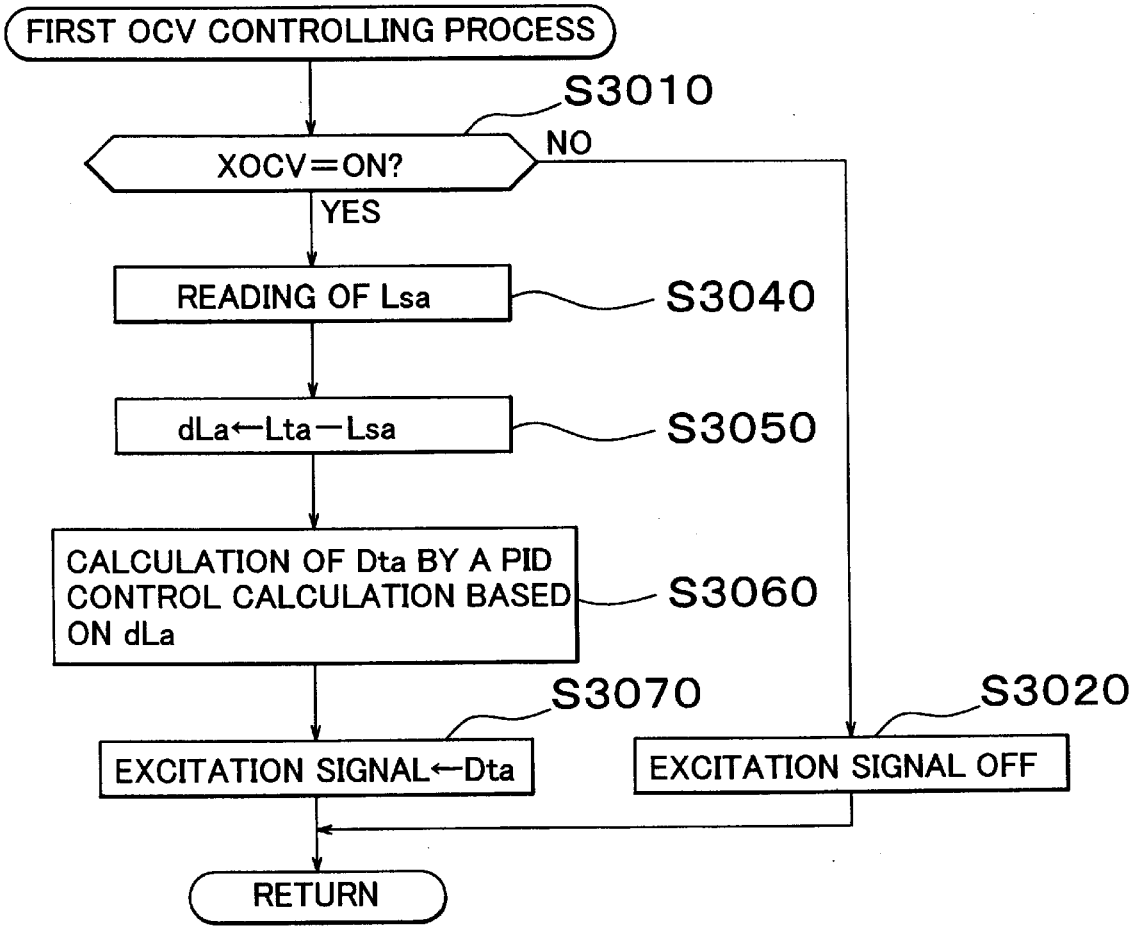
FIG. 44 is a flow chart of a process for controlling the first oil control valve (OCV) according to the third embodiment shown in FIG. 34.
Figure 45:
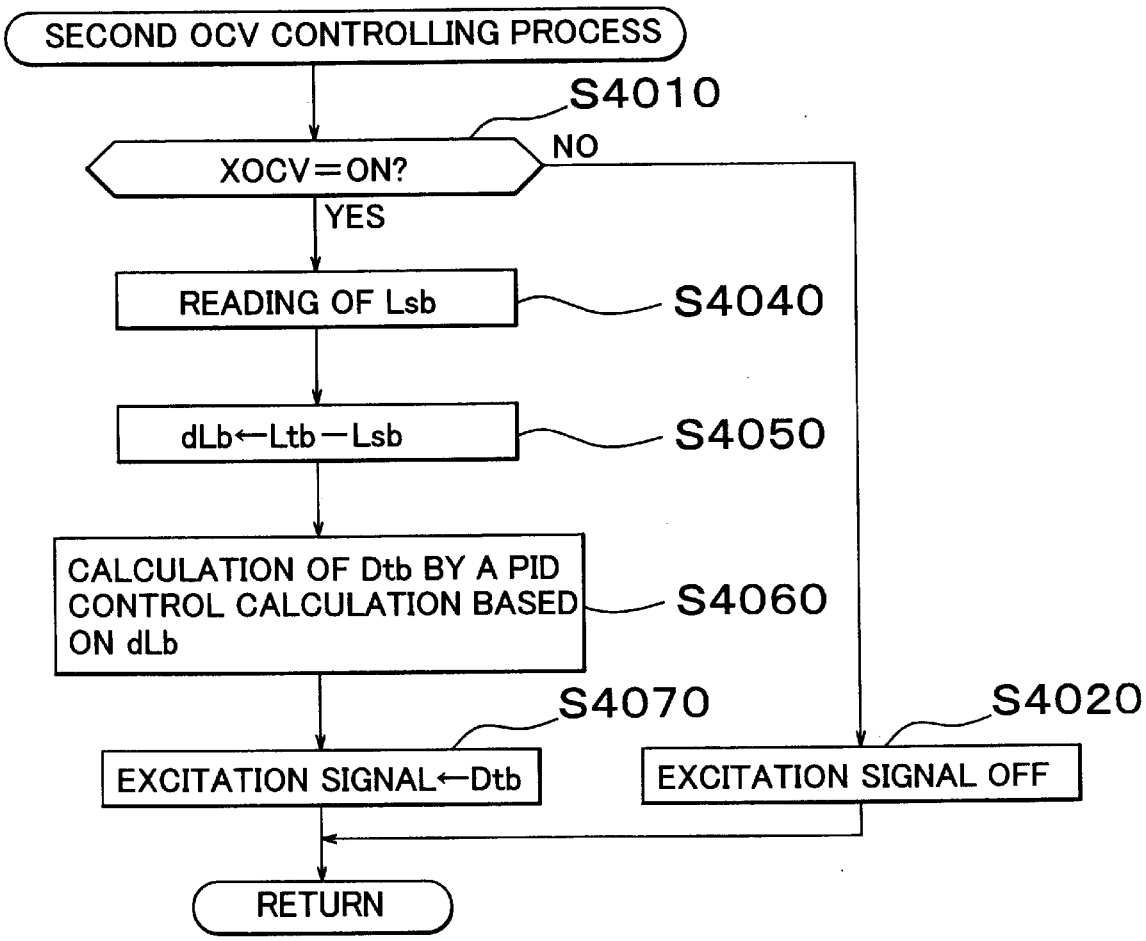
FIG. 45 is a flow chart of a process for controlling the second oil control valve (OCV) according to the third embodiment shown in FIG. 34.

One example of a process for setting target values of valve characteristics, which is carried out by the feedback control, is shown in FIG. 43, and one example of a control process with respect to the first oil control valve 370 and the second oil control valve 470 is shown in the flow charts in FIG. 44 and FIG. 45. These processes are cyclically repeated after turning the ignition switch on.

As the process for setting target values of valve characteristics (FIG. 43) is commenced, first, the running state of the engine 311 is read by the airflow meter 380*a*, PRM sensor 380*b*, coolant temperature sensor 380*c*, throttle opening degree sensor 380*d*, vehicle velocity sensor 380*e*, starter switch 380*f*, accelerator opening degree sensor 380*g*, the first shaft position sensor 380*h*, the second shaft position sensor 380*i* and various other types of sensors, etc. (S2410). Accordingly, the status of the starter switch, air intake amount GA, number NE of revolutions of the engine, coolant temperature THW, throttle opening degree TA, vehicle velocity Vt, accelerator opening degree/entire close signal, accelerator opening degree ACCP, shaft position Lsa of the intake side camshaft 322, shaft position Lsb of the exhaust side camshaft 323, etc., are read in the working area of a RAM existing in the ECU 380.

Next, it is determined (S2420) whether or not the starting of the engine is completed. In a case where the number of NE of revolutions of the engine is lower than the reference number of revolutions to determine the engine drive, or where the starter switch is turned [ON], the engine is before start or during starting, wherein it is determined that the starting is not completed ([NO] in S2420]), and [0] is established for the target shaft position Lta of the intake side camshaft 322 (S2430). Furthermore, [0] is established for the target shaft position Ltb of the exhaust side camshaft 323 (S2440). Then [OFF] is established for the OCV drive flag XOCV (S2450). Then, the process is terminated once.

At this time, in the first OCV controlling process (FIG. 44) corresponding to the intake side camshaft 322, first, it is determined whether or not the OCV drive flag XOCV is [ON] (S3010). Since XOCV=[OFF] is established in the process for setting target values of the valve characteristics (FIG. 43)([NO] in S3010), an excitation signal corresponding to the electromagnetic solenoid 370*a* of the first oil control valve 370 is [OFF], that is, the electromagnetic solenoid 370*a* is maintained in a non-magnetized state (S3020). The process is then terminated.

In addition, first, in the second OCV controlling process (FIG. 45) corresponding to the exhaust side camshaft 323, it is determined (S4010) whether or not the OCV drive flag XOCV is [ON]. Since XOCV=[OFF] is established in the process (FIG. 43) for setting target values of valve characteristics ([NO] in S4010), an excitation signal corresponding to the electromagnetic solenoid 470*a* of the second oil control valve 470 is [OFF], that is, the electromagnetic solenoid 470*a* is maintained in a non-magnetized state (S4020). The process is then terminated.

Before starting is completed as in the above, both the first oil control valve 370 and the second oil control valve 470 do not operate at all, wherein the first lift-varying actuator 324 and the second lift-varying actuator 326 are not driven.

When the engine 311 stops, the intake side camshaft 322 is at the shaft position Lsa=0 (state in FIG. 39) by a pressing force of the spring 364 secured at the first lift-varying actuator 324 and a thrust force received from the cam follower 320*b* in line with a tapered cam surface 327*a* of the intake cam 327. In addition, the exhaust side camshaft 323 is held at the shaft position Lsb=0 (state in FIG. 41) by a pressing force of a spring 464 secured at the second lift-varying actuator 326.

Figure 47:
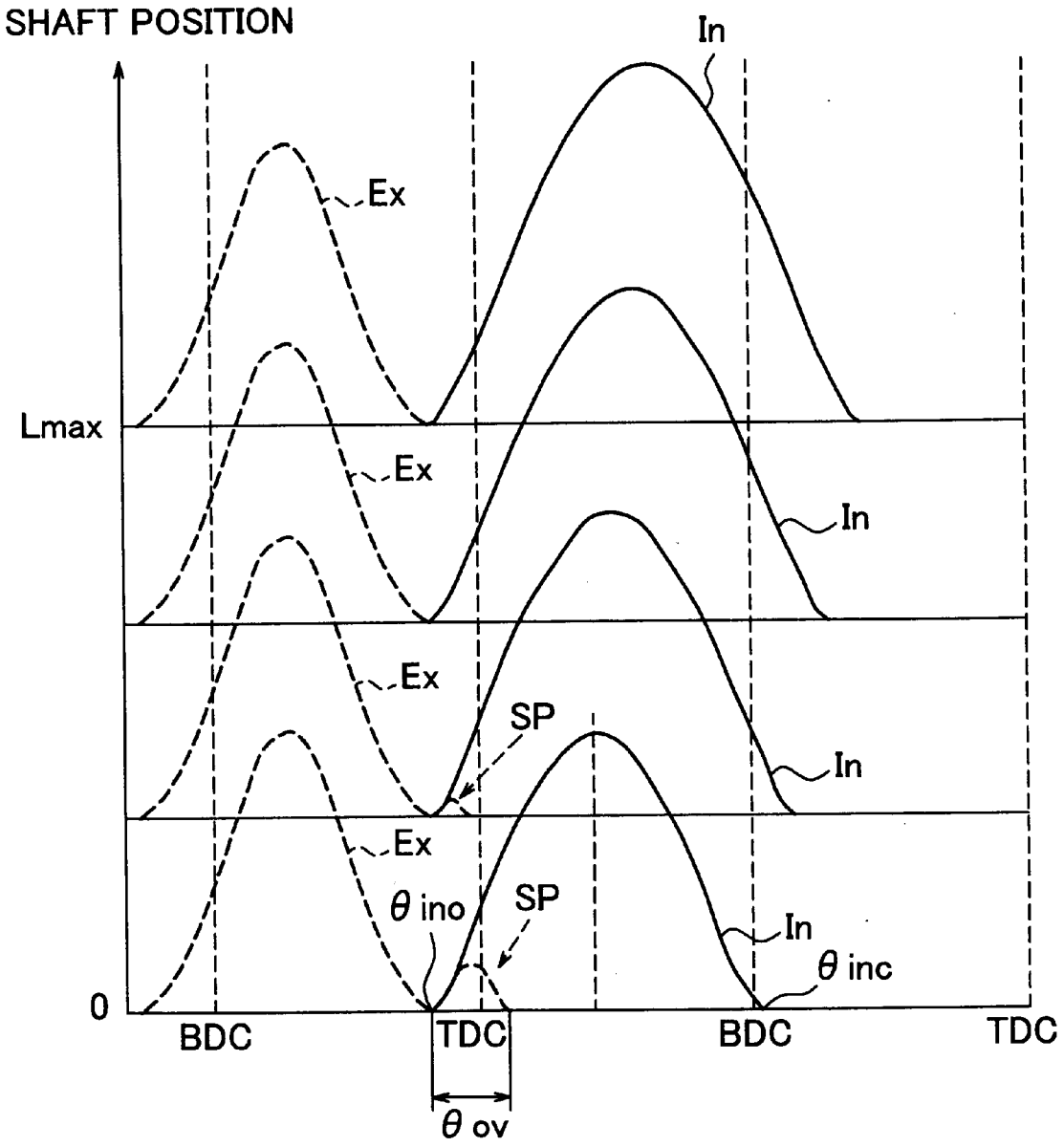
FIG. 47 is a view illustrating the lift patterns of the exhaust valve and intake valve according to the third embodiment shown in FIG. 34.

Therefore, when the engine is started, as the crankshaft 315 is turned by the starter in order to start the engine 311, a sub-peak is caused to appear in the lift pattern Ex of the exhaust valve 321 with the maximum operation angle and maximum lift as shown at the shaft position (Ls=0) in FIG. 47. The sub-peak SP achieves the maximum valve overlap θov. On the other hand, although the open timing θino is not changed since the lift pattern In of the intake valve 320 is of the minimum operating angle, the close timing θinc is most advanced, wherein the intake valve 320 is closed earlier.

Therefore, when starting the engine, since there is no case where the close timing of the intake valve 320 is adjusted to the delay side, it is possible to prevent a mixture, which is sucked in the combustion chamber once, from returning to the intake tube. Also, since the sub-peak SP at the exhaust valve 321 side is adequately established and the valve overlap θov is not excessive, the blow-back of exhaust will not become excessive. Therefore, the ability to start the engine is made favorable.

The aforementioned processes (Steps S2410 through S2450, Steps S3010, S3020, and Steps S4010 and S4020) are repeated during the cranking, whereby as the engine 311 is driven ([YES] in S2420), it is determined (S2470) whether or not the engine is idling. Herein, for example, the idling determination described in Step S1460 of the second embodiment is carried out.

If idling ([YES] in S2470), next, it is determined (S2480) whether or not the engine is cold. For example, if the coolant temperature THW is 78° C. or less, it is determined that the engine is still cold. If cold ([YES] in S2480), that is, herein, if the engine is in a cold idling state since the engine is also idling, next, [OFF] is established in the OCV drive flag XOCV (S2490), then, the process is terminated once.

Accordingly, since the OCV drive flag XOCV is [OFF] in the first OCV controlling process (FIG. 44) ([NO] in Step 3010), the electromagnetic solenoid 370*a* of the first oil control valve 370 is maintained in a non-magnetized state (S3020), and the process is terminated once.

Further, it is determined in the second OCV controlling process (FIG. 45) that the OCV drive flag XOCV is [OFF], and the electromagnetic solenoid 470*a* of the second oil control valve 470 is maintained in a non-magnetized state (S4020). The process is then terminated.

In a cold idling state, even if the oil pressure is gradually raised, the intake valve 320 and exhaust valve 321 are maintained in a valve timing state when the engine is started. Therefore, as shown at the shaft position =0 in FIG. 47, the maximum valve overlap θov is maintained, and the close timing θino of the intake valve 320 is maintained in the most advanced state.

Thus, in the case of a cold idling state, even if the engine 311 is driven, the valve timing of the intake valve 320 is maintained in the cold idling timing. Therefore, carburetion of fuel in the combustion chamber and intake ports can be promoted with an adequate valve overlap θov and adequate blow-back of exhaust.

Figure 46A:
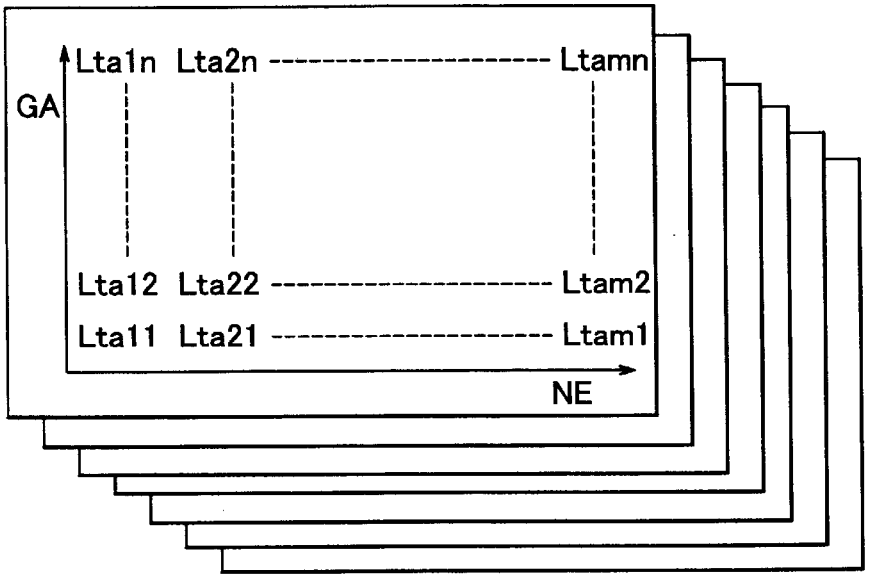
FIG. 46 is a view each illustrating a map construction of target shaft positions Lta and Ltb used in a process for setting target values of the valve characteristics according to the third embodiment shown in FIG. 34.
Figure 46B:
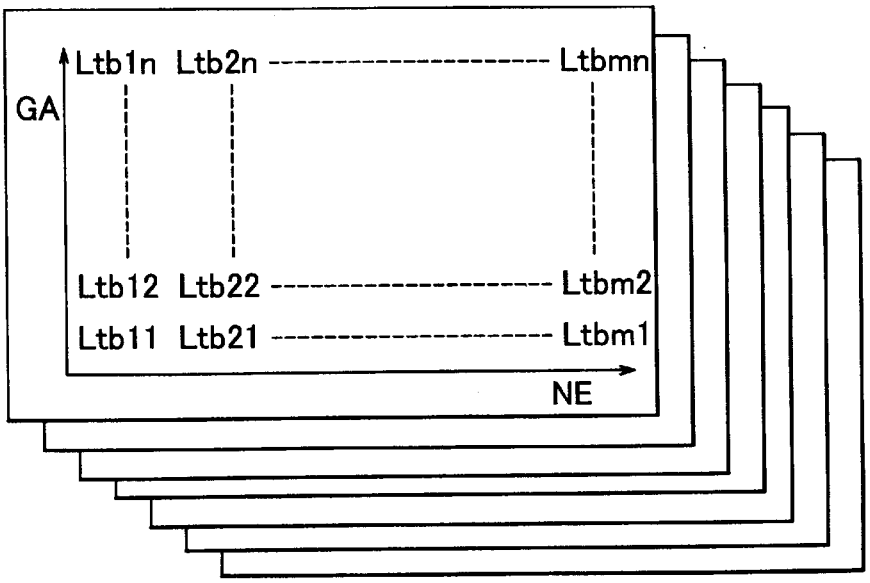

Thus, after such a cold idling state is continued for a while, as it is determined ([NO] in S2480) that the engine temperature is raised and is not in a cold state but is hot, a map responsive to the running mode of the engine 311 is selected next (S2510). The ROM of the ECU 380 is provided, as shown in FIG. 46, with a group "A" of target shaft positions for the first lift-varying actuator 324 and a group "B" of target shaft positions for the second lift-varying actuator 326, which are established for each of the running modes such as idling run, stoichimetric combustion run, and lean combustion run, etc., when the engine is hot. In Step S2510, a map "A" and a map "B" each corresponding to the running mode are selected from these groups of maps. The maps "A" and "B" are the maps experimentally established in order to obtain favorable target shaft positions Lta and Ltb, using the engine load (herein, air intake amount GA) and number NE of revolutions of the engine as parameters.

After the maps "A" and "B" corresponding to the running mode are selected in Step S2510, next, the target shaft position Lta to control the first oil control valve 370 is calculated (Step S2520) from the number NE of revolutions of the engine and air intake amount GA on the basis of the selected map "A". In addition, the target shaft position Ltb to control the second oil control valve 470 is calculated (S2530) from the number NE of revolutions of the engine and air intake amount GA on the basis of the selected map "B".

Then [ON] is established for the OCV drive flag XOCV (S2540) and the process is terminated.

Also, in a state where the engine is not idling ([NO] in S2470), it is determined (S2575) whether or not the engine is in a cold state, wherein, if not cold ([NO] in S2575), a series of processes in steps S2510 through S2540 are carried out. Also, where the engine is in a cold state ([YES] in S2575), a process in Step S2490 is carried out.

In addition, the map "A" shown in FIG. 46 is to establish a valve overlap in response to the running state of the engine 311 in the third embodiment. It is constructed as in the description with reference to FIG. 12 in the aforementioned first embodiment. Also, the map "B" is to establish the close timing of the intake valve 320 in response to the running state of the engine 311 in the third embodiment. For example, it is devised that the blow-back is suppressed by advancing the close timing of the intake valve 320 when the engine is in a hot idling state, whereby the combustion is stabilized and the engine revolution is also stabilized, and in a high load and high speed revolution zone, the close timing is delayed in response to the number NE of revolutions of the engine, whereby a high cubic efficiency can be obtained.

At this time, first, in the first OCV control process (FIG. 44), it is determined that the OCV drive flag XOCV is [ON] ([YES] in S3010). Therefore, the actual shaft position Lsa of the intake side camshaft 322, which is calculated by the detected value of the first shaft position sensor 380*h*, is read (S3040). A deviation dLa between the target shaft position Lta of the intake side camshaft 322, which is established in Step S2520 in the process for setting target values of valve characteristics (FIG. 43), and the actual shaft position Lsa is calculated as shown in the following expression (4) (S3050).

$$dLa \leftarrow Lta - Lsa \quad (4)$$

By a PID control calculation based on the deviation dLa, the duty Dta for control with respect to the electromagnetic solenoid 370*a* of the first oil control valve 370 is calculated (S3060), and an excitation signal with respect to the electromagnetic solenoid 370*a* of the first oil control valve 370 is established on the duty Dta (S3070). The process is then terminated.

Also, in the second OCV controlling process (FIG. 45), first, it is determined that the OCV drive flag XOCV is [ON] ([YES] in S4010). Therefore, the actual shaft position Lsb of the exhaust side camshaft 323, which is calculated from the detected value of the second shaft position sensor 3801 is read (S4040). A deviation dLa between the target shaft position Ltb of the exhaust side camshaft 323, which is established in Step S2530 of the process for setting target values of valve characteristics (FIG. 43), and the actual shaft position Lsb is calculated by the following expression (5) (S4050).

$$dLb \leftarrow Ltb - Lsb \quad (5)$$

And, by a PID control calculation based on the deviation dLb, the duty Dtb for control with respect to the electromagnetic solenoid 470*a* of the second oil control valve 470 is calculated (S4060), and an excitation signal with respect to the electromagnetic solenoid 470*a* of the second oil control valve 470 is established on the basis of the duty Dtb (S4070). Thus, the process is terminated once.

Since the first oil control valve 370 is thus controlled by the duty Dtb for control and the first lift-varying actuator 324 is driven and started, the displacement of the intake side camshaft 322 in the direction S of the rotation axis is adjusted so that an adequate intake valve timing can be obtained in response to the running state of the engine 311. Since the second oil control valve 470 is controlled by the duty Dtb for control and the second lift-varying actuator 326 is driven and started, the displacement of the exhaust side camshaft 323 in the direction S of the rotation axis is adjusted so that an adequate exhaust valve timing can be obtained in response to the running state of the engine 311.

Furthermore, where the engine 311 is stopped, the intake side camshaft 322 is, as described above, returned to the shaft position Lsa=0 (a state shown in FIG. 39) by a pressing force of the spring 364 secured in the first lift-varying actuator 324 and a thrust force received from the cam follower 364 in line with the tapered cam surface 327*a* of the intake cam 327. Also, the exhaust side camshaft 323 is returned to the shaft position Lsb=0 (a state shown in FIG. 41) by a pressing force of the spring 464 secured in the second lift varying actuator 326.

In the third embodiment described above, the second lift-varying actuator 326 corresponds to the rotation axis direction shifter, the spring 464 secured in the second lift-varying actuator 326 corresponds to a non-drive valve overlap setter, and various types of sensors 380*a* through 380*g* correspond to the running state detector. Further, the process for setting target values of valve characteristics in FIG. 43 corresponds to a valve overlap controller.

Further, in the process for setting target values of valve characteristics in FIG. 43, three determination processes (S2470, S2480 and S2575) are employed to explain to clearly show the process in a cold idling. However, these three processes may be carried out by a single process to determine whether or not the engine is cold. That is, when cold, the process in S2490 is performed, and when not cold, the processes of Steps S2510 through S2540 are carried out.

According to the third embodiment described above, the following characteristics are provided.

(i). By continuing a non-driven state of the second lift-varying actuator 326 when cold even if the engine is idling, the sub-peak SP at the exhaust valve 321 side is maintained, and a valve overlap is permitted to exist. Therefore, in cold idling, carburetion of fuel in the combustion chamber and intake ports can be promoted by blow-back of exhaust from the exhaust ports and combustion chamber. Therefore, even though fuel that is injected through a fuel injection valve adheres to an intake port and the inner surface of the combustion chamber when the engine is still cold, it may be quickly carbureted. Therefore, a mixture will have a sufficient air-fuel ratio without depending on an increase in fuel, combustion will be stabilized still further than in a case of not increasing the valve overlap, and it is possible to prevent cold hesitation from occurring, wherein the drivability may be maintained comparatively favorabe. Furthermore, fuel efficiency and emission can be prevented from worsening since an increase in fuel does not result.

Since the valve overlap is reduced when hot idling, taking into consideration combustion stability when idling, an attempt can be made to sufficiently stabilize the combustion by reducing the gas amount remaining in the combustion chamber.

(ii). In particular, by the sub-nose 328*e* of the exhaust cam 328 and spring 464 of the second lift-varying actuator 326, the maximum sub-speak SP is produced in the lift pattern of the exhaust valve 321 where the second lift-varying actuator 326 is in a non-driven state. Thereby, the cold valve overlap θov can be achieved. Therefore, even in a case where the second lift-varying actuator cannot be driven due to an insufficient output of oil pressure in a cold state immediately after the engine 311 is started, the state of the second lift-varying actuator 326, in which the cold valve overlap is made into θov when the engine 311 stops or just starts, is maintained, whereby the cold valve overlap θov can be achieved. And, since the second lift-varying actuator 326 can be driven after the engine is warmed up, a required valve overlap can be brought about. For example, any valve overlap can be eliminated.

With such a simple construction, the characteristics provided in (i) can be produced.

(iii). Since in the intake valve 320 the intake cam 327 is a three-dimensional cam, a thrust force is produced in the intake side camshaft 322 by pressure produced from the valve lifter 320*a* of the intake valve 320 when the first lift-varying actuator 324 is not driven. Still further, the position of the intake side camshaft 322 in the direction S of the rotation axis is set so as to be stabilized at the position, where the minimum lift amount can be obtained, by a spring 364 of the first lift-varying actuator 324. In addition, in movement of the intake side camshaft 322 in the direction S of the rotation axis, the intake valve timing will be most advanced in the minimum lift position by engagement of the helical spline 357 at the cover 354 side and helical spline 363 at the ring gear 362 side.

Therefore, when the engine is just started or is in cold idling, the close timing of the intake valve 320 can be automatically quickened in advance, wherein it is possible to prevent intake from flowing in reverse when the engine is just started or in cold idling, and combustion can be stabilized.

In the illustrated embodiment, the controller (80, 238, 380) is implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hard-wired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. An apparatus for controlling a valve timing of an internal combustion engine, comprising:

a variable valve overlap mechanism that adjusts at least one of a valve opening time of an intake valve and a valve closing time of an exhaust valve in order to vary an overlap period during which the intake valve and the exhaust valve are both open, wherein, when the variable valve overlap mechanism is not driven, the variable valve overlap mechanism produces a cold overlap period.

2. The apparatus according to claim 1, wherein the variable valve overlap mechanism comprises:

a pair of cams, including at least one of an intake cam and an exhaust cam, having profiles differing from each other in a direction of a rotation axis;

a rotation axis direction actuator that varies a valve timing of at least one of the intake valve opening time and the exhaust valve closing time by consecutively adjusting a valve lift by adjusting a position in the direction of the rotation axis with respect to the cams; and a non-drive valve overlap actuator that sets the position of the cams in the direction of the rotation axis to a position corresponding to a cold valve timing position at which the cold overlap period is produced when the variable valve overlap mechanism is not driven.

3. The apparatus according to claim 2, wherein the profiles of the cams are formed so that an amount of valve lift consecutively changes in the direction of the rotation axis, and the cold valve timing position is defined at a position in the direction of the rotation axis when the amount of valve lift is a minimum.

4. The apparatus according to claim 3, wherein the non-drive valve overlap actuator is a rotation axis presser, wherein the minimum value lift position of at least one of the profiles is defined as a stabilized stop position when the cams are not driven.

5. The apparatus according to claim 1, wherein the variable valve overlap mechanism comprises:

a pair of cams, including at least one of an intake cam and an exhaust cam having an amount of a valve lift consecutively changing in a direction of a rotation axis;

a rotation axis direction actuator that varies a valve timing of at least one of the intake valve opening time and the exhaust valve closing time by consecutively adjusting a valve lift by adjusting a position of the cams in the direction of the rotation axis;

a rotation phase difference actuator that varies a phase difference in rotation between the intake cam and the exhaust cam; and a coupler that:

couples the rotation axis direction actuator with the rotation phase difference actuator, by varying the phase difference in rotation between the intake cam and the exhaust cam in synchronization with a positional adjustment of the cams by the rotation axis direction actuator in the direction of the rotation axis; and produces the cold overlap period when the cams move to the position in the direction of the rotation axis in which the amount of the valve lift is a minimum when the variable valve overlap mechanism is not driven.

6. The apparatus according to claim 5, wherein the coupler is a helical spline mechanism that couples the rotation axis direction actuator with the rotation phase difference actuator, so that a phase difference in rotation between the intake cam and the exhaust cam changes in a direction along which valve overlap becomes smaller, in response to an increase in the amount of the valve lift by the positional adjustment of the cam by said rotation axis direction actuator.

7. The apparatus according to claim 1, further comprising:

at least one running status detector that detects a running status of the internal combustion engine, and a valve overlap controller that:

maintains the cold overlap period produced by the variable valve overlap mechanism in a non-driven state before running of the internal combustion engine when the running status detected by the at least one running status detector defines a cold idling state;

decreases the valve overlap from the cold overlap period by driving the variable valve overlap mechanism when the running status of the internal combustion engine detected by the running status detector defines a hot idling state; and increases the valve overlap from the valve overlap in the hot idling state by driving the variable valve overlap mechanism when the running status detected defines a hot non-idling state.

8. The apparatus according to claim 1, further comprising:

at least one running status detector that detects a running status of the internal combustion engine; and a valve overlap controller that:

maintains the cold overlap period produced by the variable valve overlap mechanism in a non-driven state before running of the internal combustion engine when the running status detected by the at least one running status detector defines a cold idling state; and produces a valve overlap responsive to the running status by driving the variable valve overlap mechanism when the running status detected by the at least one running status detector defines at least one hot running state.

9. An apparatus for controlling a valve timing of an internal combustion engine, comprising:

a variable valve overlap mechanism that:

adjusts an overlap between a valve opening period of an intake valve and a valve opening period of an exhaust valve by varying a phase difference in rotation between an intake cam and an exhaust cam of the internal combustion engine; and produces a phase difference in rotation that defines a cold overlap period when the variable valve overlap mechanism is not driven.

10. The apparatus according to claim 9, wherein the variable valve overlap mechanism comprises;

a rotation phase difference actuator that varies the overlap by changing a phase difference in rotation between the intake cam and the exhaust cam; and a non-drive valve overlap actuator that causes the rotation phase difference actuator to produce the phase difference in rotation between the intake cam and the exhaust cam that defines the cold overlap period when the variable valve overlap mechanism is not driven.

11. The apparatus according to claim 9, further comprising:

a rotation phase difference actuator that adjusts the overlap by changing a phase difference in rotation between the intake cam and the exhaust cam; and a non-drive valve overlap actuator that causes the rotation phase difference actuator to produce the phase difference in rotation between the intake cam and the exhaust cam that defines the cold overlap period when the variable valve overlap mechanism is not driven after the cranking of the internal combustion engine.

12. The apparatus according to claim 9, further comprising:

at least one running status detector that detects a running status of the internal combustion engine; and a valve overlap controller that:

maintains the cold overlap period produced by the variable valve overlap mechanism in a non-driven state before running of the internal combustion engine when the running status detected by the at least one running status detector defines a cold idling state;

decreases the valve overlap from the cold overlap period by driving the variable valve overlap mechanism when the running status of the internal combustion engine detected by the running status detector defines a hot idling state; and increases the valve overlap from the valve overlap in the hot idling state by driving the variable valve overlap mechanism when the running status detected defines a hot non-idling state.

13. A valve timing control apparatus for controlling an open and close timing of at least one of a first valve and a second valve that open and close passages to a combustion chamber of an internal combustion engine, the control apparatus comprises a controller that:

increases an overlap between a valve opening period of the first valve and a valve opening period of the second valve when a running status of the internal combustion engine is cold idling, and decreases the overlap between the valve opening period of the first valve and the valve opening period of the second valve when the running status of the internal combustion engine is hot idling, wherein the controller controls the valve timing such that:

a cold idling valve overlap is produced when the running status of the internal combustion engine is cold idling, and no valve overlap is produced when the running status of the internal combustion engine is hot idling.

14. An apparatus for controlling a valve timing of an internal combustion engine, comprising:

at least one running status detector that detects a running status of the internal combustion engine; and a valve overlap controller that:

maintains a cold valve overlap produced by a variable valve overlap mechanism in a non-driven state before running of the internal combustion engine when the running status detected by the at least one running status detector defines a cold idling state; and produces a valve overlap responsive to the running status by driving the variable valve overlap mechanism when the running status defines at least one hot running state.

* * * * *